US010180019B2

(12) United States Patent
Kovac

(10) Patent No.: US 10,180,019 B2
(45) Date of Patent: Jan. 15, 2019

(54) ENHANCED SECURITY HANDCUFF APPARATUS

(71) Applicant: Creative Law Enforcement Resources, Inc., South Pasadena, CA (US)

(72) Inventor: Kresimir Kovac, Fountain Valley, CA (US)

(73) Assignee: Creative Law Enforcement Resources, Inc., South Pasadena, CA (US)

( * ) Notice: Subject to any disclaimer, the term of this patent is extended or adjusted under 35 U.S.C. 154(b) by 0 days.

(21) Appl. No.: 15/405,914

(22) Filed: Jan. 13, 2017

(65) Prior Publication Data

US 2017/0122011 A1 May 4, 2017

Related U.S. Application Data

(63) Continuation-in-part of application No. 14/919,200, filed on Oct. 21, 2015, now Pat. No. 9,551,170.

(51) Int. Cl.

| | |
|---|---|
| ***E05B 75/00*** | (2006.01) |
| ***E05B 35/00*** | (2006.01) |
| ***E05B 27/00*** | (2006.01) |

(52) U.S. Cl.

CPC ..... *E05B 75/00* (2013.01); *E05B 27/0003* (2013.01); *E05B 35/008* (2013.01)

(58) Field of Classification Search

CPC ..... E05B 75/00

See application file for complete search history.

(56) References Cited

U.S. PATENT DOCUMENTS

| | | | | |
|---|---|---|---|---|
| 1,579,333 A * | 4/1926 | Neal | E05B 75/00 70/16 |
| 1,775,727 A * | 9/1930 | Latou | E05B 75/00 70/16 |
| 1,851,206 A * | 3/1932 | Neal | E05B 75/00 70/16 |
| 4,314,466 A | 2/1982 | Harris | |
| 4,509,346 A | 4/1985 | Szczepanek | |
| 5,463,884 A | 11/1995 | Woo | |

(Continued)

FOREIGN PATENT DOCUMENTS

GB 2439088 12/2007

OTHER PUBLICATIONS

James E. Harris, "A Study of Handcuff Improvements", 1980, USA.
Jie Zhang, Bi Lingxia, "Creative Thinking in Product Innovative Design: A Handcuff Case Study" 2014, China.

*Primary Examiner* — Christopher J Boswell

(74) *Attorney, Agent, or Firm* — Smyrski Law Group, A P.C.

(57) ABSTRACT

A handcuff design is provided, including a handcuff strand having ratchet teeth with openings formed therein, a ratchet button comprising teeth configured to interface with the openings formed in the handcuff strand, a universal handcuff key receptacle configured to receive a universal handcuff key, a pawl arrangement including a rotatable pawl element configured to be moved in a direction away from the handcuff strand by the universal handcuff key, the pawl arrangement including a spring mechanism, and a lock bar configured to impede movement of the pawl arrangement unless moved to an unlocked position.

24 Claims, 109 Drawing Sheets

(56) References Cited

U.S. PATENT DOCUMENTS

| | | | | |
|---|---|---|---|---|
| 5,660,064 | A | 8/1997 | Ecker | |
| 5,743,117 | A | 4/1998 | Woo | |
| 6,851,284 | B2 * | 2/2005 | Kim | E05B 75/00 70/16 |
| 7,424,811 | B2 * | 9/2008 | Ham | E05B 75/00 70/16 |
| 8,210,006 | B2 | 7/2012 | Huang | |
| 8,336,345 | B2 | 12/2012 | Burgoon | |
| 8,353,183 | B1 | 1/2013 | Lofgren | |
| 8,769,998 | B1 | 7/2014 | MacConnell | |
| 8,776,555 | B1 | 7/2014 | Lofgren | |
| 2006/0162398 | A1 * | 7/2006 | Parsons | E05B 75/00 70/16 |
| 2007/0256461 | A1 * | 11/2007 | Parsons | E05B 75/00 70/16 |
| 2012/0085135 | A1 | 4/2012 | Louden | |
| 2013/0192314 | A1 | 8/2013 | Cheng | |

* cited by examiner

FIG. 1BB
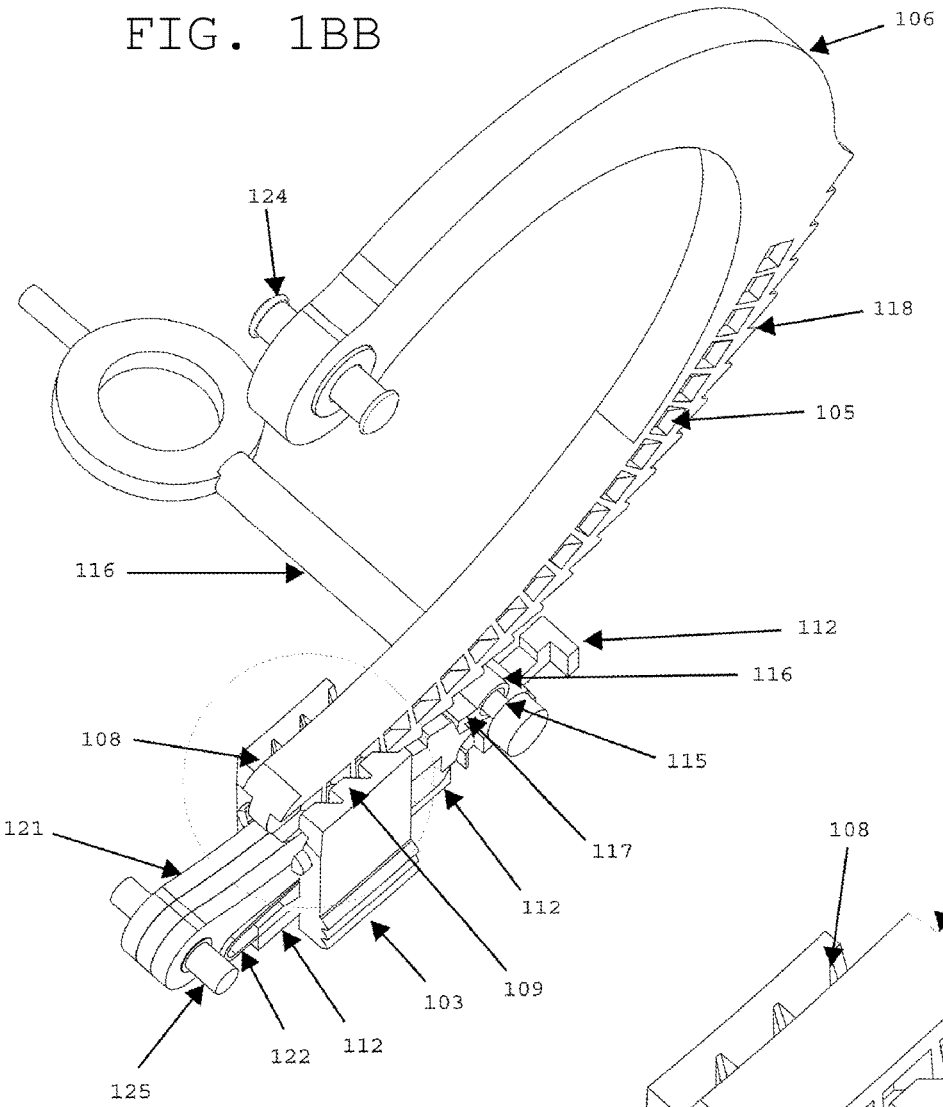
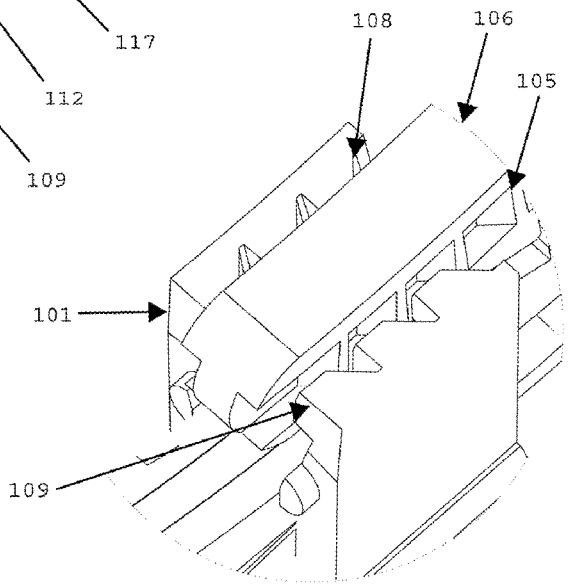
FIG. 1CC

FIG. 1DD
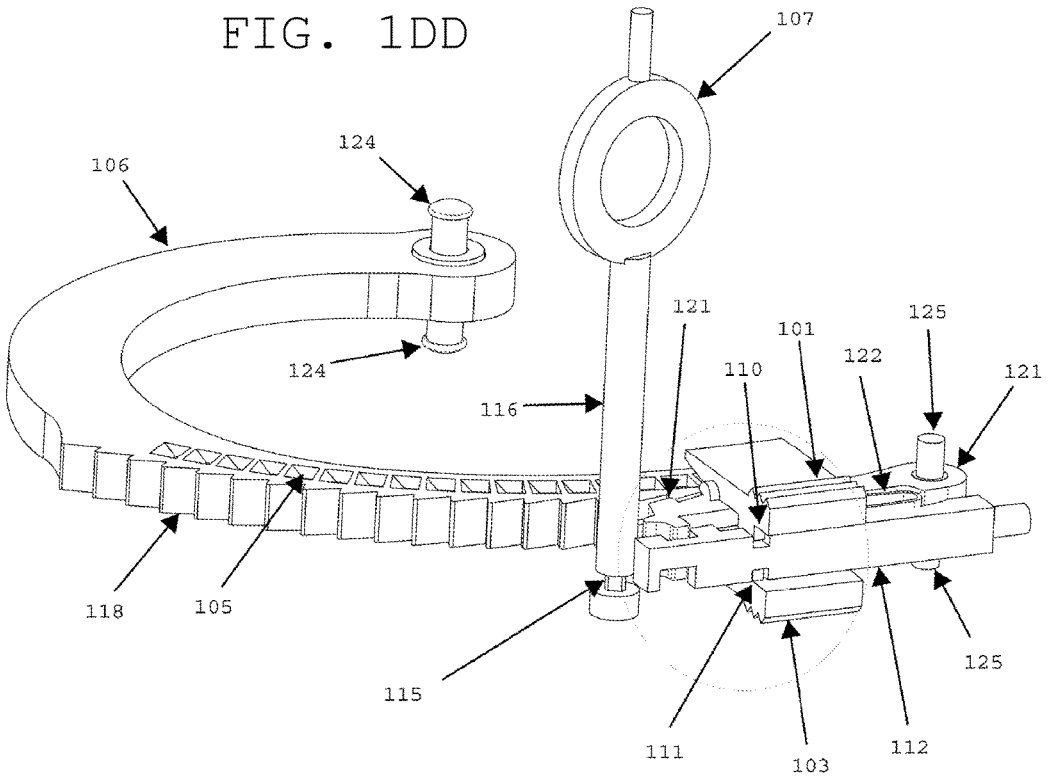
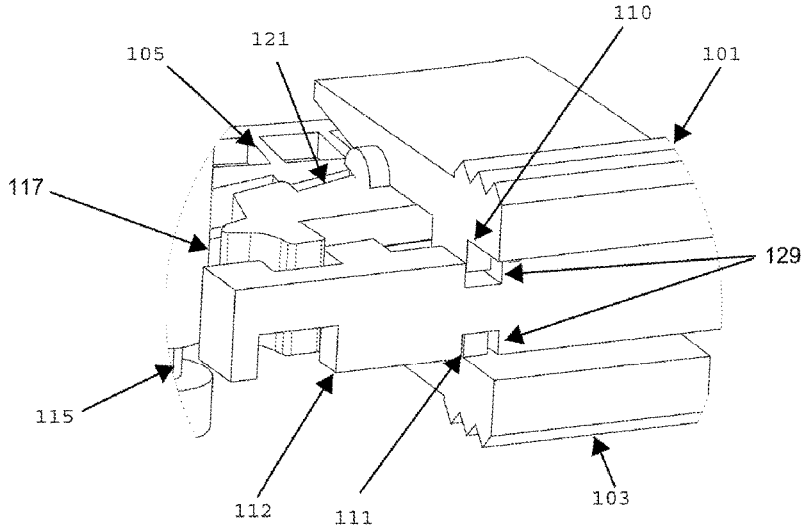
FIG. 1EE

FIG. 1QQ
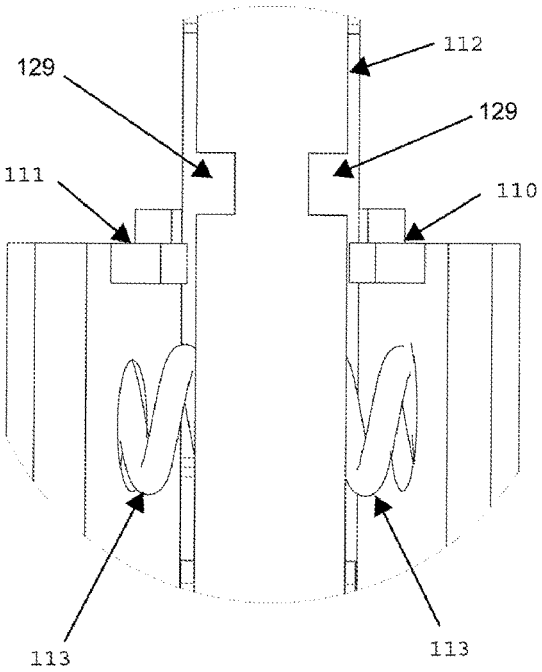
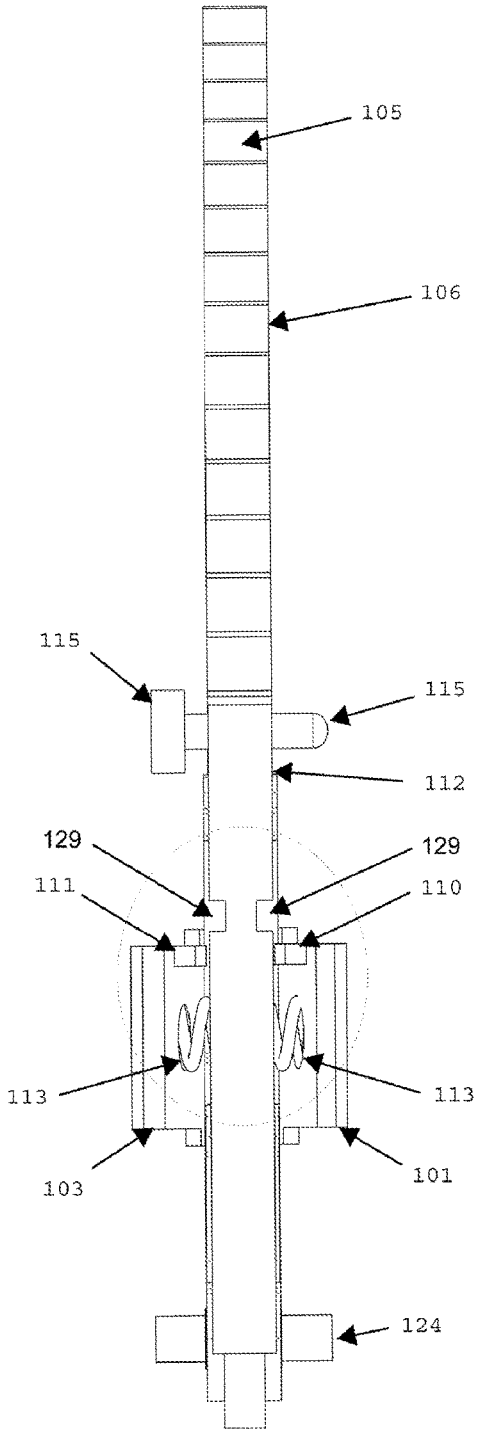
FIG. 1PP

FIG. 3C
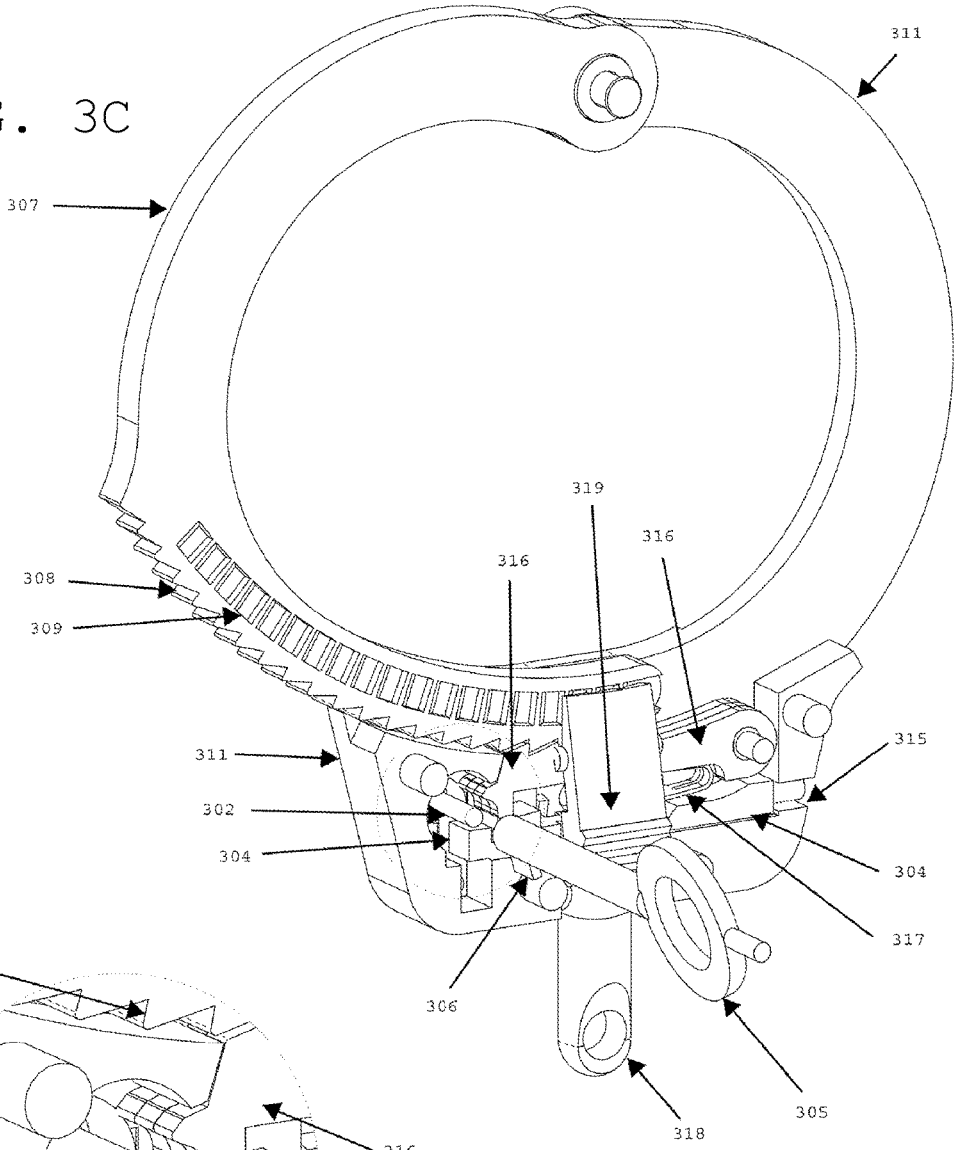
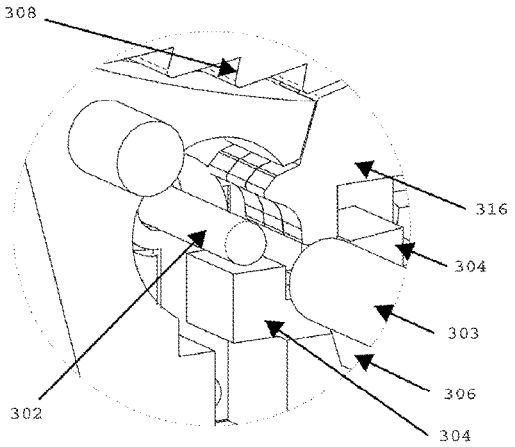
FIG. 3D

FIG. 3F
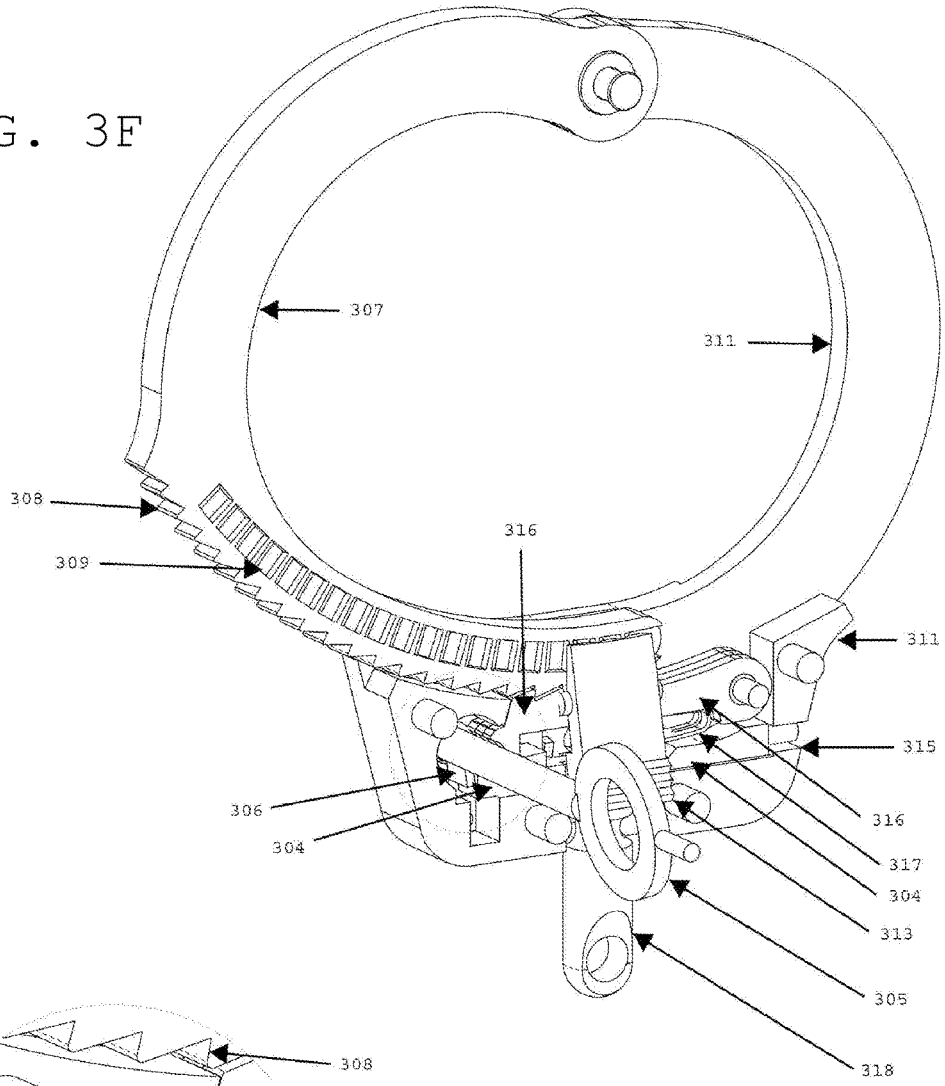
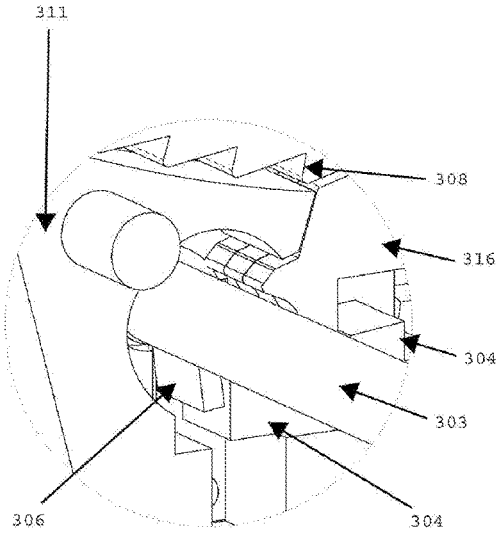
FIG. 3G

FIG. 4N
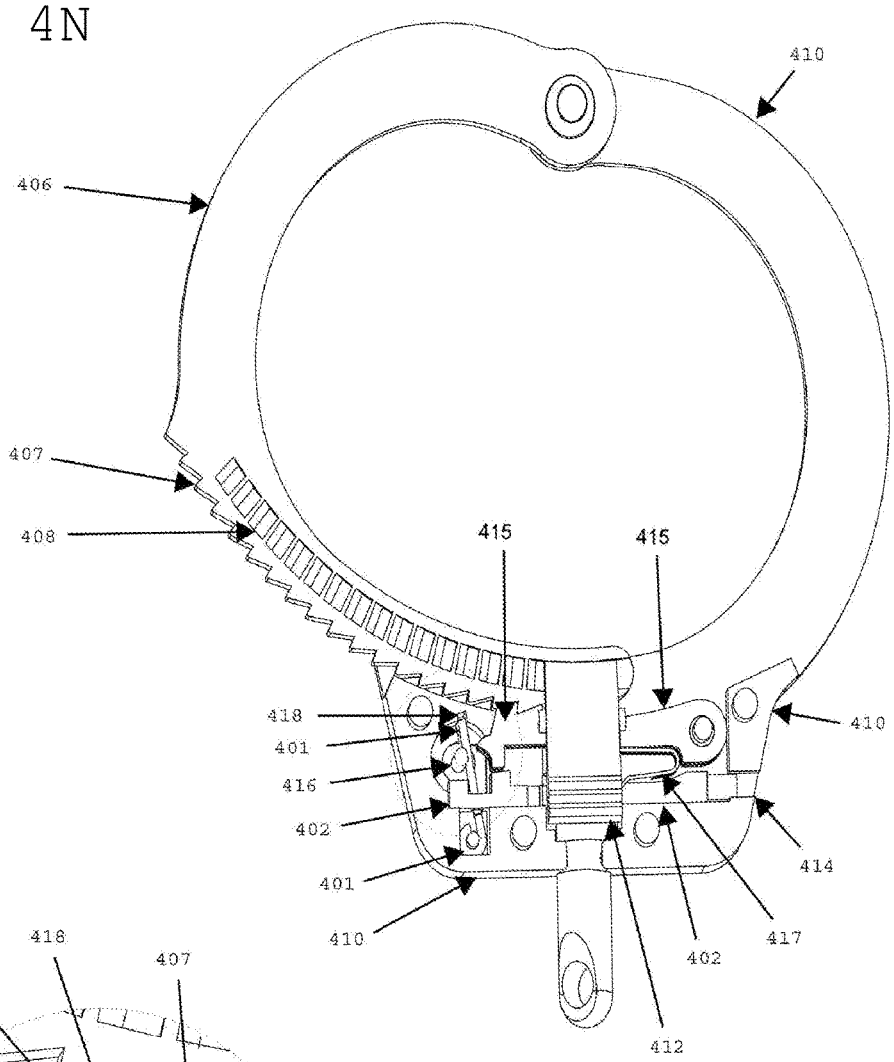
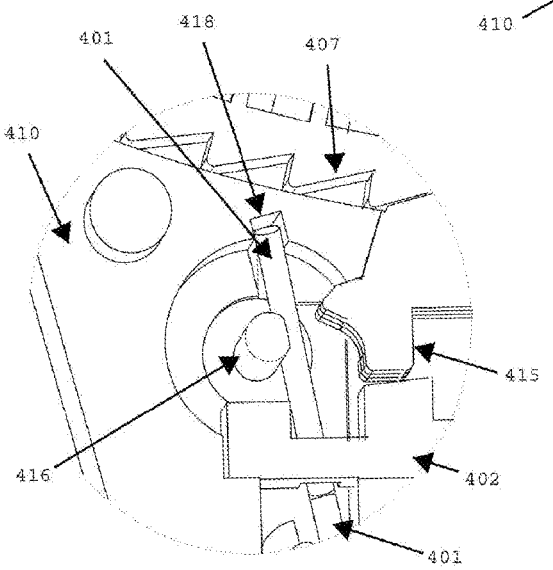
FIG. 4O

FIG. 5B
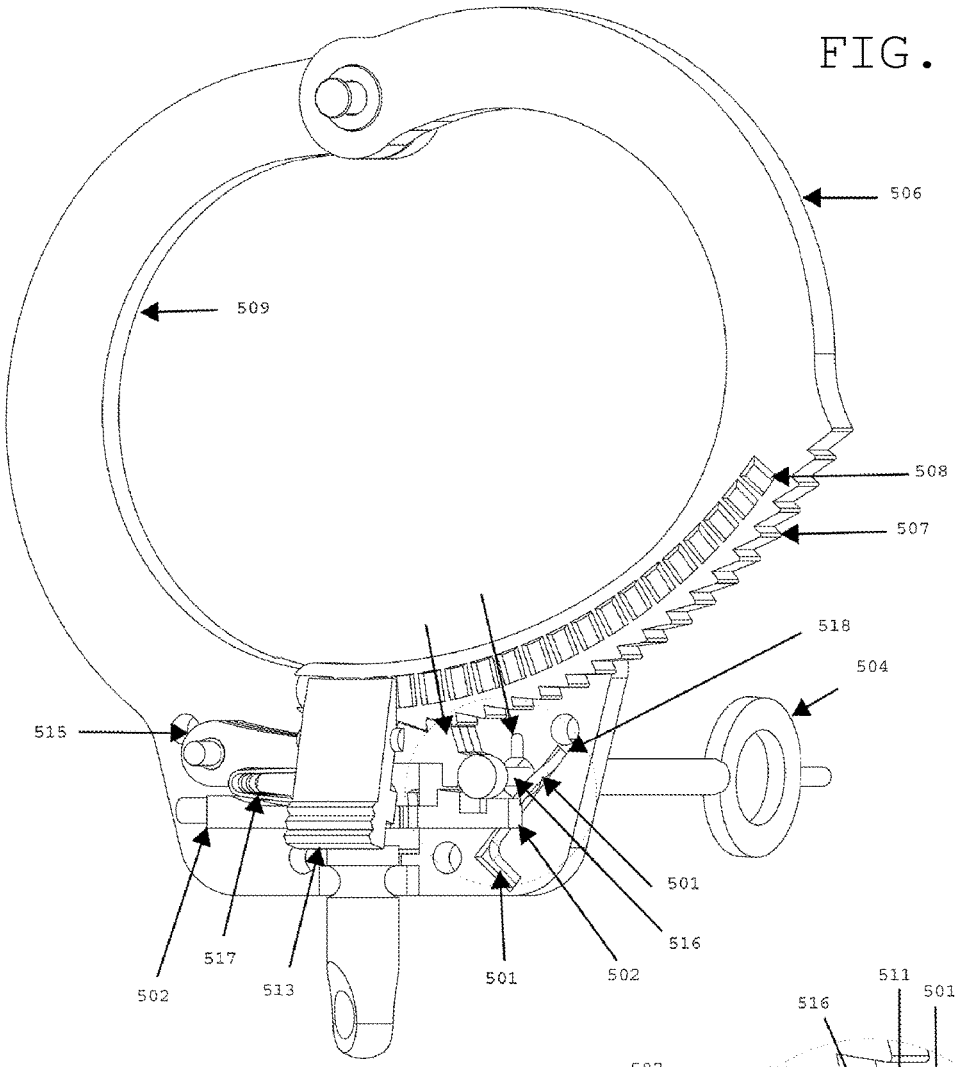
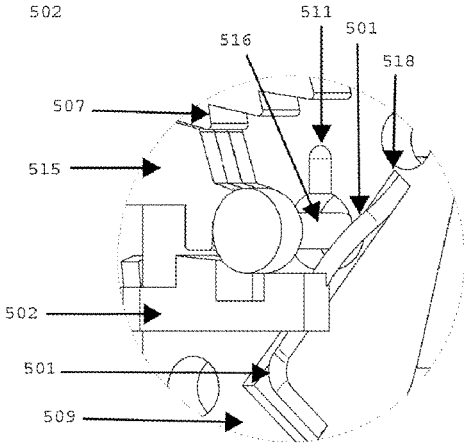
FIG. 5C

FIG. 5D
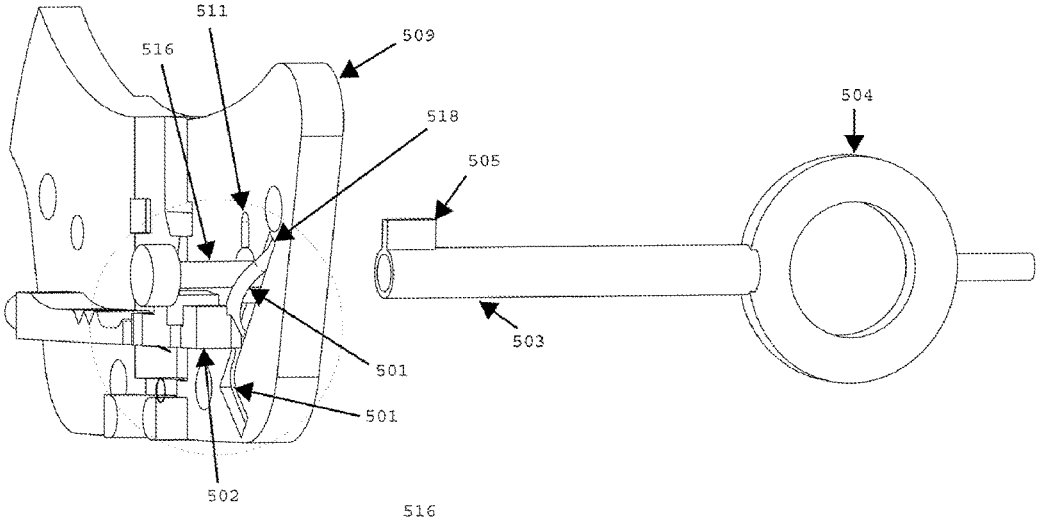
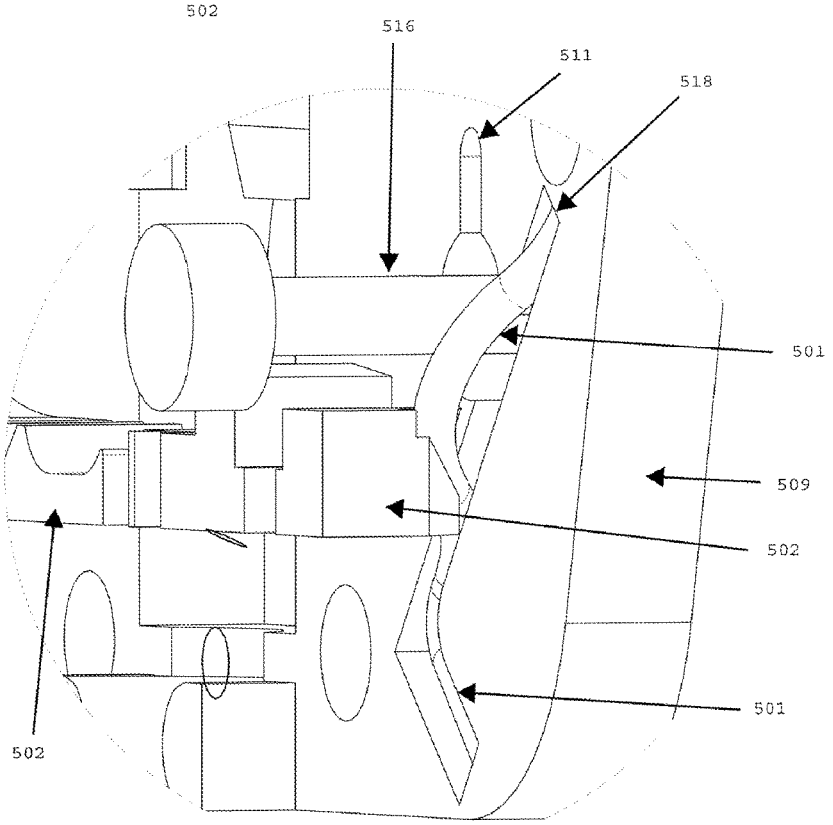
FIG. 5E

FIG. 5L
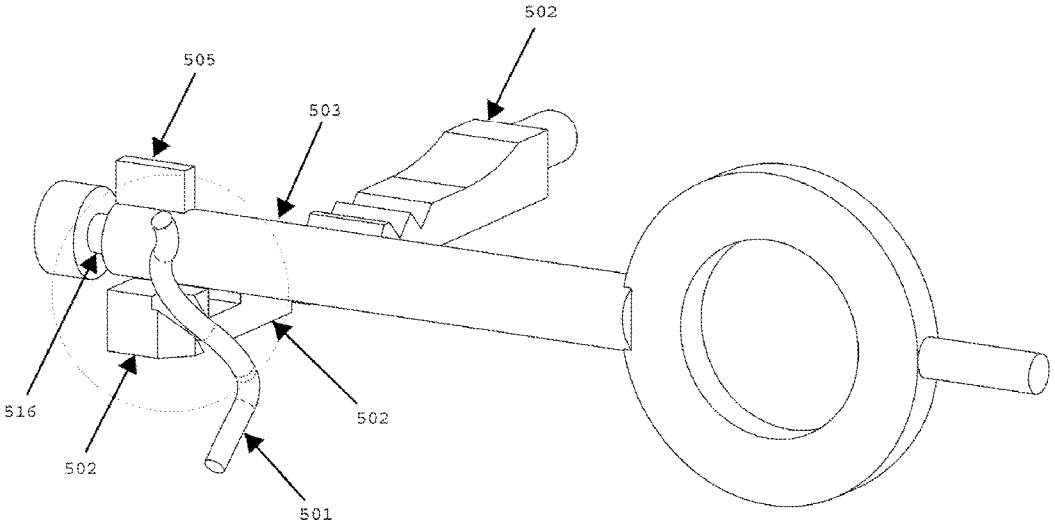
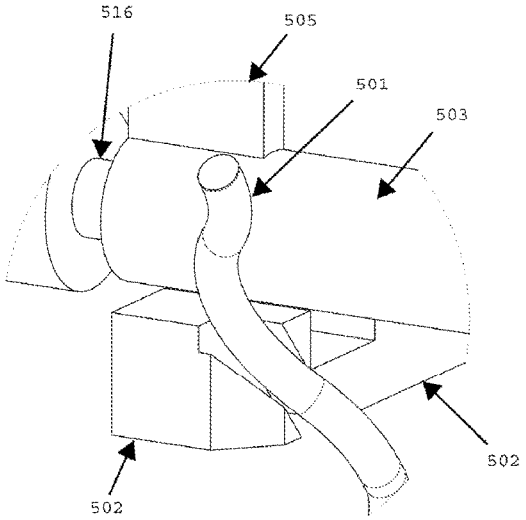
FIG. 5M

FIG. 5S
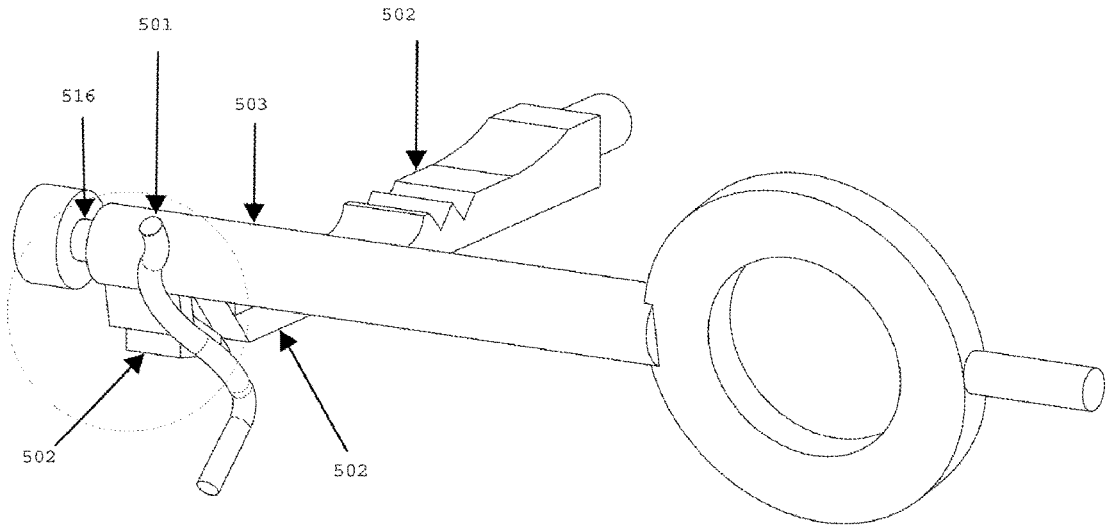
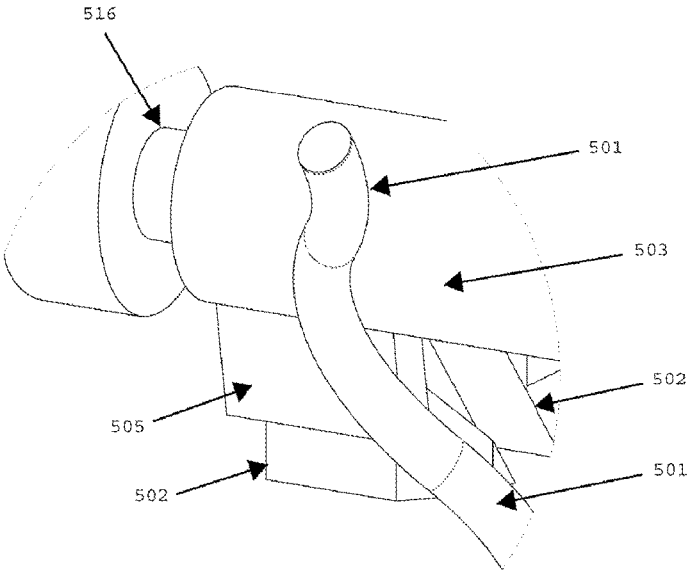
FIG. 5T

FIG. 5V
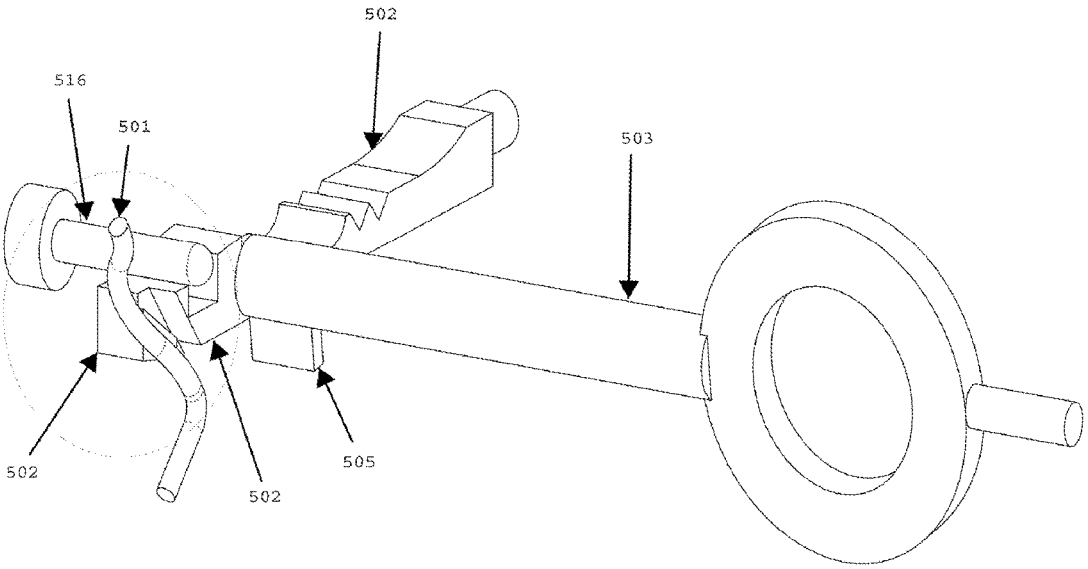
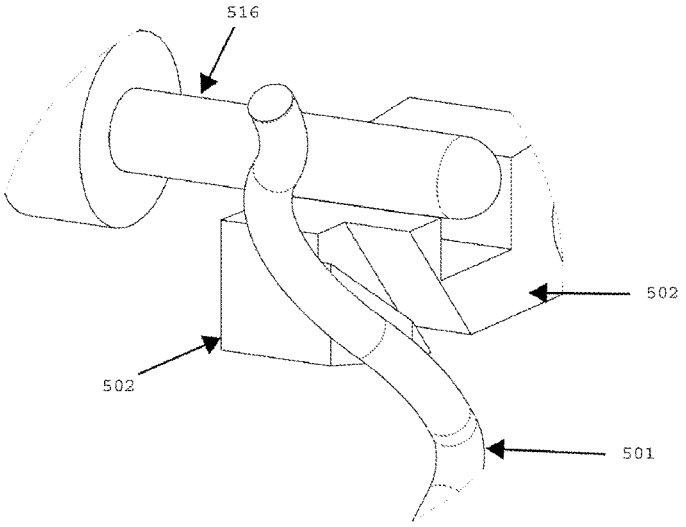
FIG. 5W

FIG. 6E
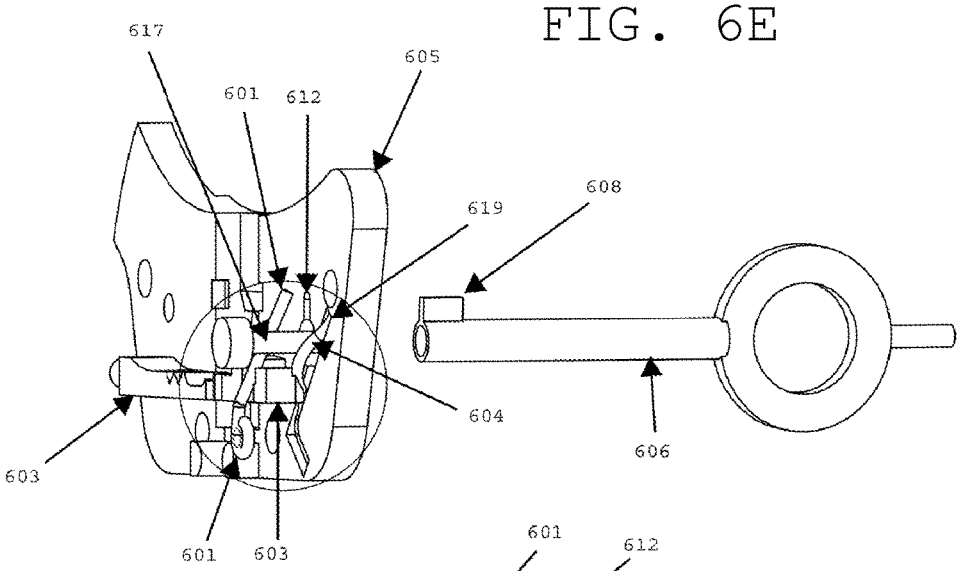
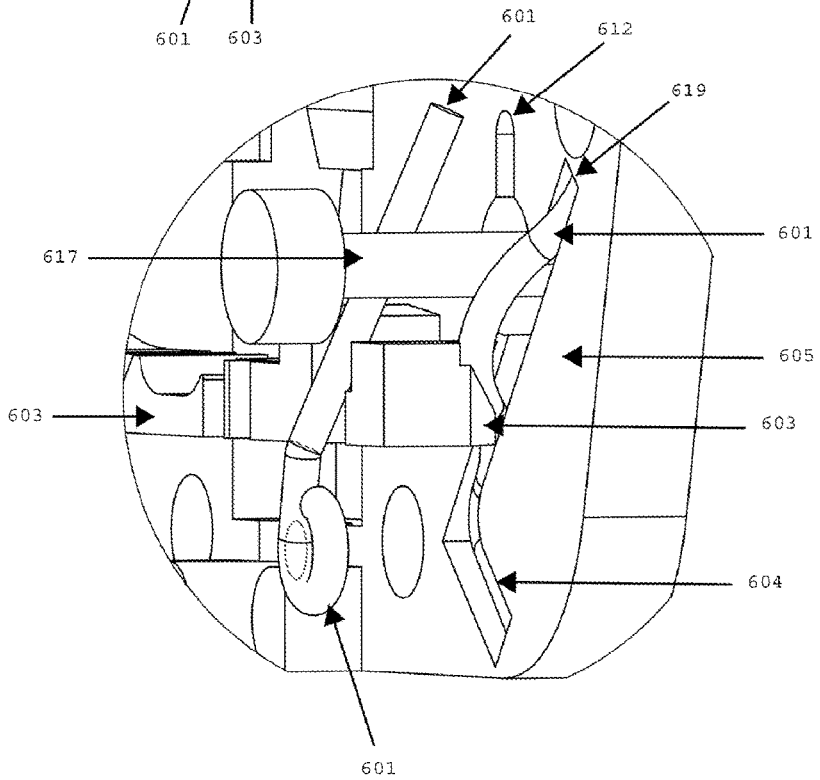
FIG. 6F

FIG. 6H
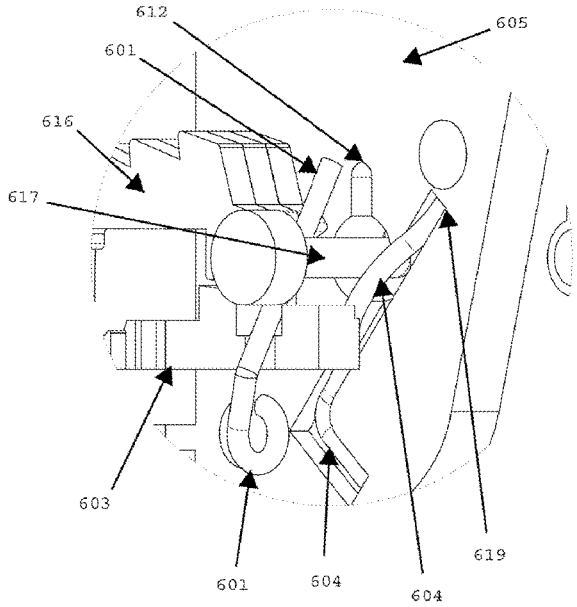
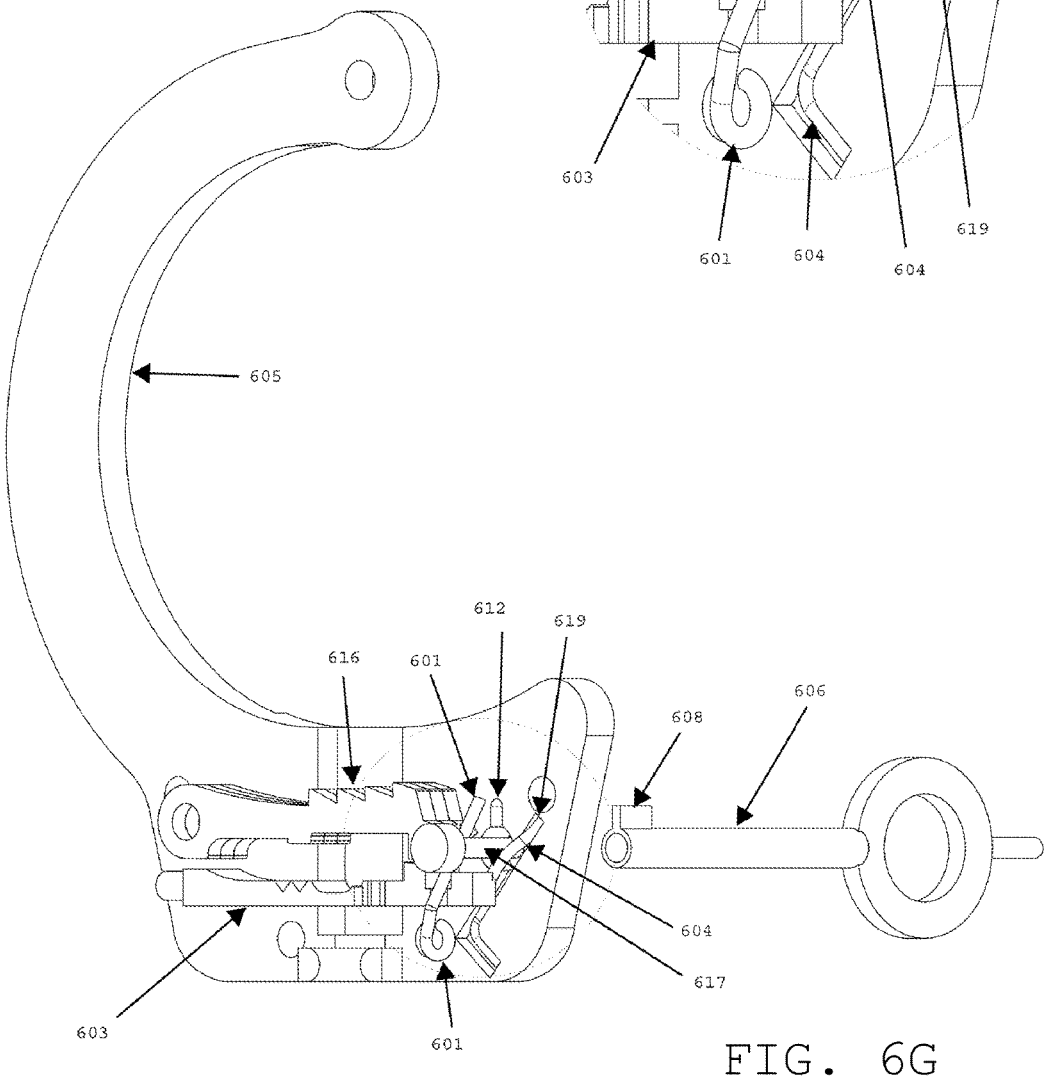
FIG. 6G

FIG. 6M
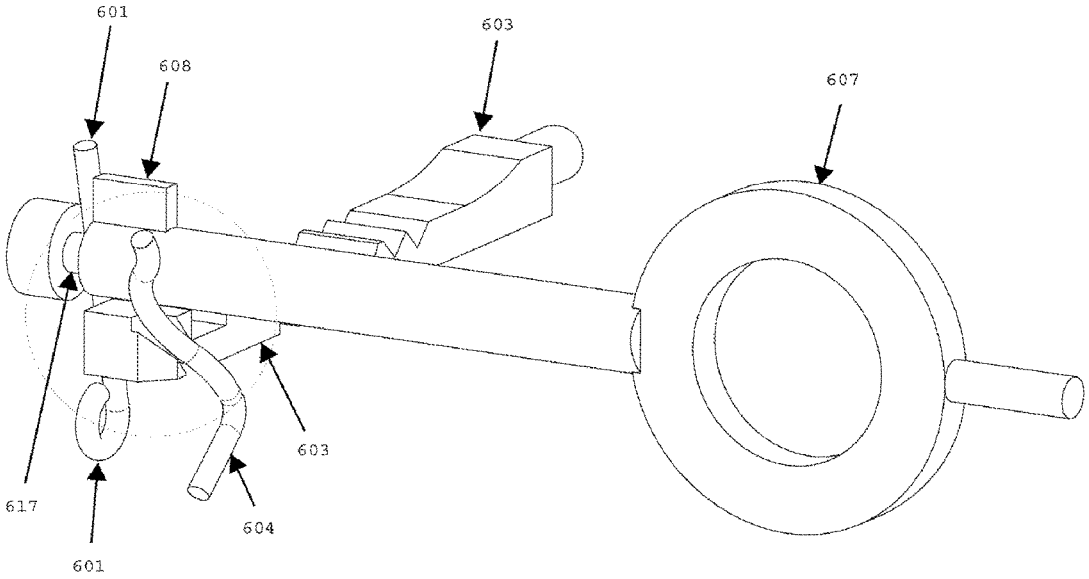
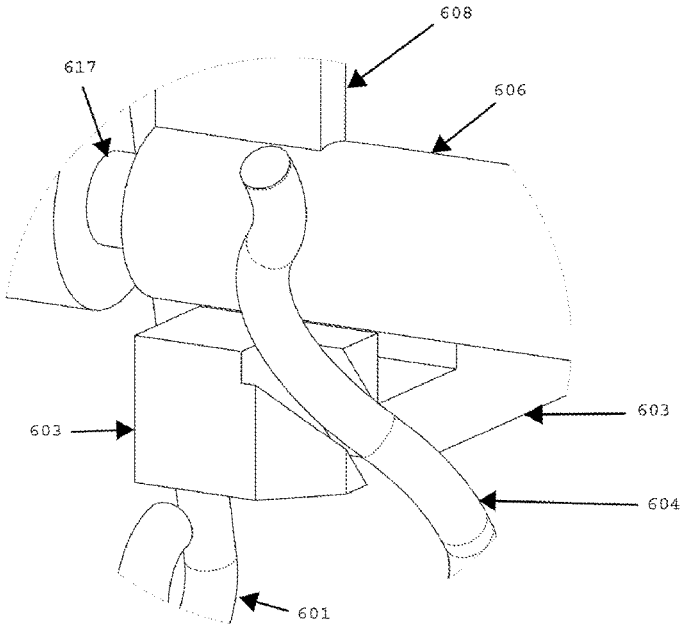
FIG. 6N

FIG. 6T
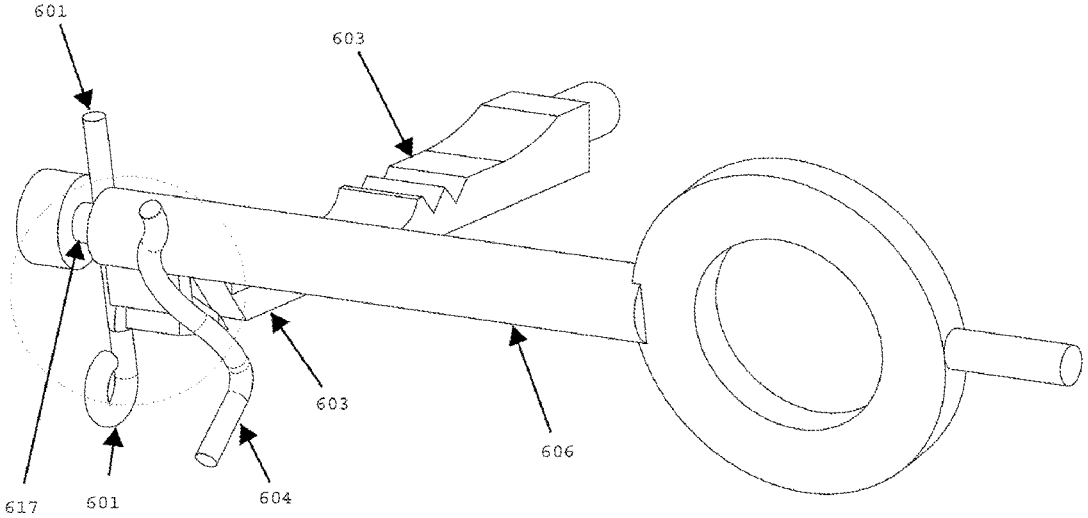
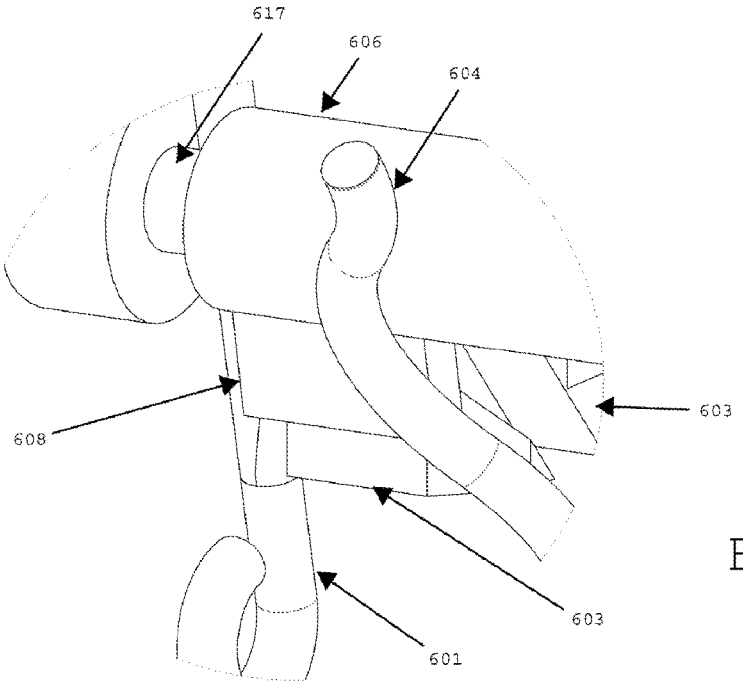
FIG. 6U

FIG. 6W
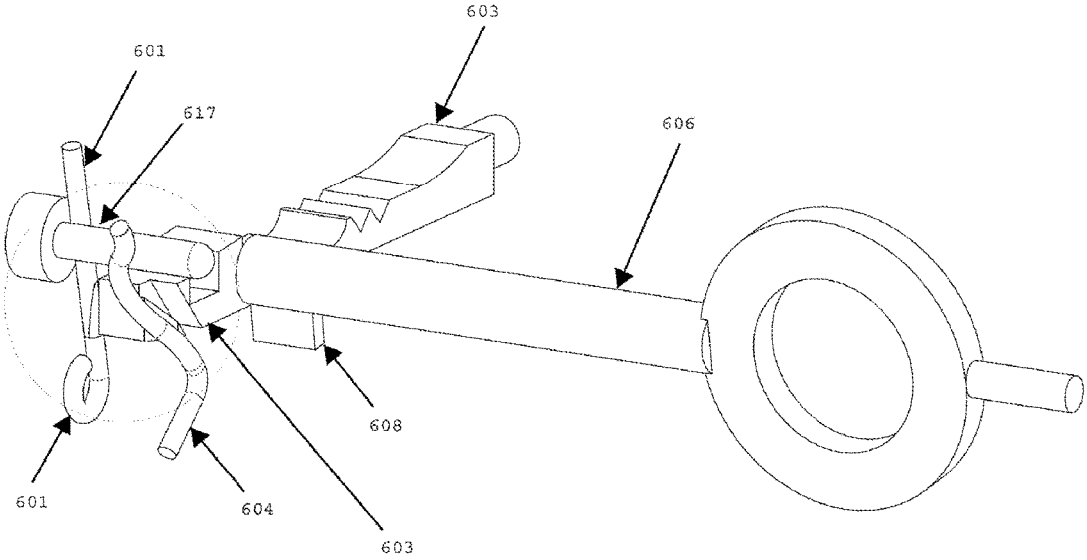
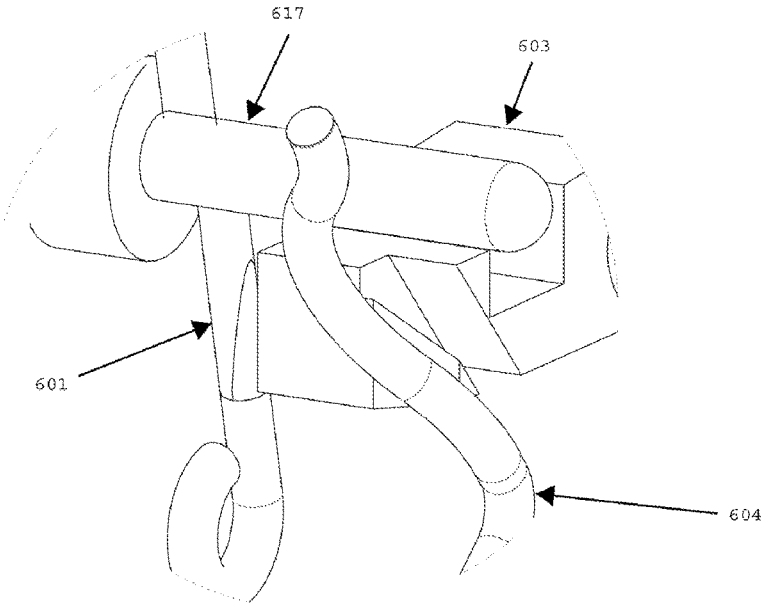
FIG. 6X

FIG. 7F
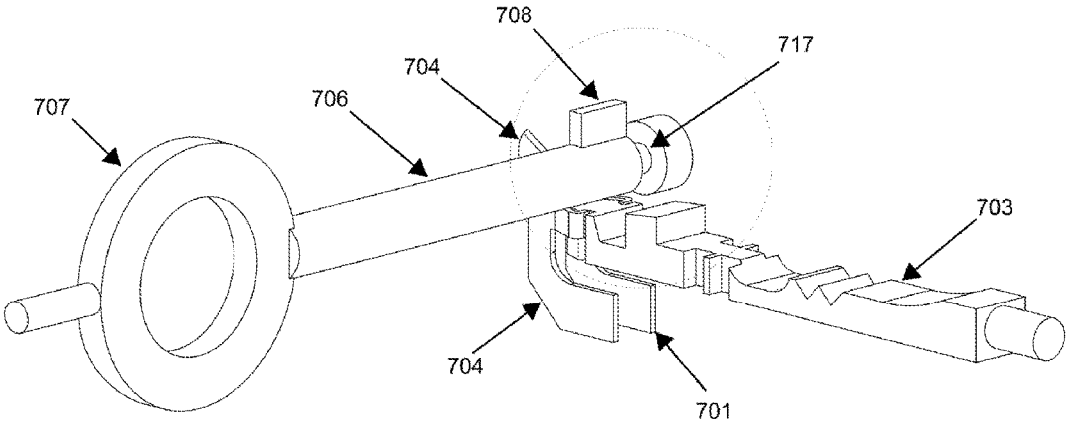
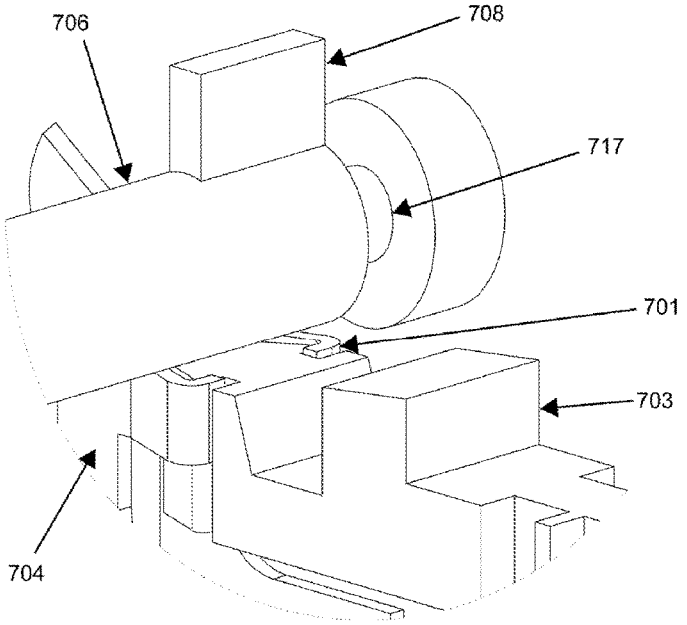
FIG. 7G

FIG. 7J
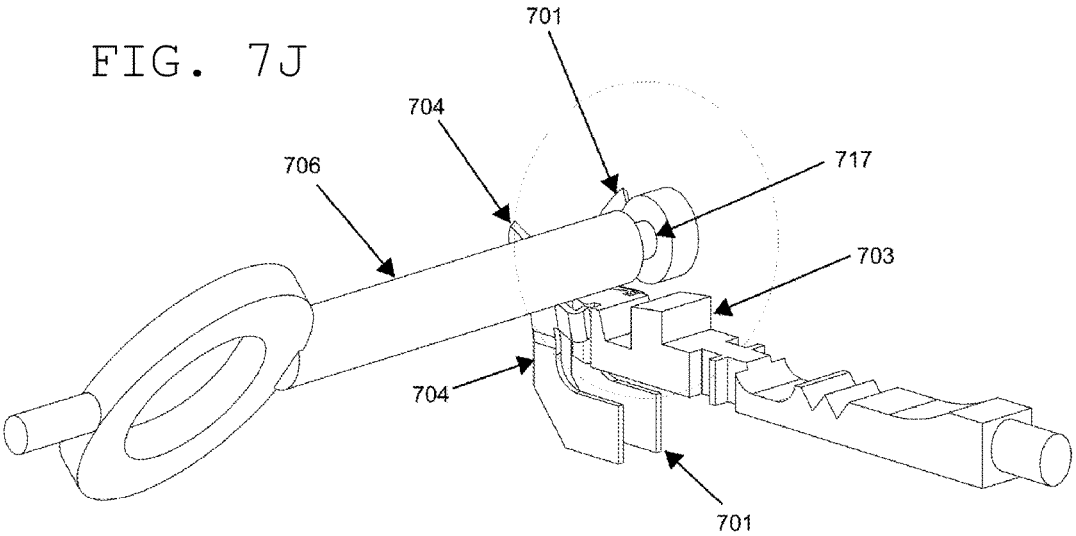
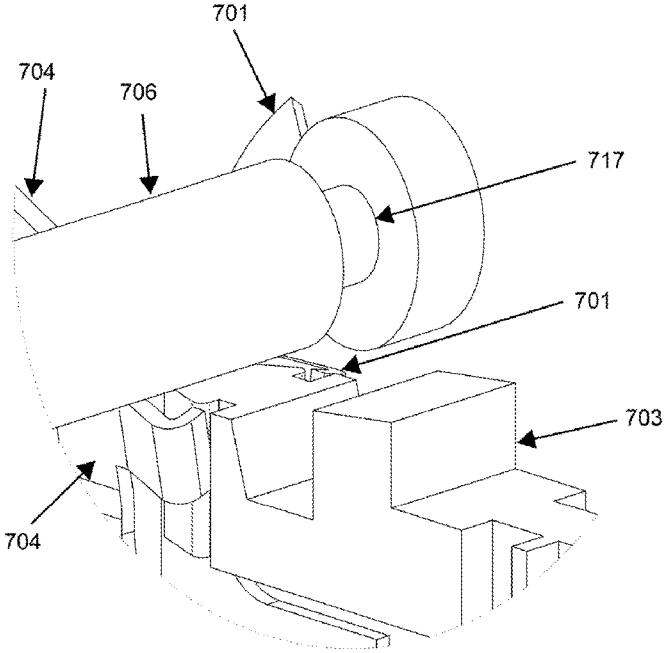
FIG. 7K

FIG. 7M
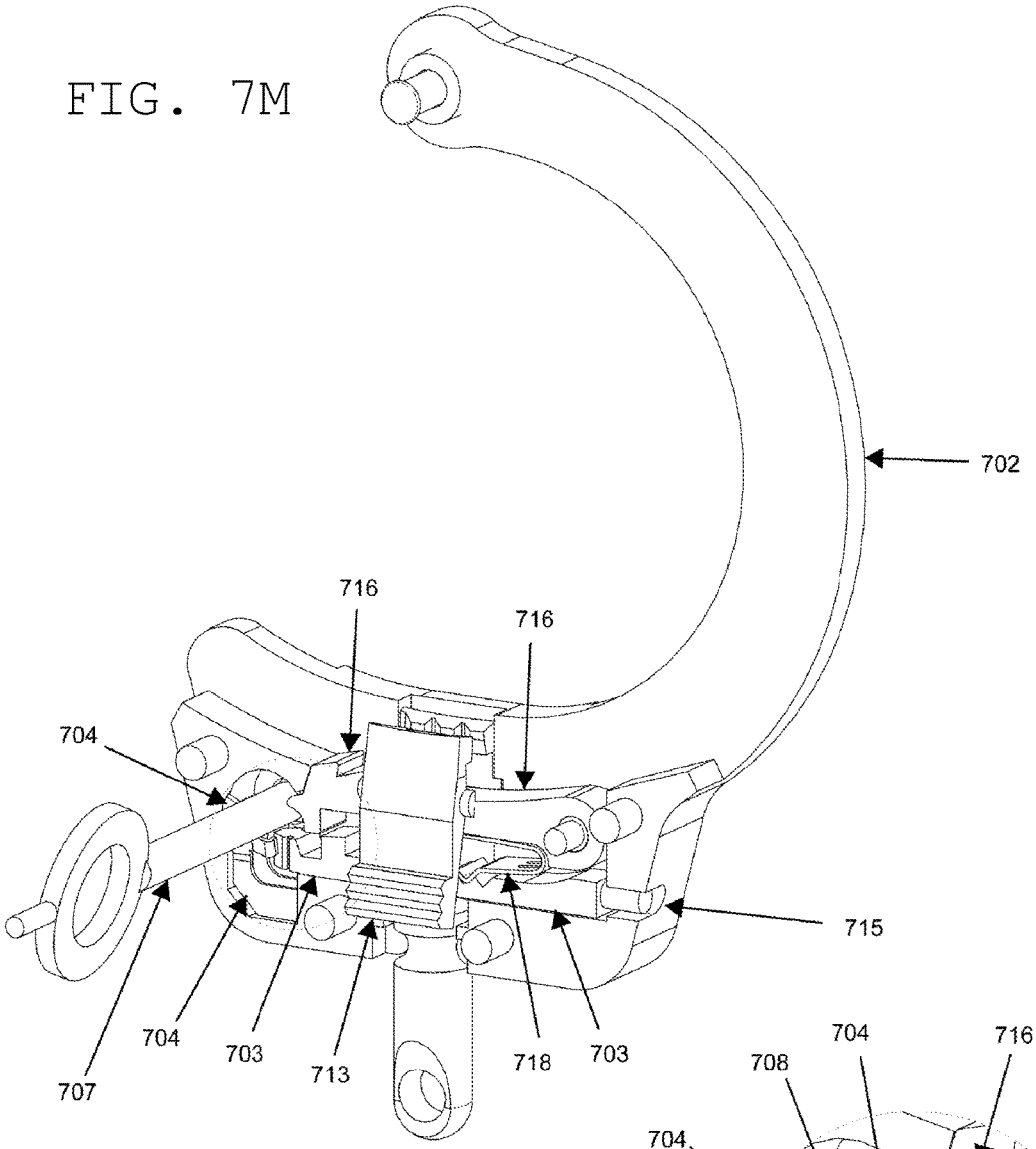
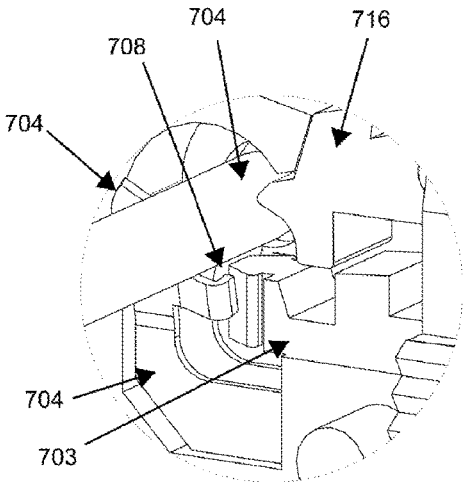
FIG. 7N

ENHANCED SECURITY HANDCUFF APPARATUS

This application is a continuation-in-part of, and claims priority based on, co-pending U.S. patent application Ser. No. 14/919,200, entitled "Handcuff Apparatus," inventor Kresimir Kovac, filed Oct. 21, 2015, the entirety of which is incorporated herein by reference.

BACKGROUND

I. Field

The present disclosure relates generally to the field of personal restraint and securing of individuals, and more specifically to handcuffs used in various scenarios, such as law enforcement, military, corrections or private security.

II. Description of the Related Art

Handcuffs have been used for centuries to restrain individuals in various scenarios, including but not limited to prison or correctional facility scenarios. Use and construction of handcuffs and similar restraints are well known, and handcuffs are generally accepted as an effective restraint system for use by law enforcement, military personnel, security officers as well as various other entities worldwide. Handcuffs are a standard issued item of police equipment utilized by every major law enforcement agency in the world, and handcuffs and/or related restraints are currently in use by police officers, corrections officers, private security officers, military personnel, and so forth. The same may be said for other restraining devices, including but not limited to handcuffs, leg chains, finger cuffs, and any manner of mechanisms used to restrain a person's wrists, hands, arms, ankles, legs, feet, or any or other body part. As used herein, all these restraining devices will be generally referred to as "handcuffs" and the teachings herein may apply to other restraining devices while illustrated for use in, for example, restraining an individual by his or her wrists.

Handcuffs have for decades employed a standard ratchet teeth type locking system wherein a standard universal handcuff key is needed to unlock them. The basic design of handcuffs has been virtually unchanged for more than a century. Handcuffs are a critical piece of law enforcement equipment and very few viable alternatives to standard handcuffs exist. Although many manufacturers have attempted to create a more secure handcuff, these have largely been commercially unsuccessful and thus the same traditional handcuff style used decades ago is still in use today.

The standard handcuff in use by law enforcement today utilizes a bracelet type design placed around a wrist and secured via a ratchet, which is then locked into place. The teeth of the ratchet engage the teeth of the spring-loaded pawl located inside the bracelet and when the pawl is forced against the ratchet, the two sets of teeth are locked together. To release the handcuffs, the pawl must be disengaged from the ratchet teeth, which is accomplished with the use of a universal handcuff key. The handcuff key is rotated to disengage the primary lock. The design of the ratchet teeth and pawl allows for free movement of a piece called a single strand when tightening the handcuffs, but prevents the single strand from loosening unless the pawl is depressed so that it may no longer engage the ratchet teeth.

Each wrist of the wearer is secured with an individual handcuff, which is connected together via a small chain, hinge or solid locking component. This assembly is commonly referred to a set of handcuffs, a pair of handcuffs, "handcuffs" or any other term or phrase indicating two or more handcuffs secured together to form a unit capable of securing two or more appendages of a wearer.

These traditional and current handcuff designs are extremely susceptible to countermeasures and escape attempts such as lock picking. Lock picking is the practice of unlocking a lock by manipulating various components of the locking device without the use of the original key. For purposes of this document, the term "lock picking" will broadly be used to describe various countermeasures utilized in an attempt to defeat the security capabilities of handcuffs or related restraints.

In general, handcuffs may be opened in five ways: utilizing a handcuff key, picking the locking mechanism with a lock pick or similar tool, slipping the hands out of the handcuffs when the hands are smaller than the ratchet openings, releasing the pawl with a shim, or breaking the handcuff chain or swivel area commonly known as "handcuff breaking."

One significant issue with today's handcuffs is the ability to unlock the cuffs using a single common universal handcuff key. The universal handcuff key is simple in its design and encompasses a shaft, a bow which is used to grip the key, a single bit or tooth which engages the pawl of the handcuffs to release the single strand and a peg or pin used to engage the double locking mechanism. Due to the simple design of the key and corresponding locking mechanism inside the common handcuff, vulnerabilities exist in the design.

Many law enforcement officers utilize the universal handcuff key for operational and field expediency. Handcuffs are often placed on suspects and custody/care of the individual(s) is transferred to other law enforcement personnel. The need to have a common key is important to ensure efficiency when cuffing, uncuffing or transporting a person whether it is in a patrol environment, the courts, a jail system, prisons, or any other setting. Further, emergency situations can sometimes arise when releasing the individual is required for the individual's safety, and an unusual or remote key can potentially result in harm to the individual.

Due to this commonality of the handcuff key design, suspects and other non-law enforcement related personnel sometimes carry handcuff keys on their person in anticipation of defeating handcuff locking mechanisms. Variations of the universal handcuff key are often hidden and kept by criminals and inmates on their person with the intent to escape and/or assault someone. Handcuff keys have been known to be built into devices and/or attached to designs to be worn on a person's clothing or body wherein they are not readily recognized as a handcuff key. These surreptitious handcuff keys can then be quickly deployed and utilized to escape or attack an officer or other individual nearby. It common for prisoners inside jail and prisons to carry handcuff keys concealed inside their bodies, (mouth, rectum, etc.) which are difficult for peace officers to discover when conducting a search.

A lock pick is a tool such as paper clip, staple, piece of metal, piece of plastic or any other object which may be inserted into various areas of the handcuffs, including the keyhole, in order to manipulate the locking mechanism. These devices are often used to depress or move the pawl away from the ratchet teeth thereby disabling the locking mechanism. Lock picks are often difficult to detect by law enforcement officers and may often be created from items available in the handcuffed person's environment. For example, a handcuffed prisoner may find a common metal paperclip on the ground, pick it up and then utilize the paperclip to unlock the handcuffs in an effort to escape from custody.

Similarly, shims may be flat pieces of metal, plastic, cardboard any other material which are utilized to release the locking mechanism of the handcuffs. A handcuff shim is pushed between the pawl and the ratchet teeth of the single strand, thereby disengaging the pawls away from the single strand ratchet teeth. This allows the handcuff to be opened without placing an object into the keyhole in an attempt to manipulate the locking mechanism.

Books and instructional videos are readily available demonstrating various ways to open handcuffs—even by the wearer. These methods for picking standard handcuffs can be learned and completed with the use of a single hand by individuals even while handcuffed with their hands behind their backs.

Lock breaking refers to a method whereby the handcuffs are twisted in such a manner as to cause undue torsion on the small chain and swivels connecting the two handcuff assemblies. Additional tension is then exerted, with force, by the wearer so the chain or swivels breaks thereby freeing a suspect's hands. Such a vulnerability is also undesirable.

Peace officers and others who are skilled in the use of handcuffs are trained to always employ the double lock bar mechanism when utilizing handcuffs on suspect(s). The double lock system is a separate locking piece or double lock bar provided inside the handcuffs which provides additional security.

The double lock system enables employing a peg from a universal handcuff key to manipulate a double lock bar mechanism, which moves laterally under the pawl. The double lock bar can be set to prevent the pawl from being depressed thereby locking the single strand into place. Handcuffs with double locks have a detent, which when engaged, stops the cuff from ratcheting tighter and prevents over-tightening the cuffs. Tightening the handcuff ratchets could be intentional or may occur unintentionally when pressure is applied to the single strand ratchet. As a result, handcuffs incorrectly employed may cause nerve damage or loss of circulation in a wearer's hands due to over-tightening. Additionally, some wearers may tighten the handcuffs in order to attempt an escape by utilizing lock picking tools or having an officer loosen the handcuffs and subsequently attempting to escape while the handcuffs are loosened. Double locking the handcuffs makes picking handcuff locks more difficult and is generally always utilized by officers when securing a person's wrists or other body parts. The double lock bar system provides a second layer of security to the handcuffs, which first must be defeated prior to the primary locking mechanism of the handcuffs (pawl and ratchet teeth) being unlocked. The double lock bar needs to be moved into the unlocked position prior to attempting to defeat or unlock the primary locking mechanism of the handcuff. The primary locking mechanism of a handcuff is generally a pawl engaging with a single strand ratchet based system.

Another counter measure often utilized by persons restrained in a pair of handcuffs is the use of a lock picking tool to unlock the double lock bar safety mechanism in the pair of handcuffs. The person then generally utilizes the same tool to unlock the primary locking mechanism of the cuffs to escape.

If a suspect restrained with a pair of handcuffs does not have a lock pick or other tool, he or she may still disable the double lock feature by utilizing a technique called an "inertia strike." In this case, the suspect (while handcuffed) strikes the edge of the double strand of the handcuffs against a hard object with considerable force. The inertia of the strike, if executed properly, forces the double lock bar into the unlocked position. The suspect may then utilize a lock pick or shim (such as a piece of plastic) to open the handcuffs.

There is a need for enhanced security handcuffs which provides substantially greater security and an inability for them to be opened by the wearer. Security handcuffs should be simple to operate, should preferably have a generally similar form factor as current designs, and still utilize a universal handcuff key. Handcuffs should be extremely difficult, if not impossible, to open by the wearer of the handcuffs even if they are in possession of the handcuff key or other lock picking device. Handcuffs are preferably capable of easily being unlocked by an officer, utilizing a universal handcuff key, while at the same time avoiding the design limitations and vulnerabilities associated with earlier designs.

SUMMARY

According to one aspect of the design, there is provided a handcuff comprising a handcuff strand comprising ratchet teeth with openings formed therein, a ratchet button comprising teeth configured to interface with the openings formed in the handcuff strand, a universal handcuff key receptacle configured to receive a universal handcuff key, a pawl arrangement comprising a rotatable pawl element configured to be moved in a direction away from the handcuff strand by the universal handcuff key, the pawl arrangement comprising a spring mechanism, and a lock bar configured to impede movement of the pawl arrangement unless moved to an unlocked position.

According to another aspect of the design, there is provided a restraining arrangement comprising a releasable strand comprising ratchet teeth, the releasable strand having multiple openings formed therein and configured to tighten and loosen about a wearer, a ratchet button configured to pivot and engage at least one opening formed in the releasable strand, a universal key locking receiving mechanism configured to receive a universal key, a multiple element pawl arrangement comprising at least one pawl element configured to be moved in a direction away from the releasable strand by the universal key, the multiple element pawl arrangement comprising a spring mechanism, and a lock bar configured to impede movement at least part of the multiple element pawl arrangement unless moved to an unlocked position.

According to a further aspect of the design, there is provided a set of handcuffs comprising a releasable handcuff strand having a plurality of openings formed therein and comprising ratchet teeth, the releasable handcuff strand configured to tighten and loosen about a wearer, a universal key receptacle configured to receive a universal key, a ratchet button comprising protruding elements configured to interface with the openings formed in the releasable handcuff strand, a pawl arrangement comprising a rotatable pawl element configured to be moved in a direction away from the releasable handcuff strand using the universal key, and a lock bar configured to move linearly and impede movement of the pawl arrangement unless moved to an unlocked position. The double lock bar may have a singular safety mechanism or a multitude of safety mechanisms that prevent the inadvertent or unauthorized disengagement of the double lock bar system.

Various aspects and features of the disclosure are described in further detail below.

BRIEF DESCRIPTION OF THE DRAWINGS

FIG. 1AA is another view of the ratchet buttons being depressed and still further engaging with the ratchet side indentations;

FIG. 1BB shows a view of the ratchet buttons being depressed and extended engagement with the ratchet side indentations while a handcuff key engages the key pawls;

FIG. 1CC is an expanded view of engagement with the ratchet side indentations;

FIG. 1DD shows a view of the ratchet buttons being depressed and further engagement with the ratchet side indentations while a handcuff key engages the key pawls;

FIG. 1EE illustrates an expanded view of the ratchet buttons being depressed and further engagement with the ratchet side indentations while a handcuff key engages the key pawls;

FIG. 1FF is a bottom view of the ratchet buttons being depressed and the bottom ratchet button protrusions engaging with the double lock bar notches;

FIG. 1GG is an expanded view of the bottom of a cuff where the ratchet buttons are being depressed and the bottom ratchet button protrusions engage with the double lock bar notches;

FIG. 1HH shows a view of the ratchet buttons being depressed and the bottom ratchet button protrusions engaging with the double lock bar notches;

FIG. 1II is a close view of parts shown in FIG. 1HH;

FIG. 1JJ shows the double lock bar in the locked position;

FIG. 1KK is an expanded view of the double lock bar in the locked position;

FIG. 1LL shows a perspective view of the double lock notches not being in line with the bottom ratchet button protrusions;

FIG. 1MM is a bottom plan view of the representation of FIG. 1LL;

FIG. 1NN shows the double lock notches not being in line with the bottom ratchet button protrusions;

FIG. 1OO shows an expanded view of the double lock notches not aligned with the bottom ratchet button protrusions;

FIG. 1PP is a bottom view of the double lock bar in the locked position;

FIG. 1QQ is an expanded bottom view of the double lock bar in locked position;

FIG. 2AA shows a handcuff key depressing double lock bar security spring and pushing the double lock bar into the unlocked position;

FIG. 2BB shows the top view of the unlocked double lock bar holding the double lock bar security spring;

FIG. 3C shows the interior of the handcuff design;

FIG. 3D is an expanded view of the representation of FIG. 3C;

FIG. 3F is a handcuff key depressing double lock bar security spring and pushing the double lock bar into the unlocked position;

FIG. 3G is an expanded view of a handcuff key depressing double lock bar security spring and pushing the double lock bar into the unlocked position;

FIG. 4N shows the double lock bar security spring engaging the double lock bar;

FIG. 4O is an expanded view showing the double lock bar security spring engaging the double lock bar;

Figure 5A:
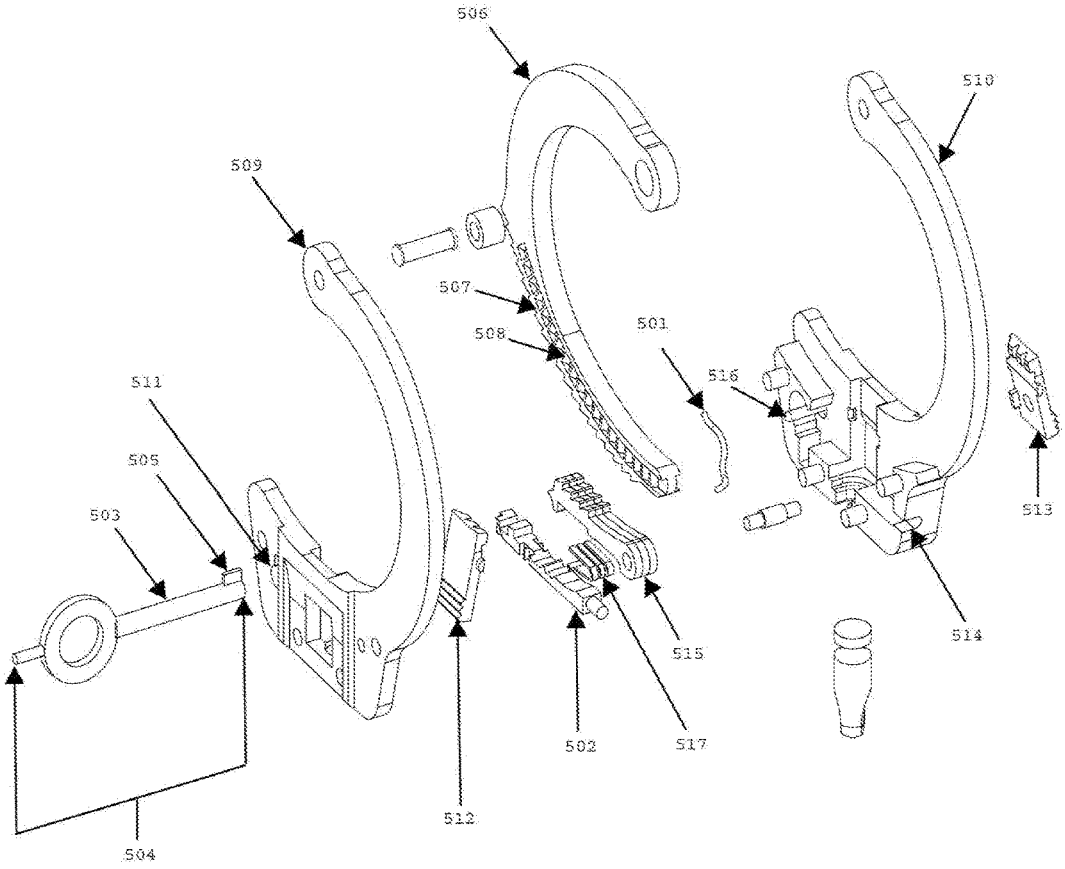
FIG. 5A illustrates an exploded view of a fifth embodiment.
Figure 5F:
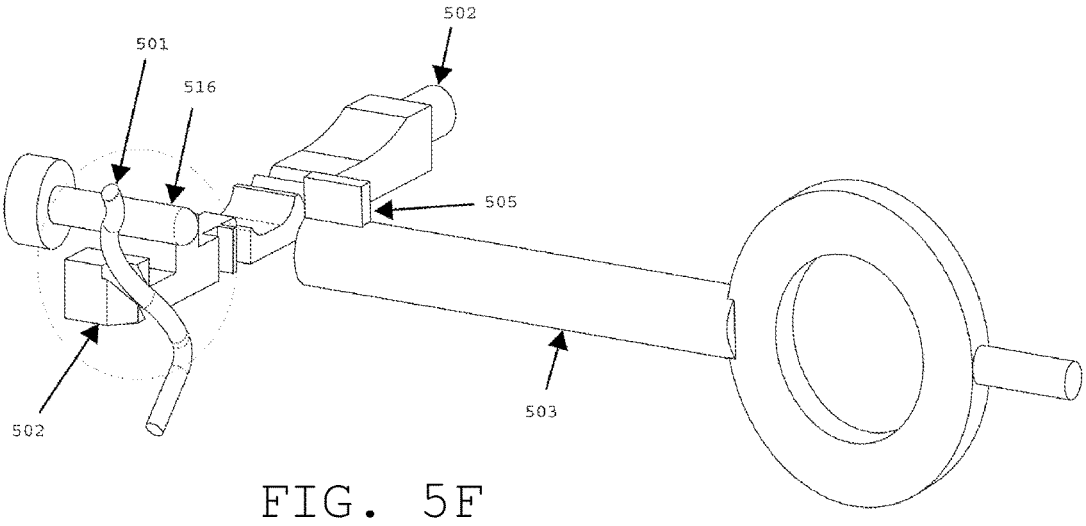
FIG. 5F further shows the double lock bar security spring engaging the double lock bar.
Figure 5G:
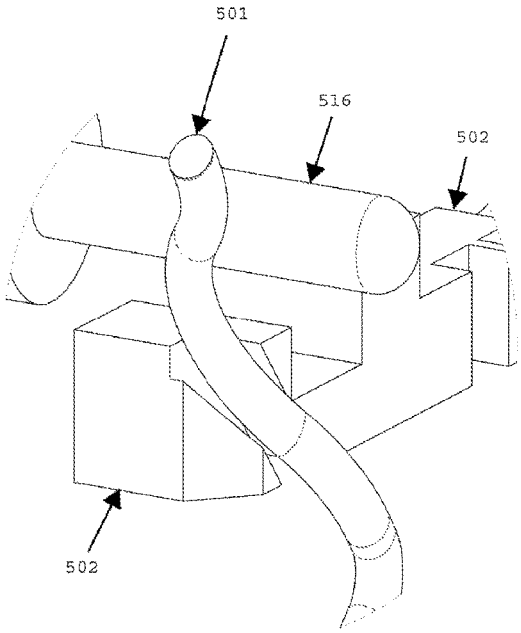
FIG. 5G is an expanded view further showing the double lock bar security spring engaging the double lock bar.
Figure 5H:
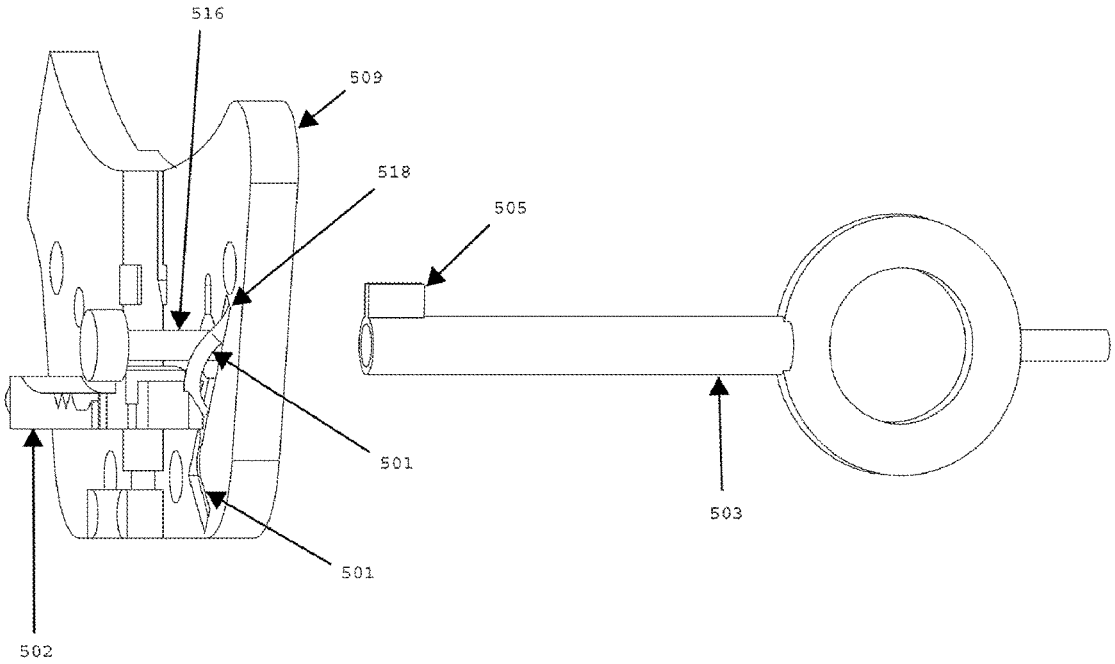
FIG. 5H illustrates the double lock bar security spring engaging the double lock bar.
Figure 5J:
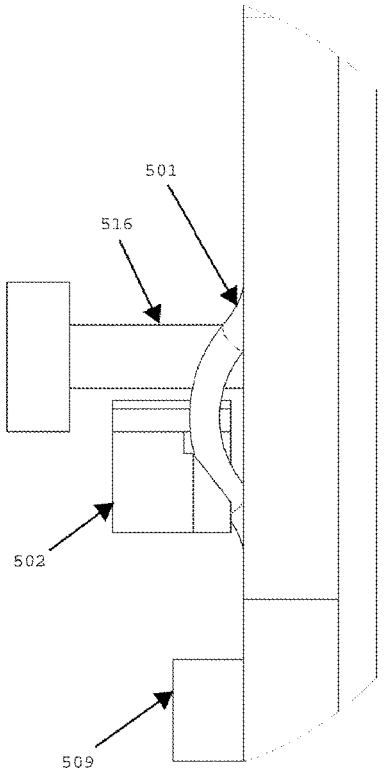
FIG. 5J is an expanded view showing the double lock bar security spring engaging the double lock bar.
Figure 5I:
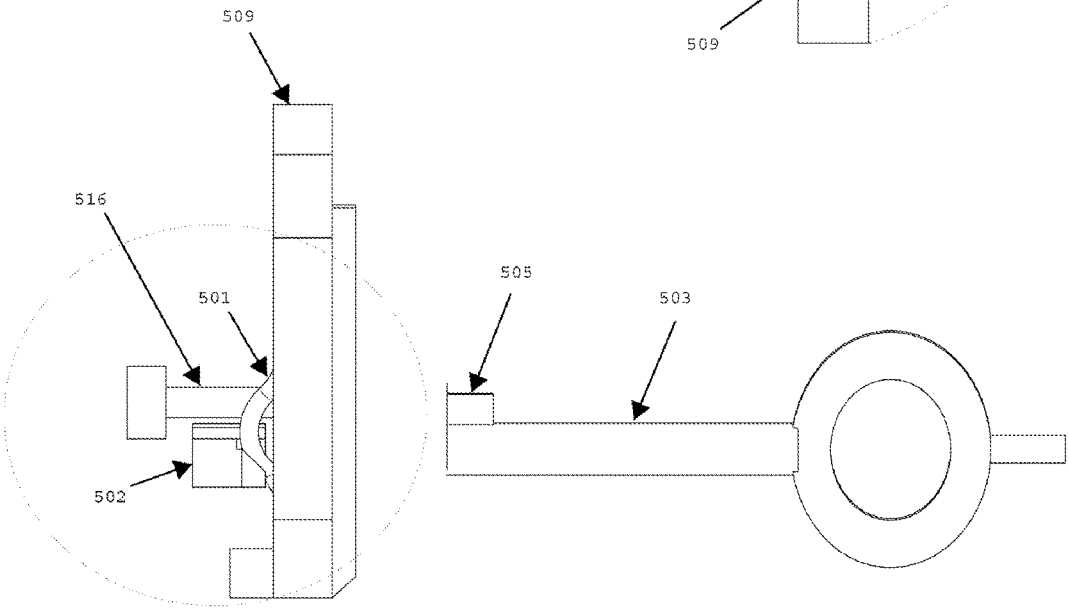
FIG. 5I shows the double lock bar security spring engaging the double lock bar.
Figure 5K:
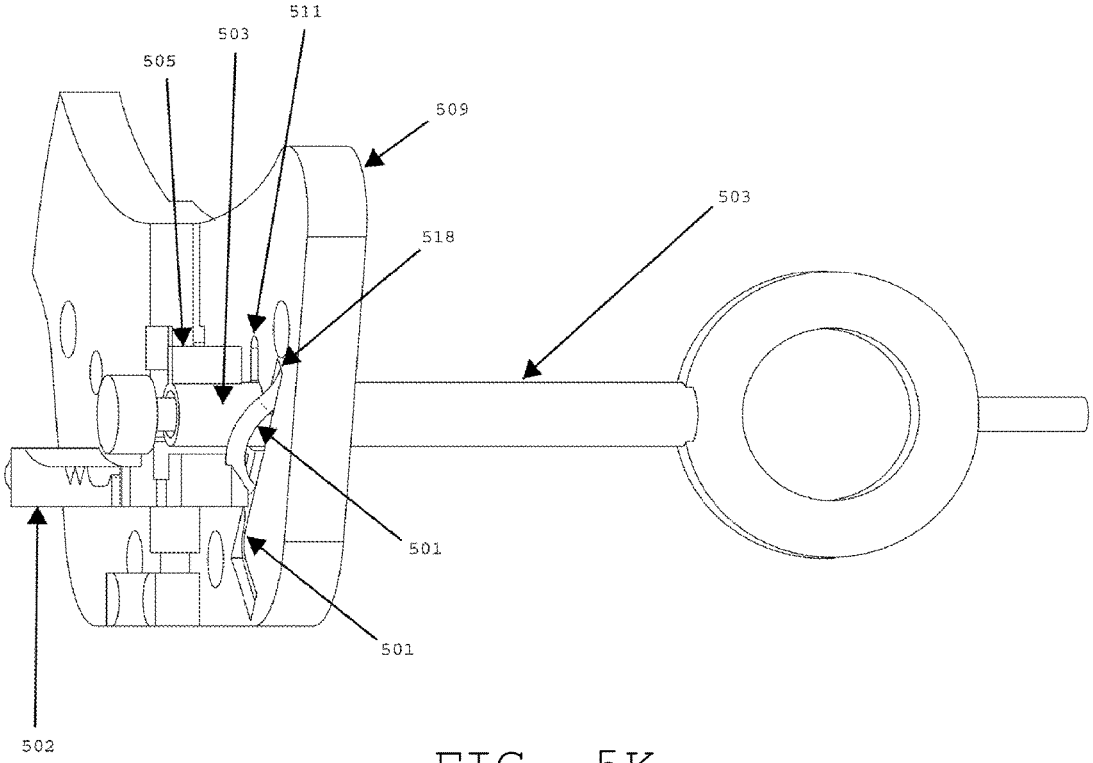
FIG. 5K shows a handcuff key inserted into the keyhole.
Figure 5N:
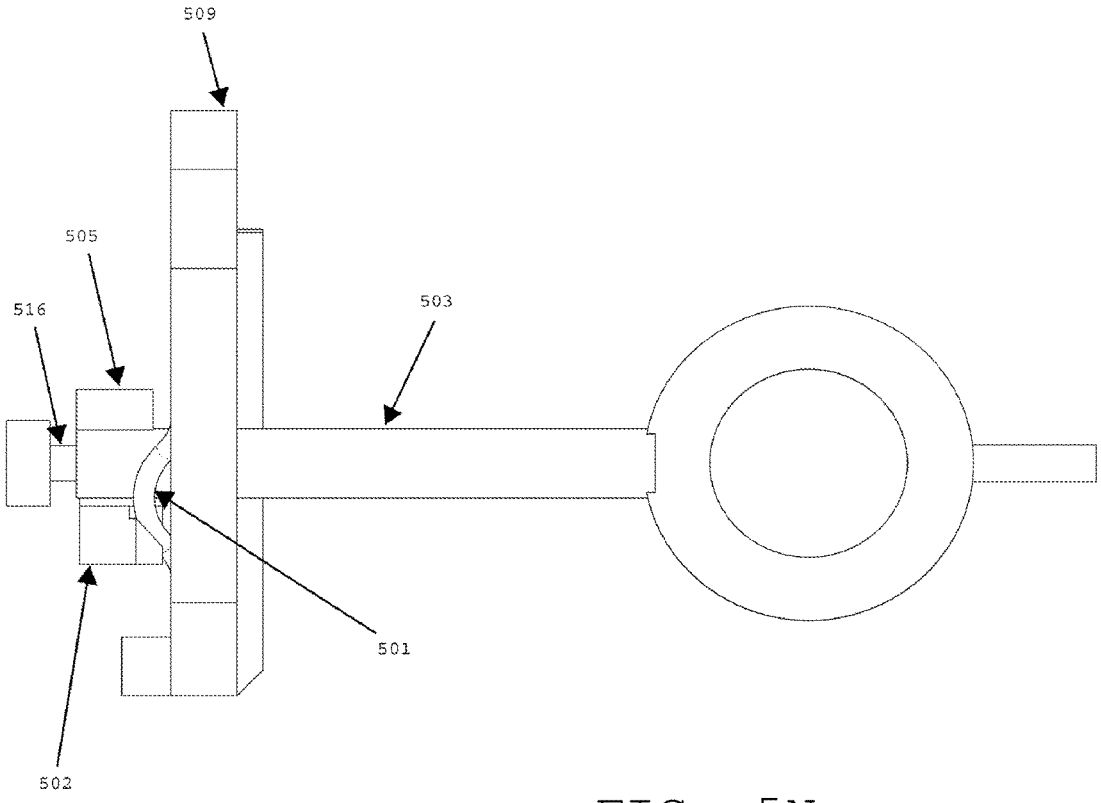
FIG. 5N shows a side of a handcuff inserted into the keyhole.
Figure 50:
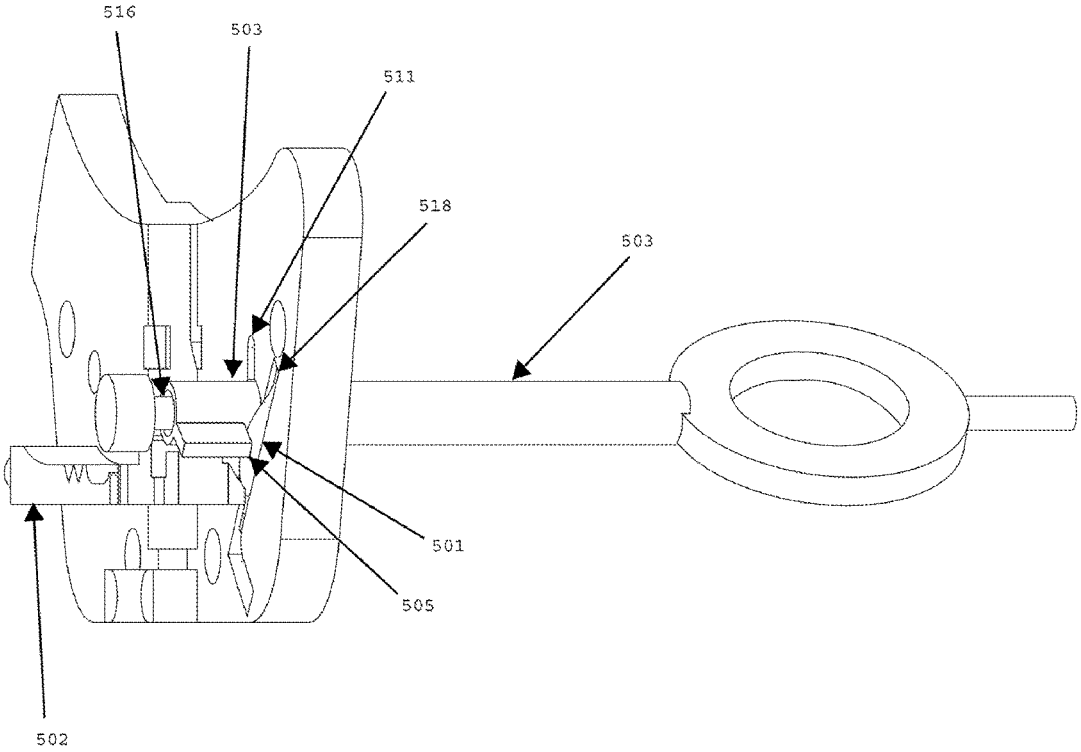
Figure 5P:
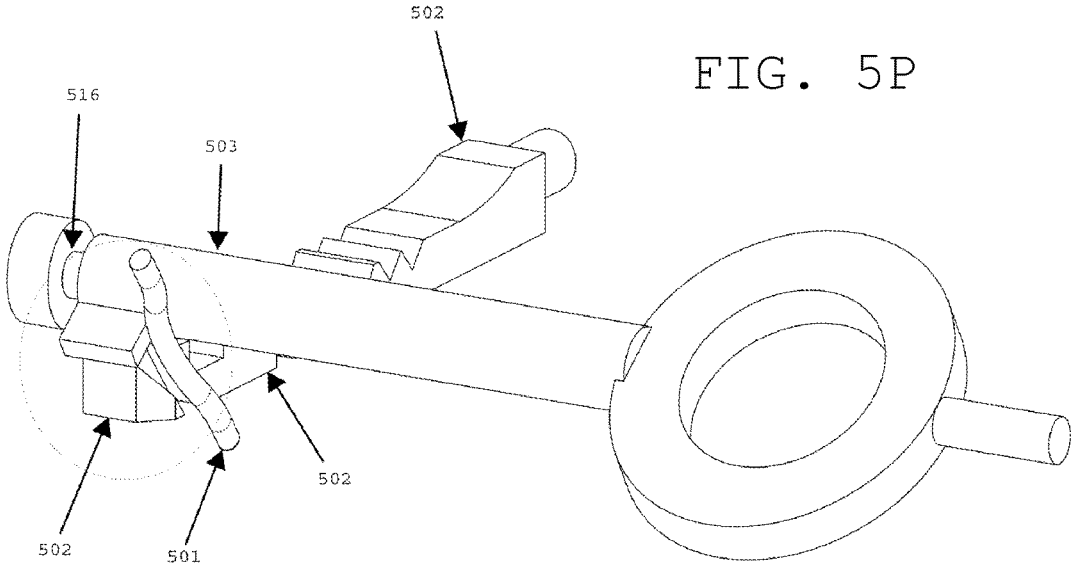
FIG. 5B shows the double lock bar security spring engaging the double lock bar.
FIG. 5C is an expanded view showing the double lock bar security spring engaging the double lock bar.
FIG. 5D shows the double lock bar security spring engaging the double lock bar.
FIG. 5E is an expanded view showing the double lock bar security spring engaging the double lock bar.
FIG. 5L further shows a handcuff key inserted into the keyhole.
FIG. 5M is an expanded view of FIG. 5L.
FIG. 5O shows a handcuff key depressing double lock bar security spring.
Figure 5Q:
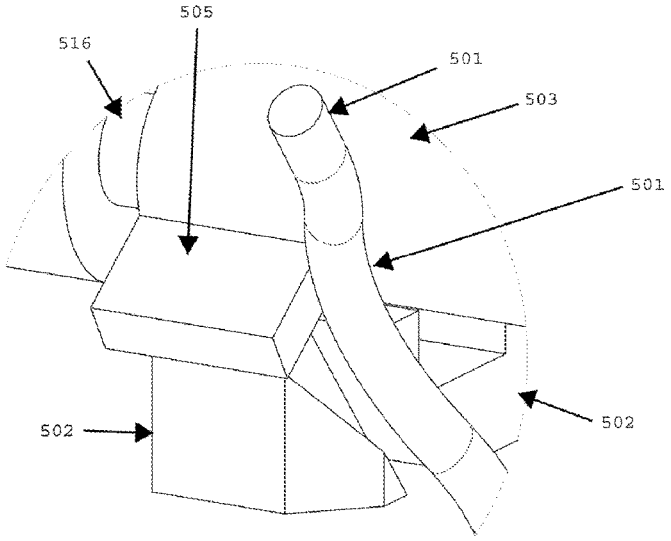
Figure 5R:
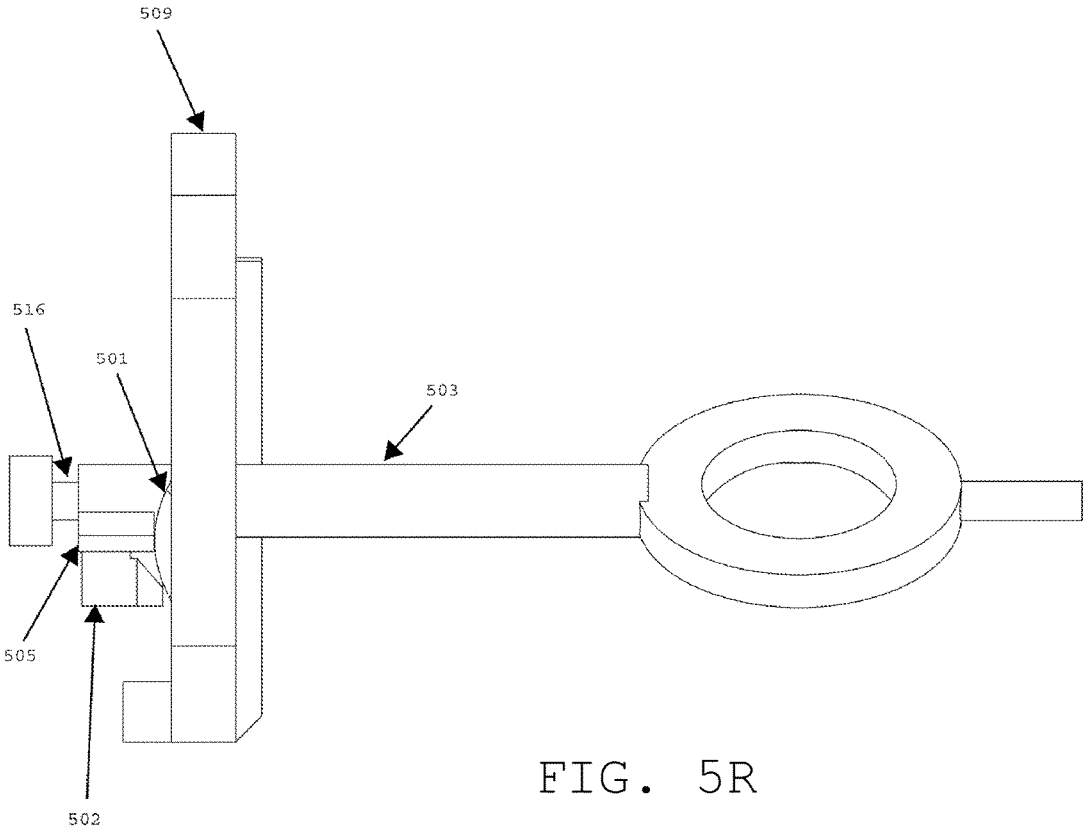
Figure 5U:
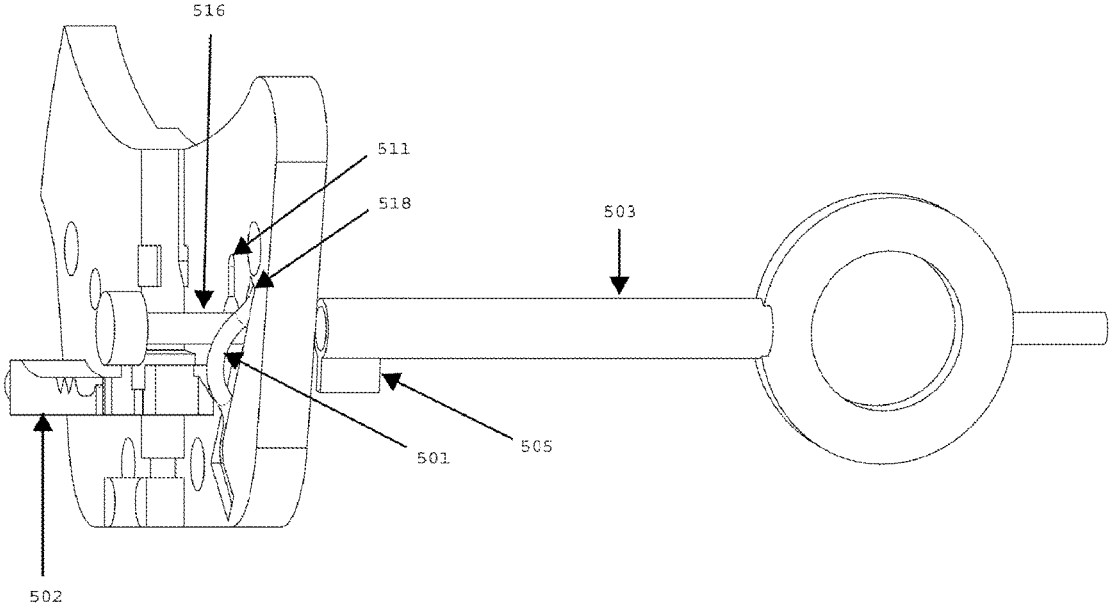
Figure 5X:
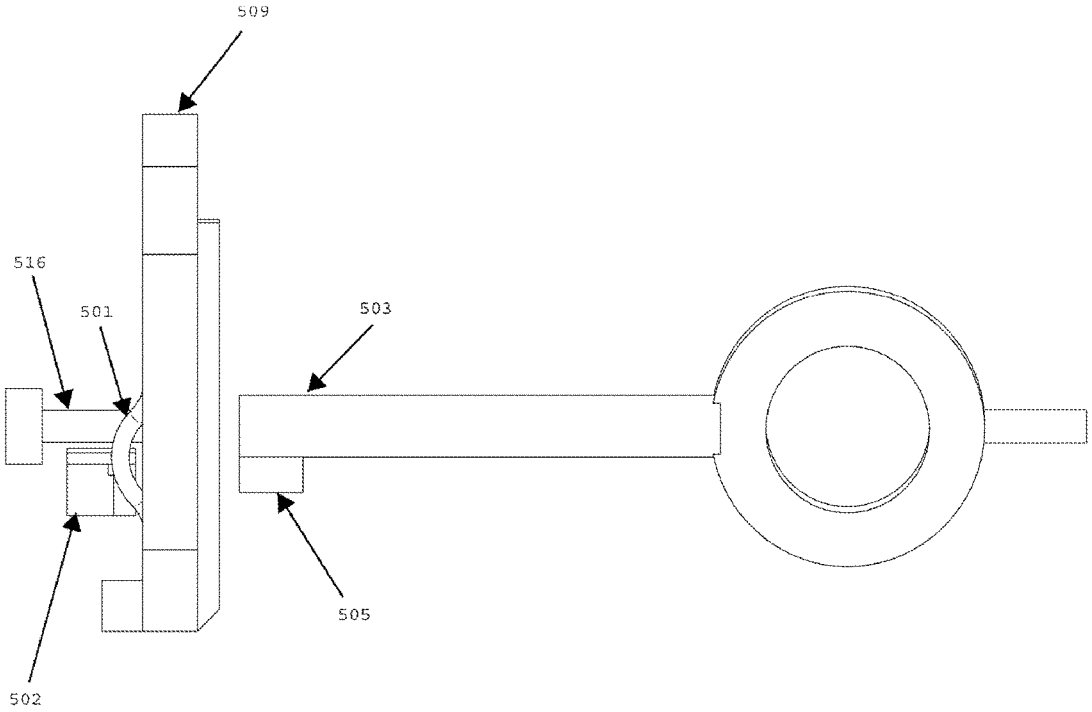
Figure 6A:
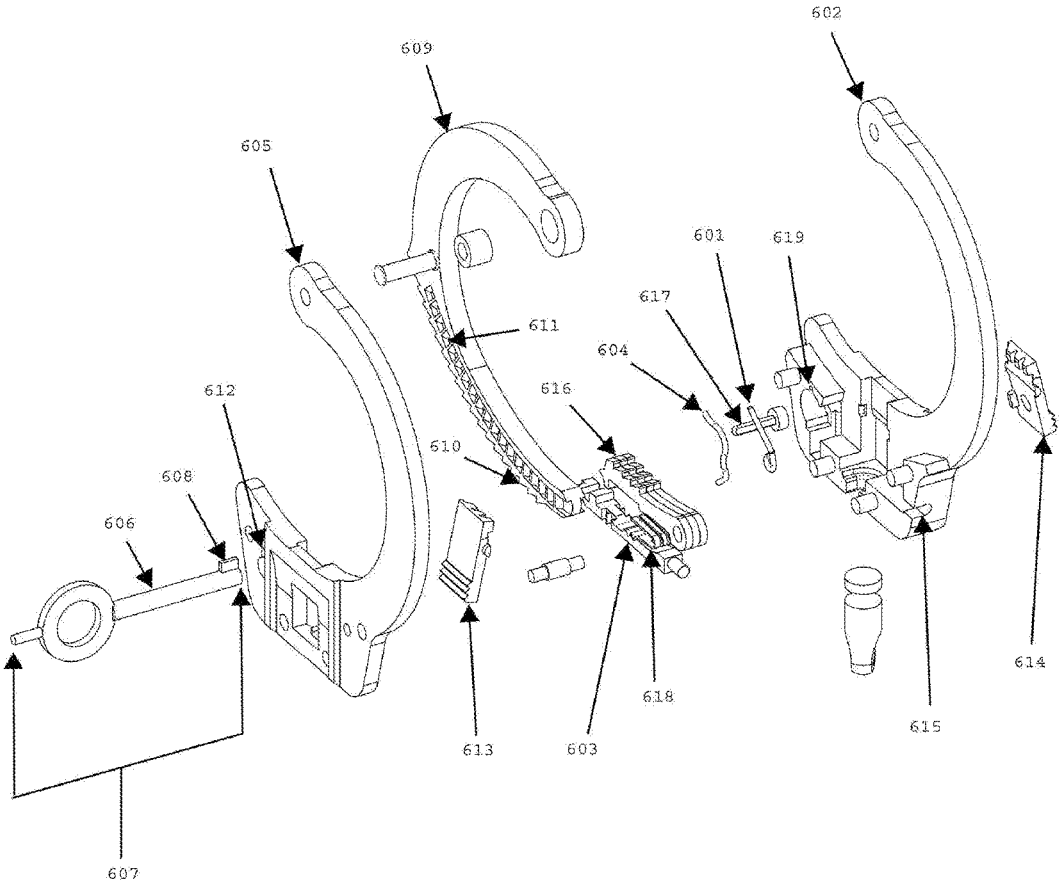
Figures 6B, 6C:
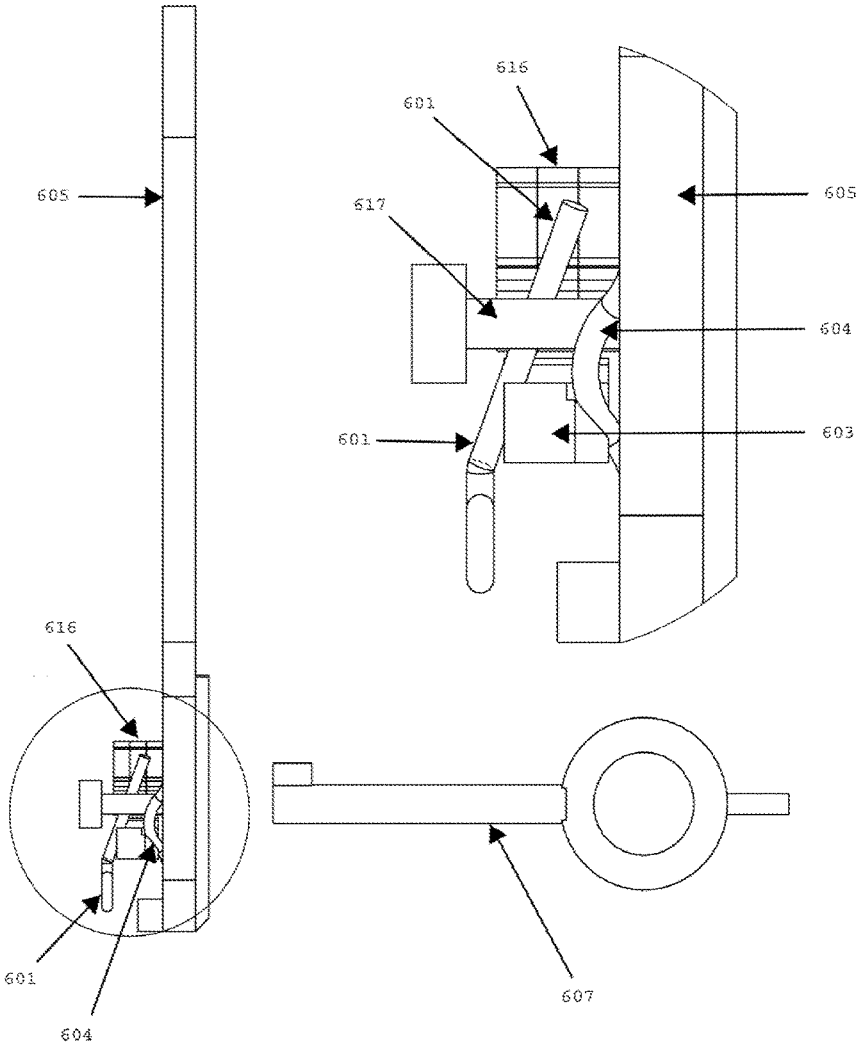
Figure 6D:
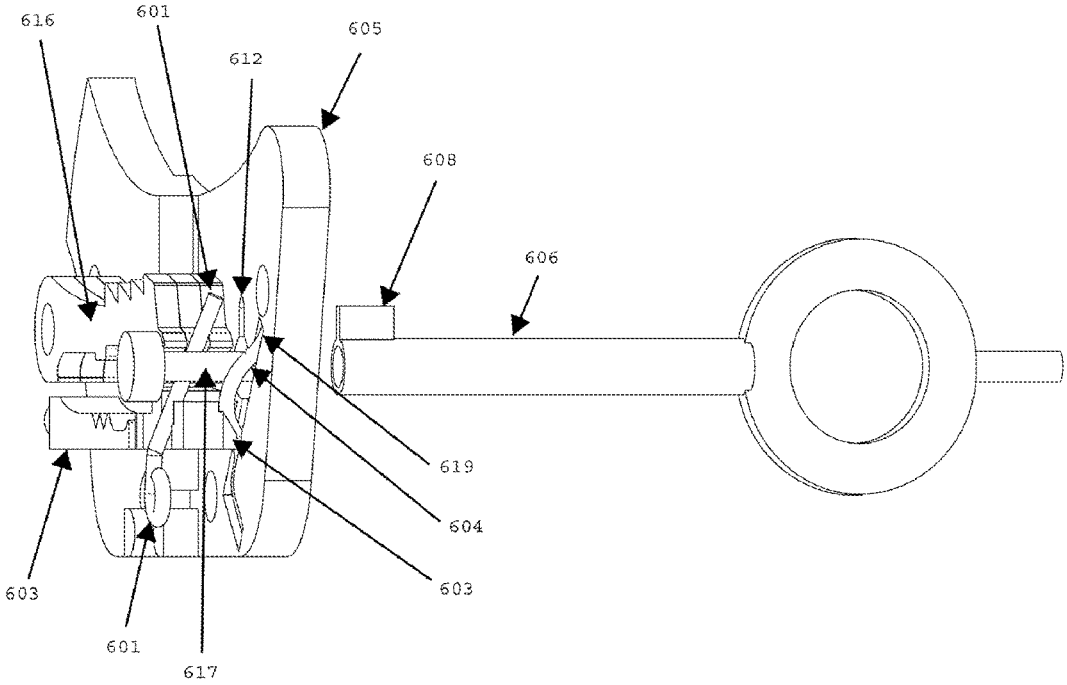
Figure 6I:
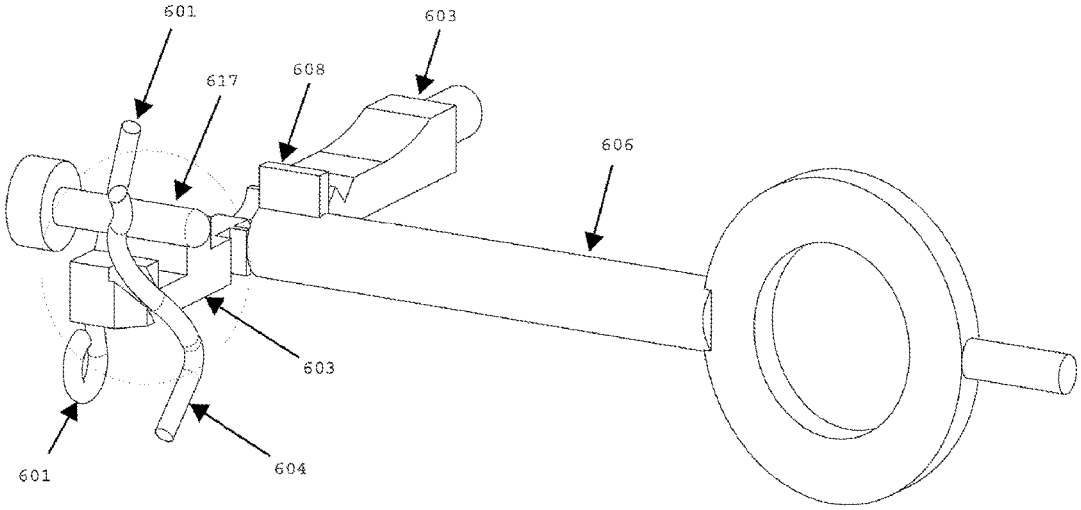
Figure 6J:
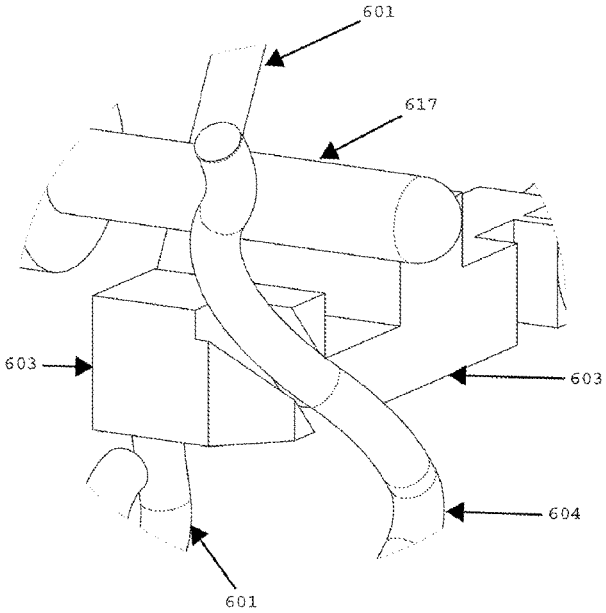
Figure 6K:
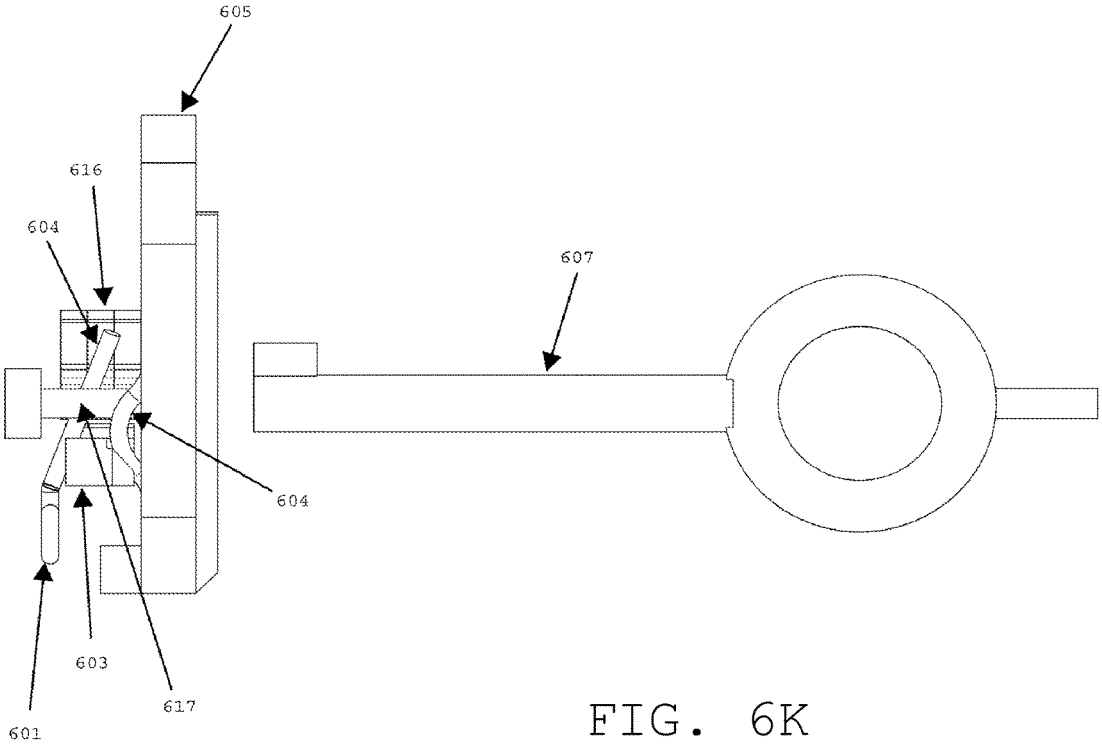
Figure 6L:
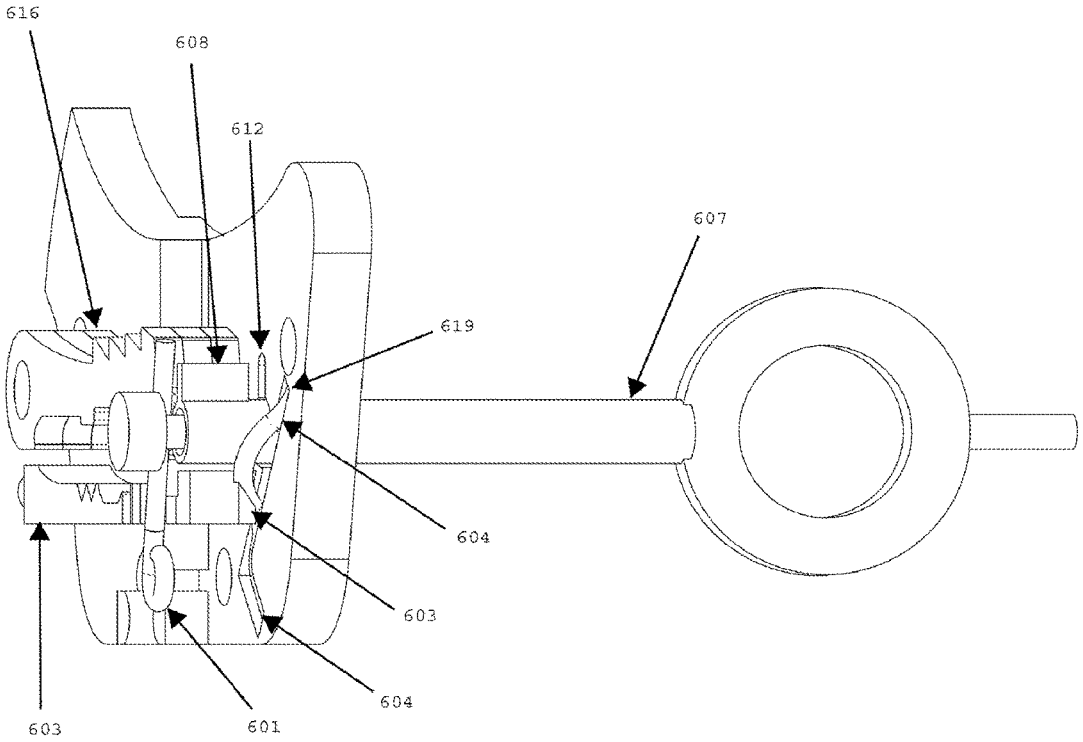
Figure 60:
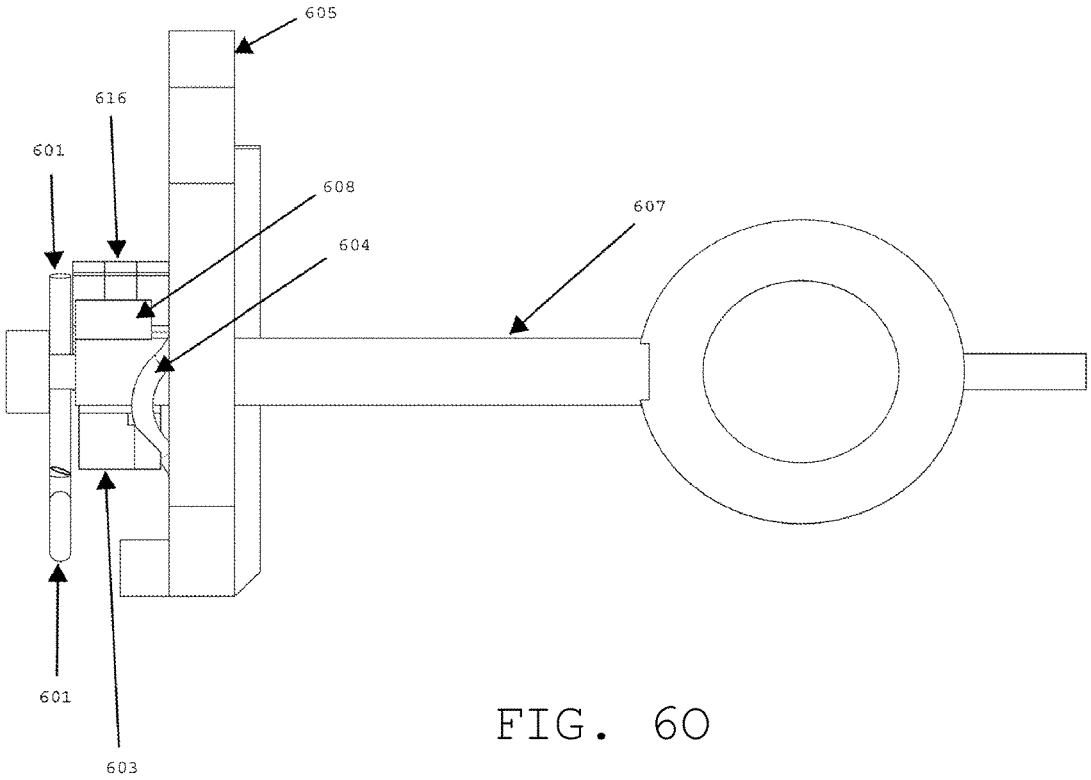
Figure 6P:
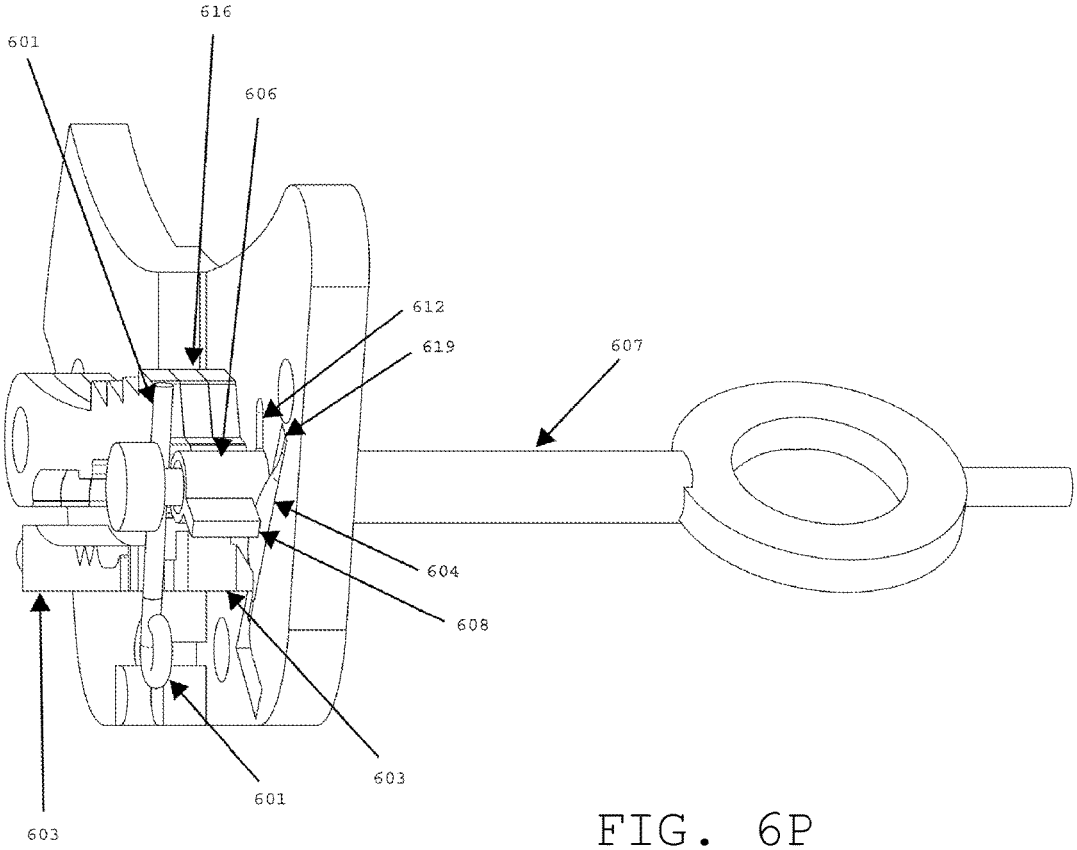
Figure 6Q:
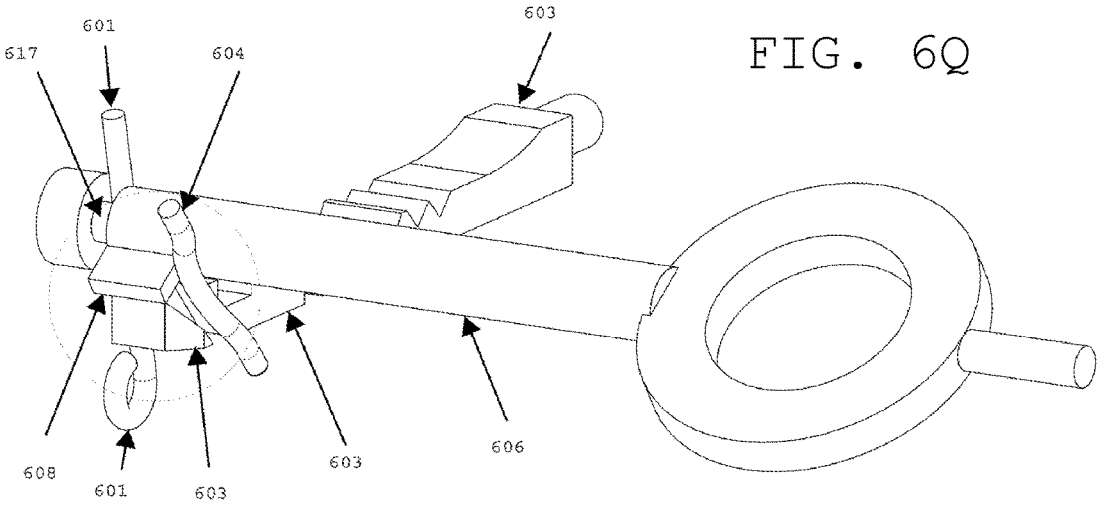
Figure 6R:
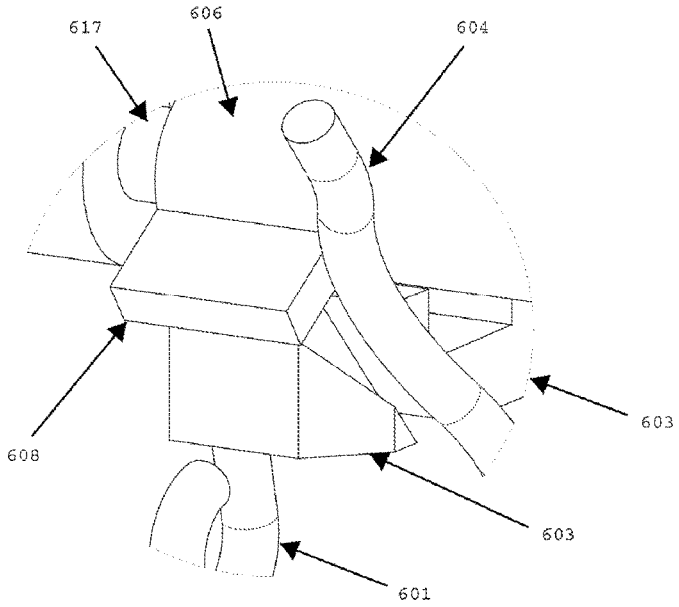
Figure 6S:
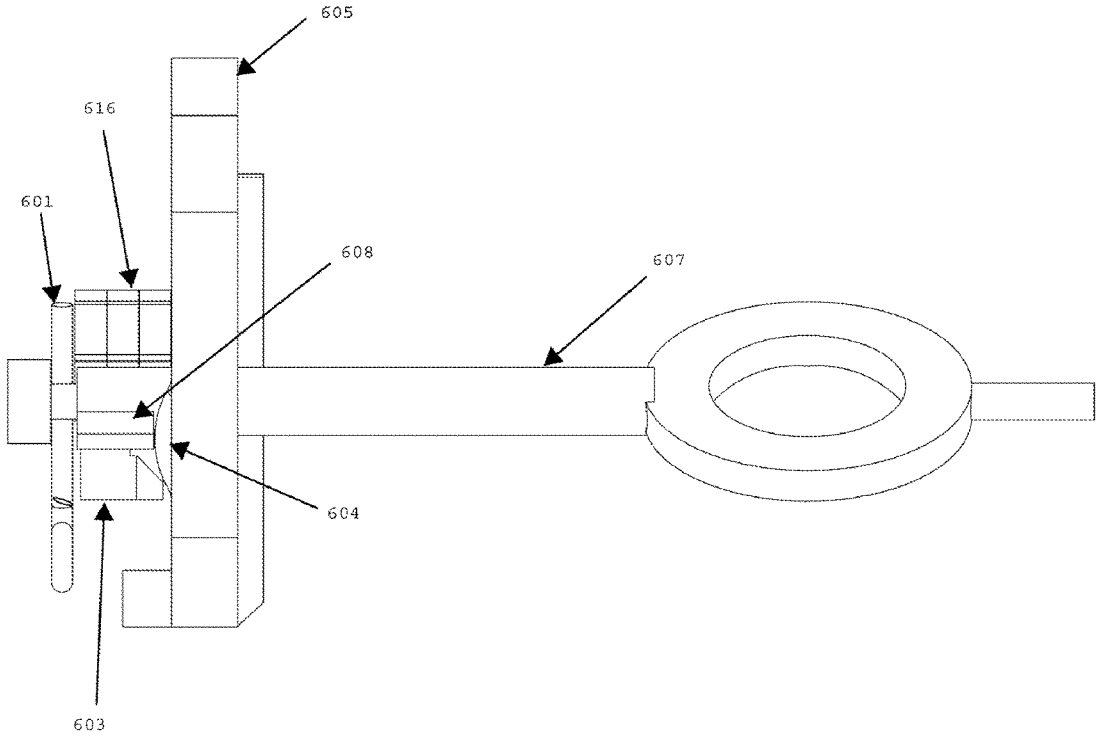
Figure 6V:
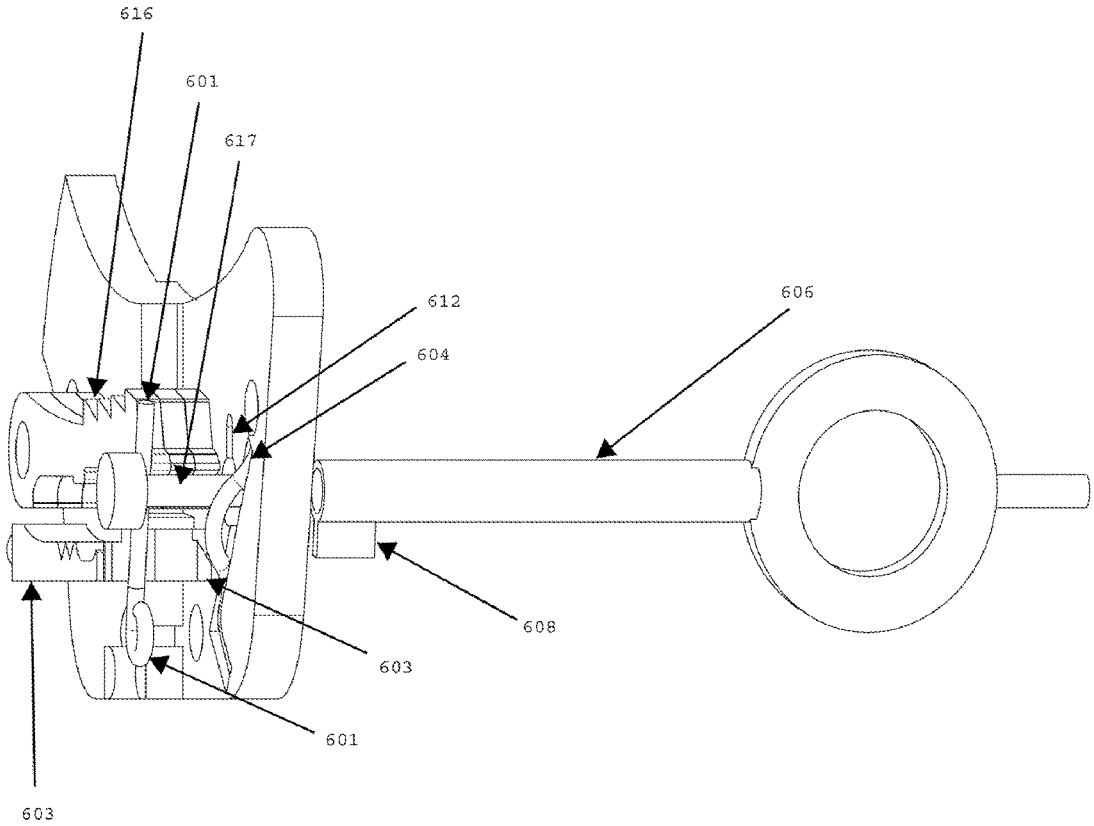
Figure 6Y:
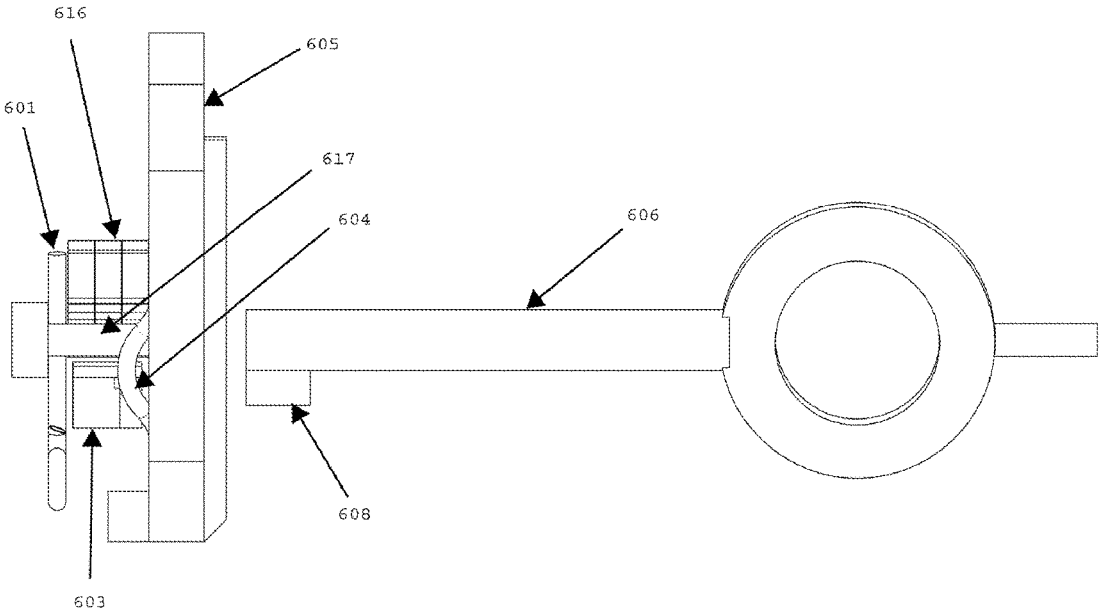
Figure 7A:
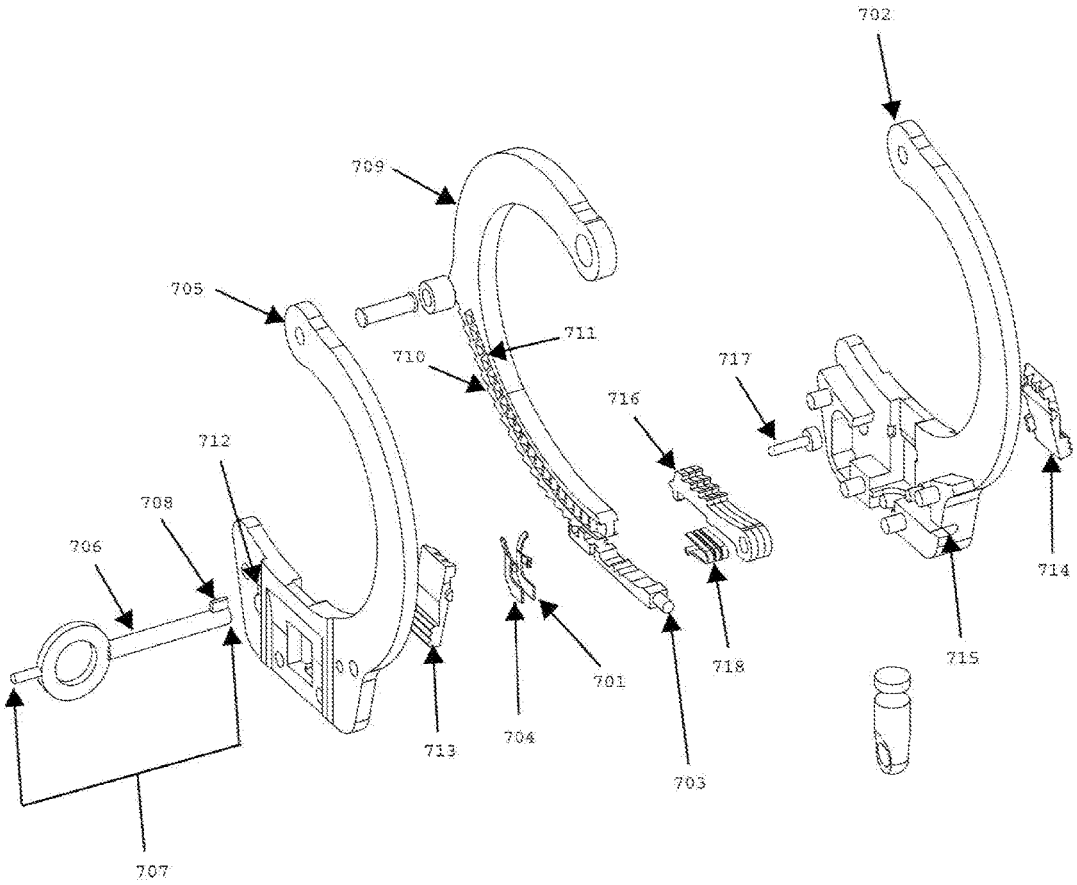
Figure 7B:
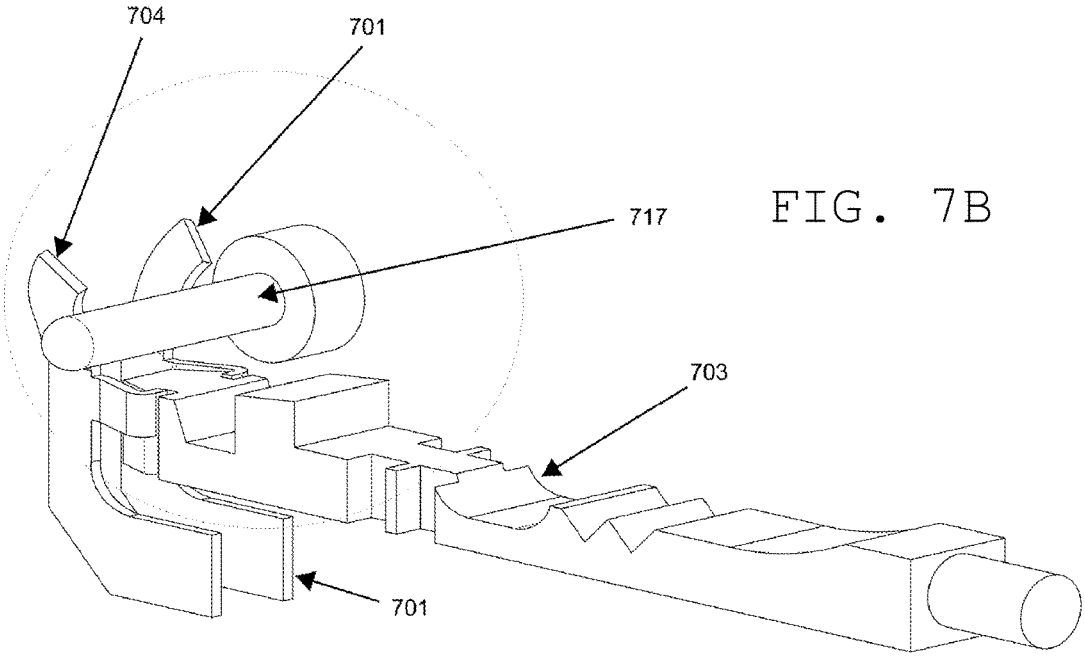
Figure 7C:
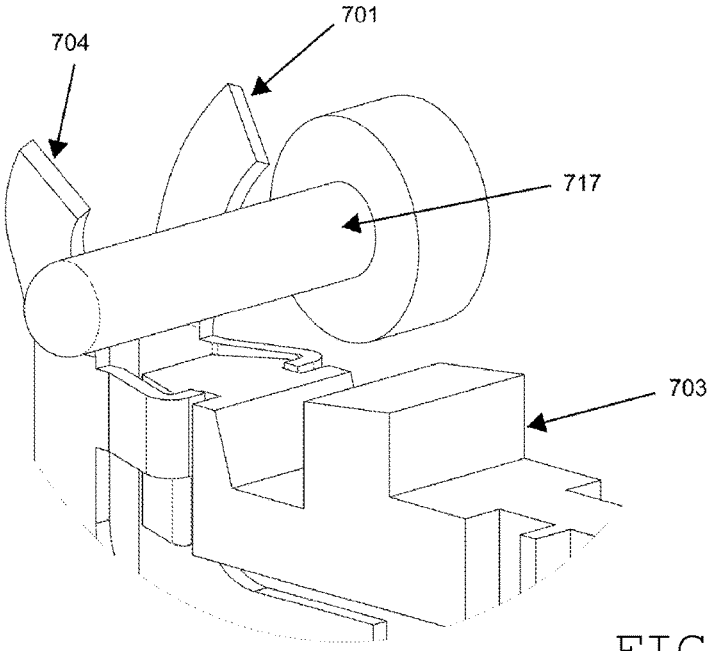
Figure 7D:
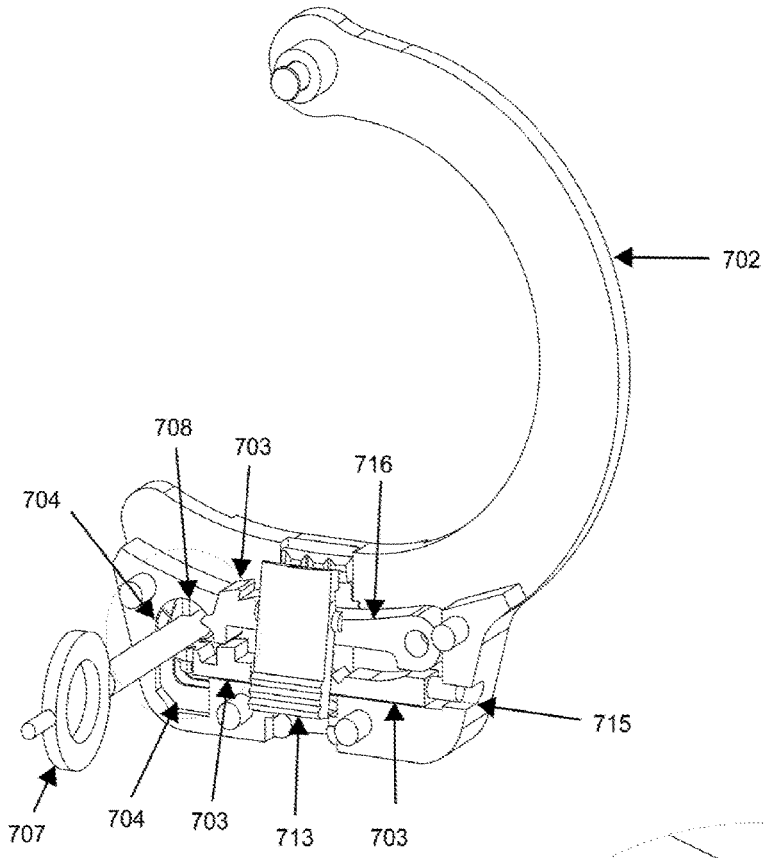
Figure 7E:
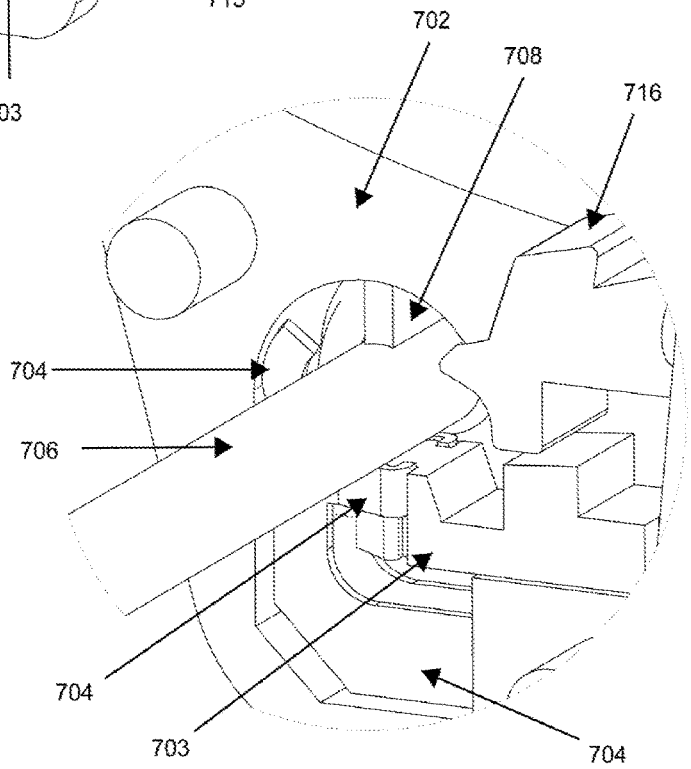
Figure 7H:
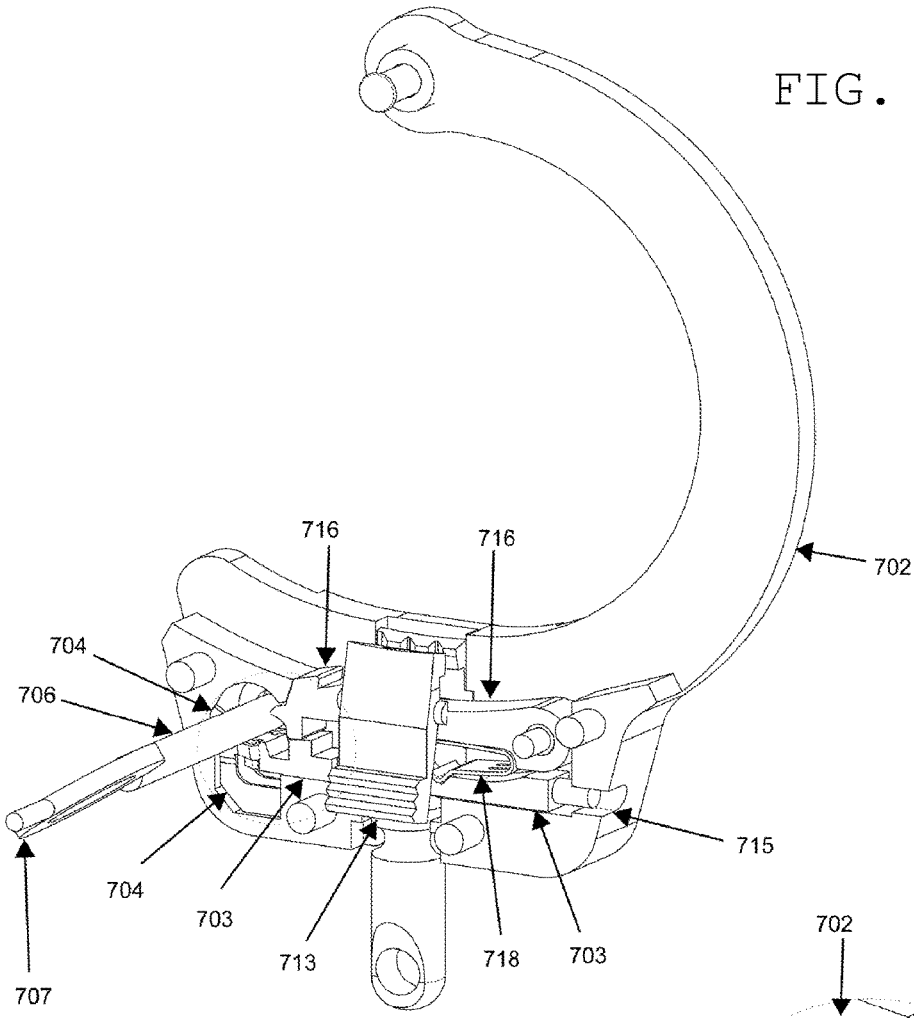
Figure 7I:
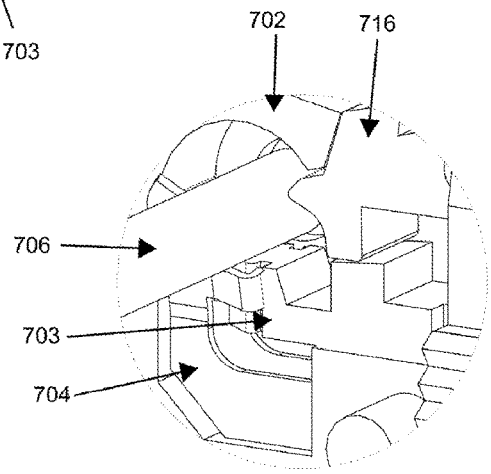
Figure 7L:
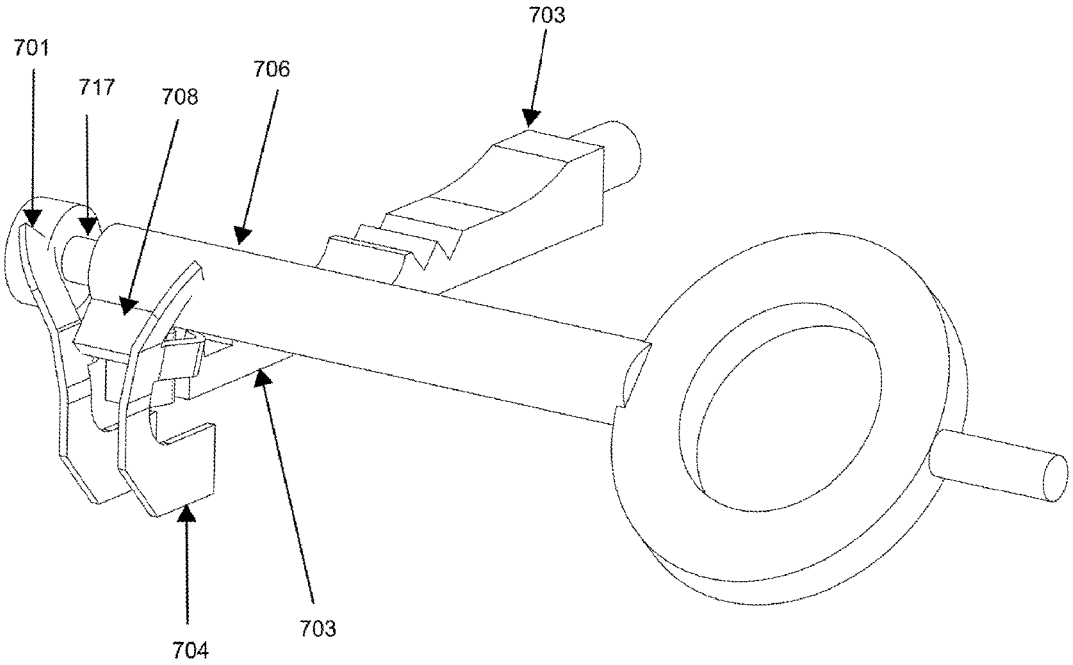
Figure 7O:
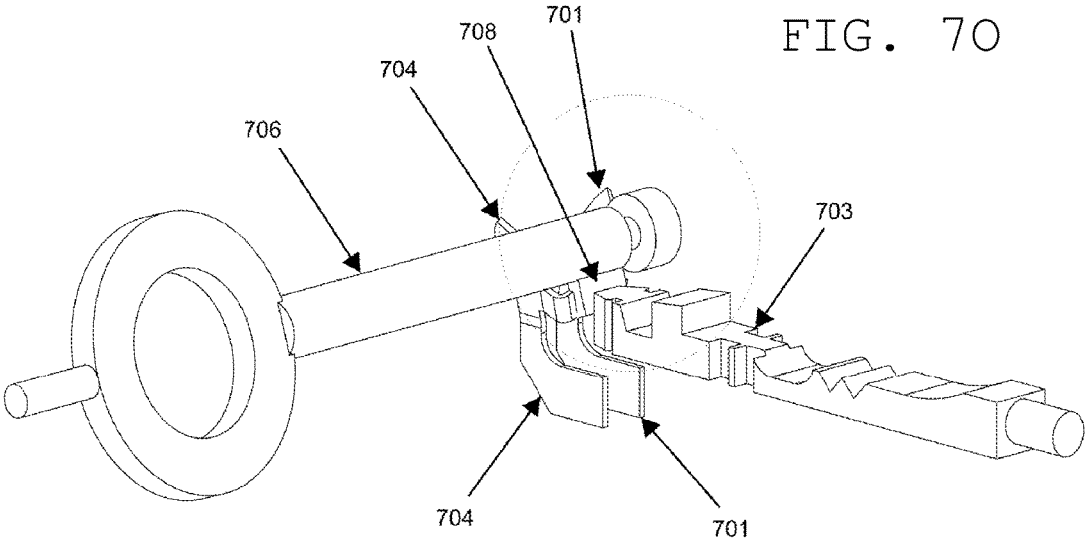
Figure 7P:
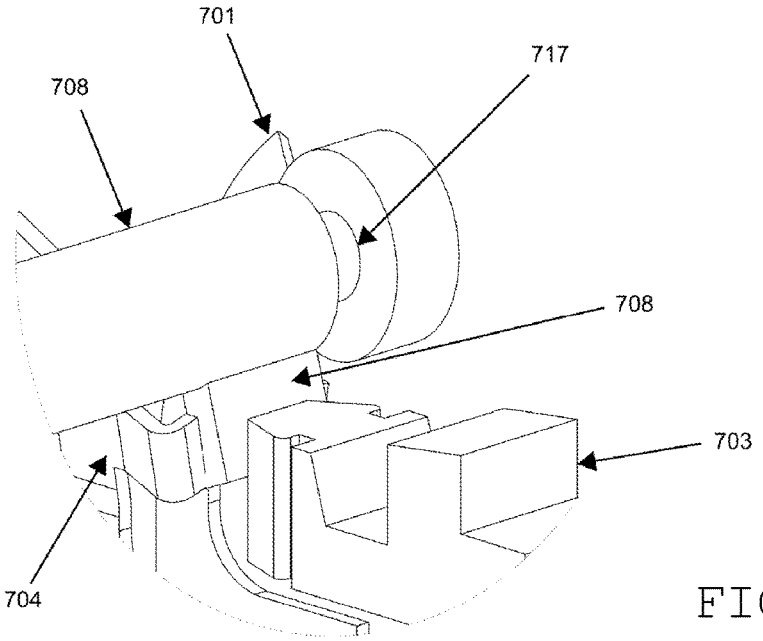

FIG. 5P further shows a handcuff key depressing double lock bar security spring;

FIG. 5Q is an expanded view further showing a handcuff key depressing double lock bar security spring;

FIG. 5R shows a side view of a handcuff key depressing double lock bar security spring;

FIG. 5S shows a handcuff key depressing double lock bar security spring and pushing the double lock bar into the unlocked position;

FIG. 5T illustrates an expanded view showing a handcuff key depressing double lock bar security spring and pushing the double lock bar into the unlocked position;

FIG. 5U shows the double lock bar in the unlocked position;

FIG. 5V shows the double lock bar in the unlocked position;

FIG. 5W is an expanded view of the double lock bar in the unlocked position;

FIG. 5X shows a side view of the double lock bar in the unlocked position;

FIG. 6A illustrates an exploded view of a sixth embodiment;

FIG. 6B shows the double lock bar security springs engaging the double lock bar;

FIG. 6C is an expanded view of the double lock bar security springs engaging the double lock bar;

FIG. 6D shows the double lock bar security springs engaging the double lock bar;

FIG. 6E further shows the double lock bar security springs engaging the double lock bar;

FIG. 6F is an expanded view further showing the double lock bar security springs engaging the double lock bar;

FIG. 6G shows the double lock bar security springs engaging the double lock bar;

FIG. 6H is an expanded view further showing the double lock bar security springs engaging the double lock bar;

FIG. 6I shows the double lock bar security springs engaging the double lock bar;

FIG. 6J is an expanded view of the double lock bar security springs engaging the double lock bar;

FIG. 6K shows the double lock bar security springs engaging the double lock bar;

FIG. 6L shows the double lock bar security springs engaging the double lock bar and a handcuff key inserted in the keyhole;

FIG. 6M shows the double lock bar security springs engaging the double lock bar and a handcuff key inserted in the keyhole;

FIG. 6N is an expanded view of the double lock bar security springs engaging the double lock bar and a handcuff key inserted in the keyhole;

FIG. 6O shows a side view of a handcuff key inserted in the keyhole and engaging the rear double lock bar security spring;

FIG. 6P shows a side view of a handcuff key engaging both double lock bar security springs;

FIG. 6Q shows a side view of a handcuff key engaging both double lock bar security springs;

FIG. 6R is an expanded view of the side view of a handcuff key engaging both double lock bar security springs;

FIG. 6S shows a side view of a handcuff key engaging both double lock bar security springs and pushing the double lock bar into the unlocked position;

FIG. 6T illustrates a side view of a handcuff key engaging both double lock bar security springs and pushing the double lock bar into the unlocked position;

FIG. 6U is an expanded view of a handcuff key engaging both double lock bar security springs and pushing the double lock bar into the unlocked position;

FIG. 6V shows the double lock bar in the unlocked position;

FIG. 6W shows the double lock bar in the unlocked position;

FIG. 6X is an expanded view of the double lock bar in the unlocked position;

FIG. 6Y shows the double lock bar in the unlocked position;

FIG. 7A illustrates an exploded view of a seventh embodiment;

FIG. 7B shows the double lock bar in the locked position and the double lock bar security spring engaged;

FIG. 7C is an expanded view of the double lock bar in the locked position and the double lock bar security spring engaged;

FIG. 7D shows a handcuff key inserted in the keyhole and engaging the rear double lock bar security spring;

FIG. 7E is an expanded view of a handcuff key inserted in the keyhole and engaging the rear double lock bar security spring;

FIG. 7F illustrates a handcuff key inserted in the keyhole and engaging the rear double lock bar security spring;

FIG. 7G is an expanded view of a handcuff key inserted in the keyhole and engaging the rear double lock bar security spring;

FIG. 7H is a handcuff key engaging both double lock bar security springs;

FIG. 7I is an expanded view of FIG. 7H;

FIG. 7J illustrates a handcuff key engaging both double lock bar security springs;

FIG. 7K is an expanded view showing a handcuff key engaging both double lock bar security springs;

FIG. 7L shows a handcuff key engaging both double lock bar security springs;

FIG. 7M is a handcuff key engaging both double lock bar security springs and pushing the double lock bar into the unlocked position;

FIG. 7N is an expanded view of a handcuff key engaging both double lock bar security springs and pushing the double lock bar into the unlocked position;

FIG. 7O shows a handcuff key engaging both double lock bar security springs and pushing the double lock bar into the unlocked position; and FIG. 7P is an expanded view showing a handcuff key engaging both double lock bar security springs and pushing the double lock bar into the unlocked position.

DETAILED DESCRIPTION

The present series of designs is directed to enhanced security handcuffs that substantially increase the security related to handcuff internal and external locking mechanisms. Various embodiments are described herein, all of which are centered on improving the security of the double lock or similar systems utilized in handcuffs and other restraints. The designs allow the use of a universal handcuff key while increasing the complexity and difficulty of the removal of the restraints by suspects or others who are wearing them while at the same time combatting common lock picking techniques. The design may require use of a universal handcuff key with one hand while simultaneously manipulating other controls or mechanisms on the handcuffs in order to unlock or open them.

Law enforcement officers are typically trained in one-handed techniques to place handcuffs on a suspect's wrists and a two-handed operation to uncuff a suspect. A standard key is used for almost all handcuffs and is universal in that the same key can be used to open almost all sets of handcuffs regardless of manufacturer. Because handcuff keys are universal and millions exist, they are readily accessible to suspects and inmates restrained by handcuffs, creating a tremendous liability to law enforcement officers. This condition is exemplified in the event those under arrest or being detained are able to obtain or conceal a handcuff key and uncuff themselves. This danger extends to members of the public, and in some cases, prison inmates. A simple design enhancement can make standard handcuffs substantially more effective in their capability to restrain a wearer even if the wearer is in possession of a handcuff key, and such an improvement is the subject of the present design.

The enhanced security handcuffs according to the present design address a need for a more secure, "unpickable" handcuff. Over the years, manufacturers have attempted to improve upon the traditional handcuff design, typically seeking to create a more advanced key and corresponding locking mechanism. This route, however, has been largely unsuccessful. Rather than creating an improved key design, this design centers around increasing the security mechanism and manipulation processes related to the double locking system of handcuffs and restraints.

Locking means of the designs may comprise a variety of arrangements, including but not limited to a multiple tab spring, a sliding mechanism, a design wherein the handcuff strand comprises a plurality of openings configured to receive teeth engageable by depressing a plurality of buttons, a chain tension lock bar, a multiple element spring and a multiple element key pawl, a double lock chain hinge, a two button arrangement comprising a spring positioned between or interfacing with one, two or more buttons, a double lock and spring-plunger arrangement, a hook component configured to engage a key pawl to keep the key pawl from moving, an opposing two button arrangement configured to lock and release a key pawl, a double lock with sliders on both sides of one handcuff. Various other designs are available.

Although many of the variations herein discuss the use of a standard universal handcuff key, it should be noted the designs incorporated herein also apply to handcuffs and restraints employing specialized, propriety and high security keys and locking mechanisms. Such specialized locking mechanisms may also be utilized to employ the designs described herein.

This disclosure provides numerous designs intended to increase the security level of the handcuffs and make it extremely difficult for a wearer or a secondary party to remove the restraints by locking picking, shimming, inertia strikes or any other methods of attempting to unlock a pair of handcuffs without the use of a universal handcuff key. Additionally, the designs make it extremely difficult for a wearer to unlock and open the handcuffs even if he/she is in possession of a handcuff key. These different designs can be incorporated into handcuffs as a single enhancement or, in certain instances, multiple design concepts can be combined to increase security of the handcuffs even further. A handcuff design according to the present teachings can incorporate any combination of features and capabilities discussed herein in a set of handcuffs or in any other similar restraint systems.

As used herein, various terms are employed and are intended to be used in the broadest sense possible. For example, the present application uses the term "officer" or "law enforcement officer" or otherwise to indicate the individual applying the handcuffs or similar restraints on a person (called, for example, a "suspect" or a "prisoner"), and as such these terms are meant to broadly encompass any individual who may have use for such a device or system, including but not limited to police officers, military personnel, corrections officers, security personnel, or other interested individuals.

Additionally, the design of the handcuffs may differ from the exact configuration(s) described herein. With respect to restraints, the term "handcuffs" is intended broadly to mean any type of handcuffs, thumb cuffs, waist chains, ankle cuffs, leg irons and/or any other type of restraint designed to restrain a person's body part(s) to include but not limited to his or her hands, wrists, fingers, arms, legs, ankles, feet, waist, shoulders, neck or any other body part. A single unit is generally referred to as a "handcuff" while a connected pair is generally referred to as "handcuffs," but use may depend on context. The single and connected pairs are collectively referred to henceforth as "handcuffs" or "cuffs".

Further, certain designs and capabilities are described herein as being a single variation or capability while others are described as having multiple capabilities. It is understood that the invention is not limited solely to the configurations described but single or multiple configurations may be employed in a single restraint or handcuff respectively, as long as the functionality described is fully or in part incorporated. The foregoing and other concepts disclosed herein are intended to be interpreted broadly and not limit the scope of the present invention. Additional designs or capabilities may be incorporated such as those shown in U.S. patent application Ser. No. 14/919,200, entitled "Handcuff Apparatus," inventor Kresimir Kovac, filed Oct. 21, 2015.

As used herein, the term "wearer" is synonymous with the term "suspect," "prisoner," "individual," or any other similar term to convey someone to whom the handcuffs have been applied or a person whom the device is intended to restrain.

Each of the variations described herein utilize a traditional handcuff key, which is universally available and standardized. In certain instances, if desired, the handcuffs of the present design may employ specialized and proprietary key and locking systems to increase their effectiveness or introduce a higher level of security. As noted, such handcuffs may also incorporate multiple design features discussed herein.

Each variation of the handcuff design herein incorporates the ability of the handcuffs to be "double locked," as an option to the officer or other law enforcement professional. The "double lock" feature enables the law enforcement officer to set a detent in the double lock bar of the handcuff preventing the single strand from ratcheting further between the double strands and tightening the handcuffs. A suspect wearing handcuffs that have not been double locked may as a result inadvertently tighten the handcuffs leading to pain and discomfort. Worse, a suspect may intentionally attempt to tighten the handcuffs in order to facilitate some means of escape, or to persuade the law enforcement professional to loosen the cuffs or uncuff the suspect, thereby presenting a potential situation posing high risk and/or high liability.

All drawings, schematics or other visual depictions provided herein encompass a set of handcuffs working in unison to secure one or more appendages of a wearer. In some drawings, only a single unconnected handcuff is depicted. A second handcuff is not depicted in some drawings for clarity and simplicity reasons. Actual designs will normally encompass at least two separate handcuffs connected via one or more of several available methods such as a metal chain, links, roller chain, clasps, hinges, solid bar or any other method. At least one, or in many cases, both of the individual cuffs employ the designs depicted herein.

In general, the present design includes a number of similar components in each embodiment. Each embodiment, subject to the discussion below, includes a handcuff strand, opposing ratchet buttons that require a user to squeeze the ratchet buttons together in order to interface ratchet teeth with openings provided in the handcuff strand, a pawl arrangement which may typically comprise multiple pawls (such as three pawls), a corresponding spring to cause the pawls to contact teeth on the bottom of the strand, and a lock bar, also called a secondary lock bar that provides further security for a handcuff. Also provided is a keyhole and an arrangement that accommodates a standard handcuff key, wherein turning the key while squeezing or engaging the ratchet buttons can release the strand when the lock bar is in the unlocked position. As provided herein, various means for locking and unlocking the secondary lock bar are provided and are described in detail below. Such a construction provided for greater security than previous designs while still enabling an officer to release the cuffs from a suspect quickly and effectively when desired.

Figure 1A:
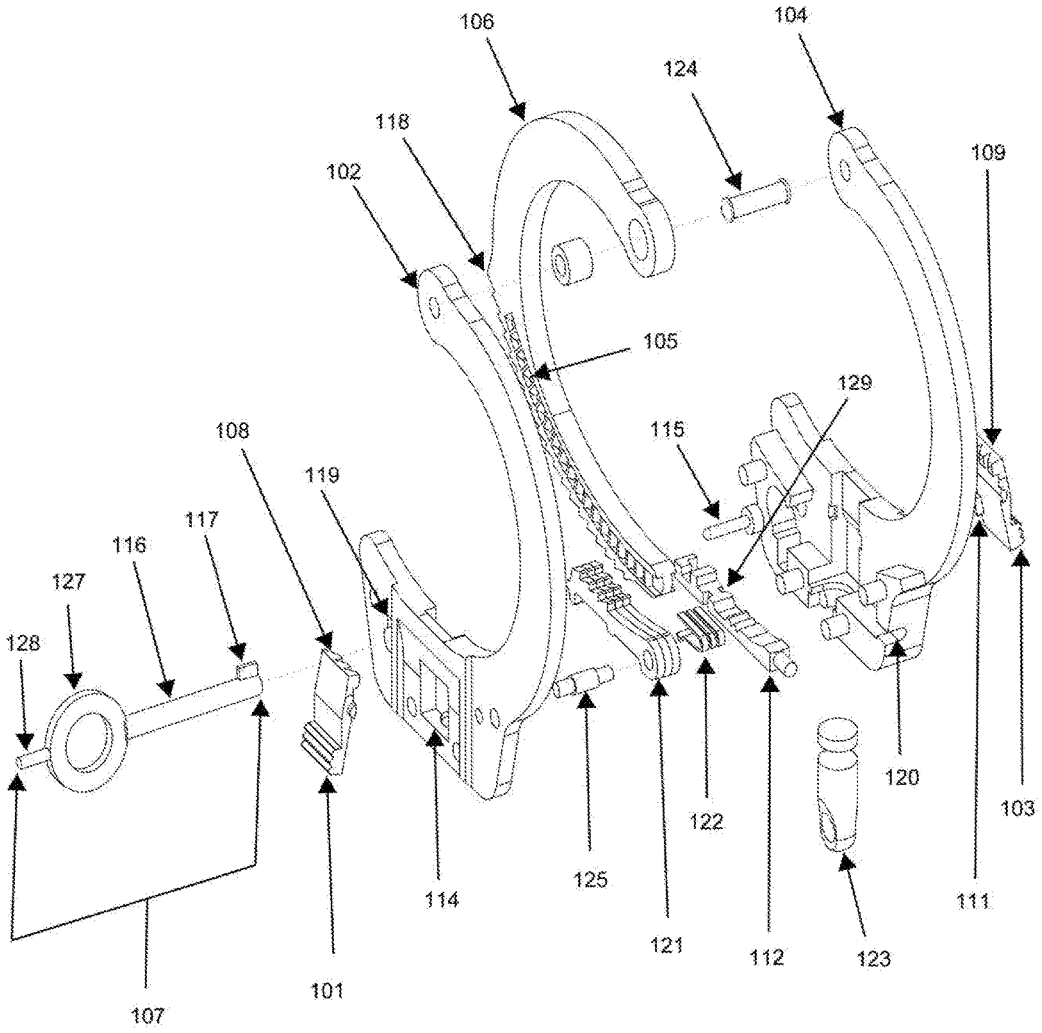
FIG. 1A shows an exploded view of the handcuffs of the first embodiment.

FIG. 1A illustrates an exploded view of the first variation of the present design. The design utilizes a front ratchet button 101 attached to the front double strand 102. The design also incorporates a rear ratchet button 103 attached to the rear double strand 104. These ratchet buttons 101 and 103 have protrusions 108 and 109 on the top inside. These protrusions 108 and 109 engage with indentations 105 which are located on each side of the single strand ratchet 106. This engagement allows the single strand 106 to tighten freely without the use of a universal handcuff key 107. This aspect of the design has similarities to certain designs described in co-pending U.S. patent application Ser. No. 14/919,200, entitled "Handcuff Apparatus," inventor Kresimir Kovac, filed Oct. 21, 2015.

Figure 1B:
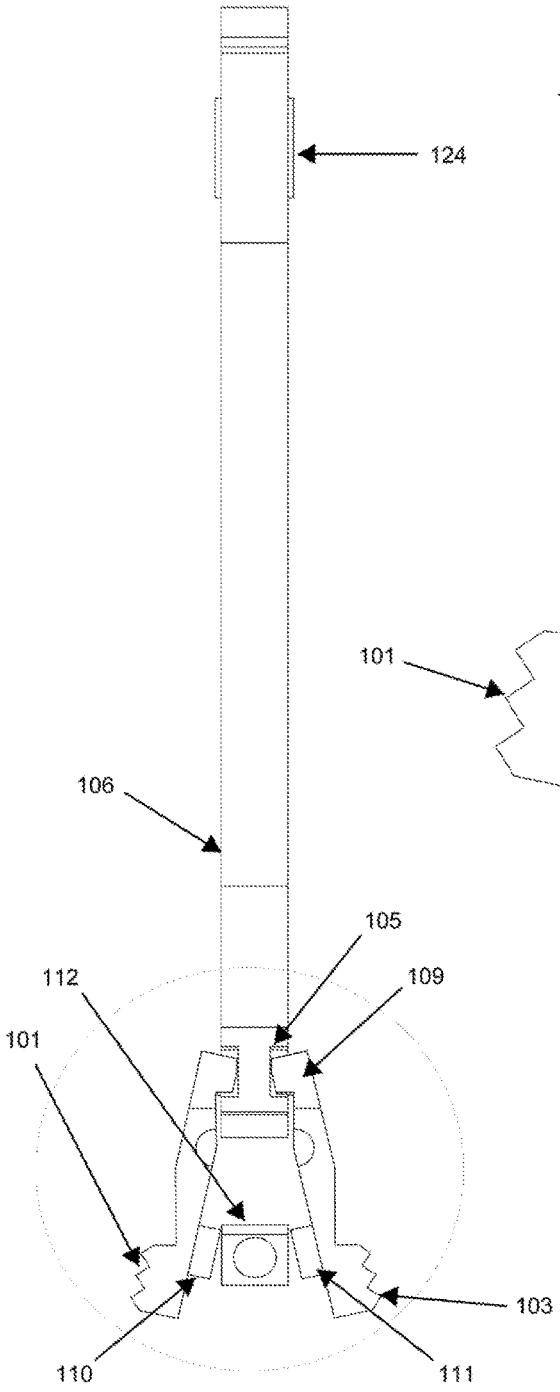
FIG. 1B illustrates the engagement of the ratchet buttons with the ratchet side indentations.
Figure 1C:
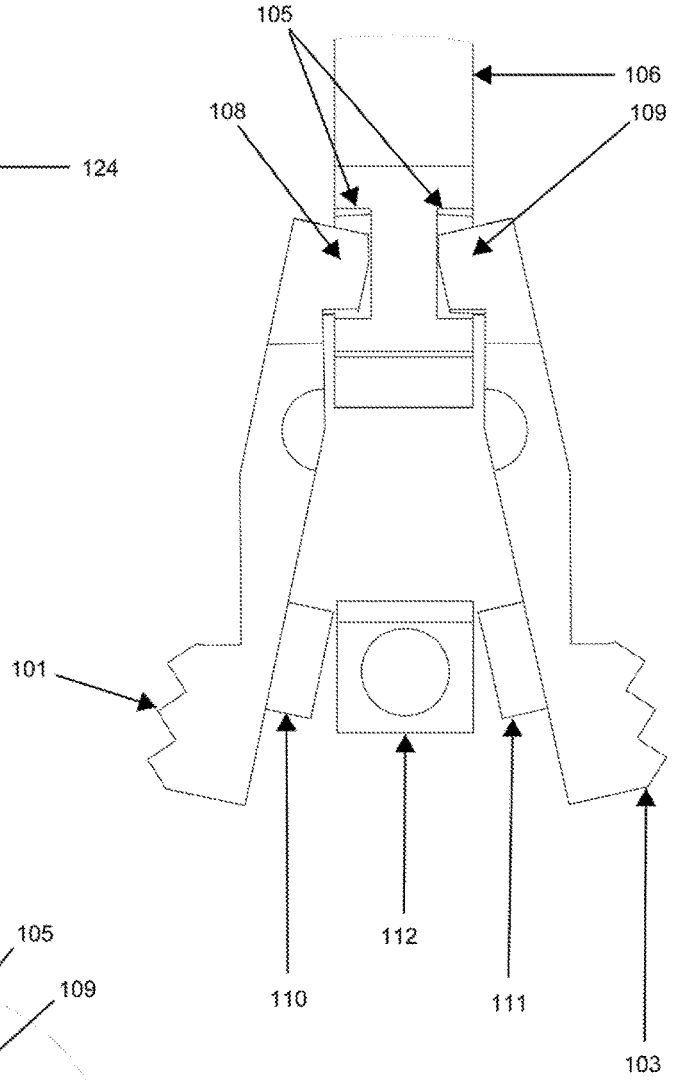
FIG. 1C further illustrates the engagement of the ratchet buttons with the ratchet side indentations

As depicted in the combination of FIGS. 1A, 1B, and 1C, the front ratchet button 101 and rear ratchet button 103 have protrusions 110 and 111 on the bottom inside of the buttons 101 and 103. These protrusions 110 and 111 engage with the double lock bar notches 129 in the double lock bar 112, which allow the buttons 101 and 103 to move up and down freely when the double lock bar 112 is in the unlocked position. The front ratchet button 101 and rear ratchet button 103 utilize ratchet button springs 113 which push the bottom of the buttons 101 and 103 away from the double strands 102 and 104. The spring 113 forces the top inside protrusions 108 and 109 to push into the ratchet side indentations 105.

Figure 1D:
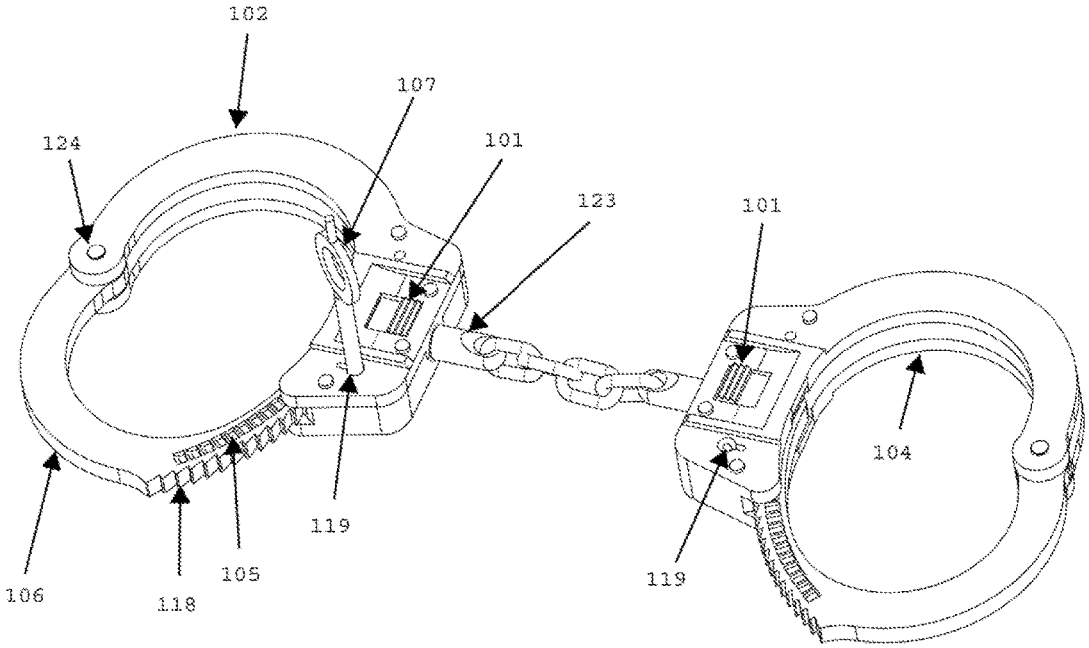
FIG. 1D shows the exterior of a set of handcuffs of the first embodiment.
Figure 1E:
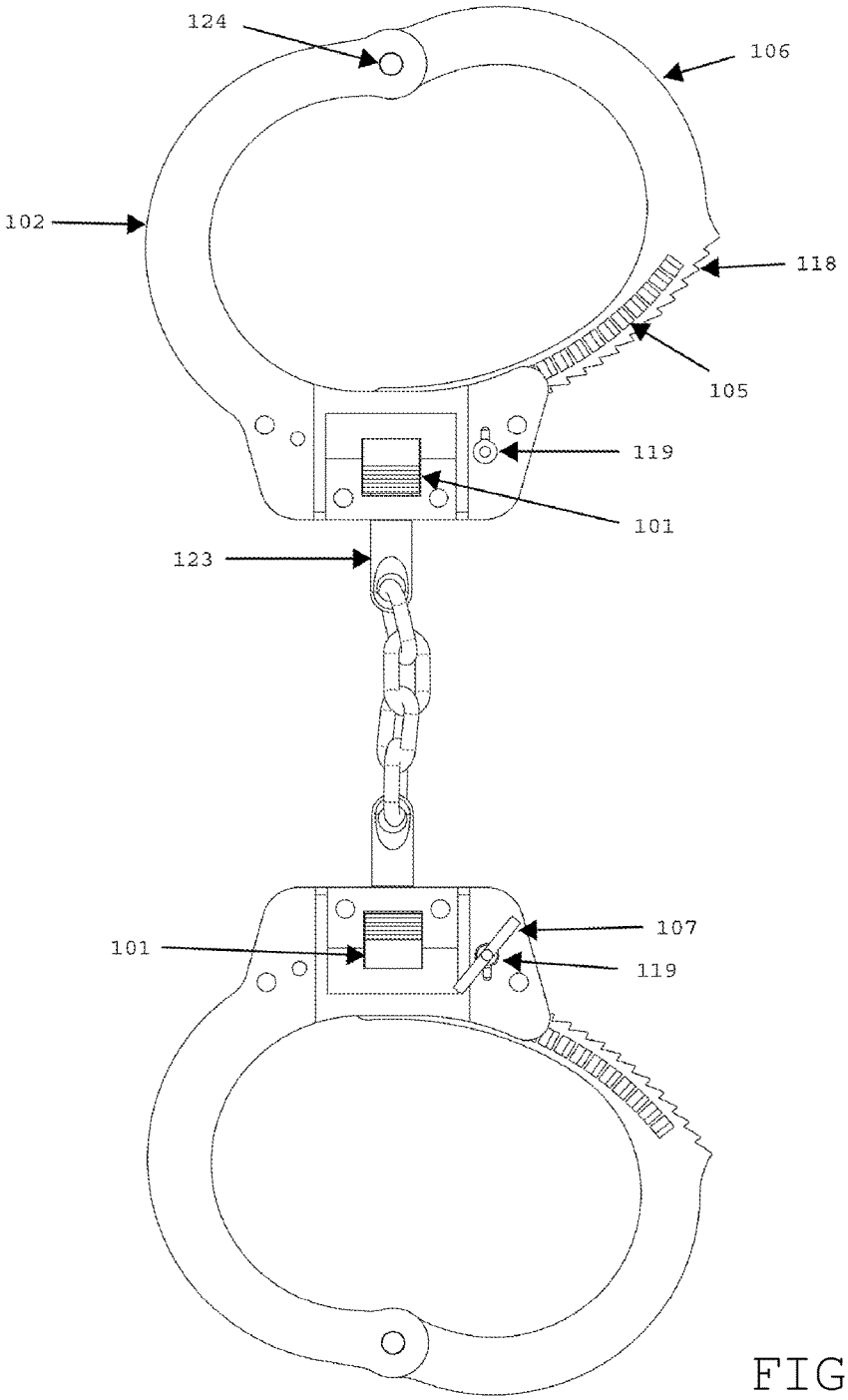
FIG. 1E shows the exterior of a set of handcuffs of the first embodiment.

FIG. 1A also shows the front ratchet button recess 114, handcuff key guidepost 115, handcuff key barrel 116, handcuff key bit 117, ratchet teeth 118, keyhole 119, double lock bar activation hole 120, key pawls 121, pawl spring 122, swivel 123, double strand hinge 124, key pawl pin 125, handcuff key bow 127, handcuff key spike 128 and double lock bar notch 129. FIG. 1D through and including FIG. 1M show various exterior perspectives of the handcuffs according to this first embodiment and showing generally the same parts reflected in FIGS. 1A and 1B. Part numbering in each of these views is identical, i.e. element 105 is intended to represent the same element (ratchet side indentations 105), in all of FIGS. 1A through 1QQ.

Figure 1F:
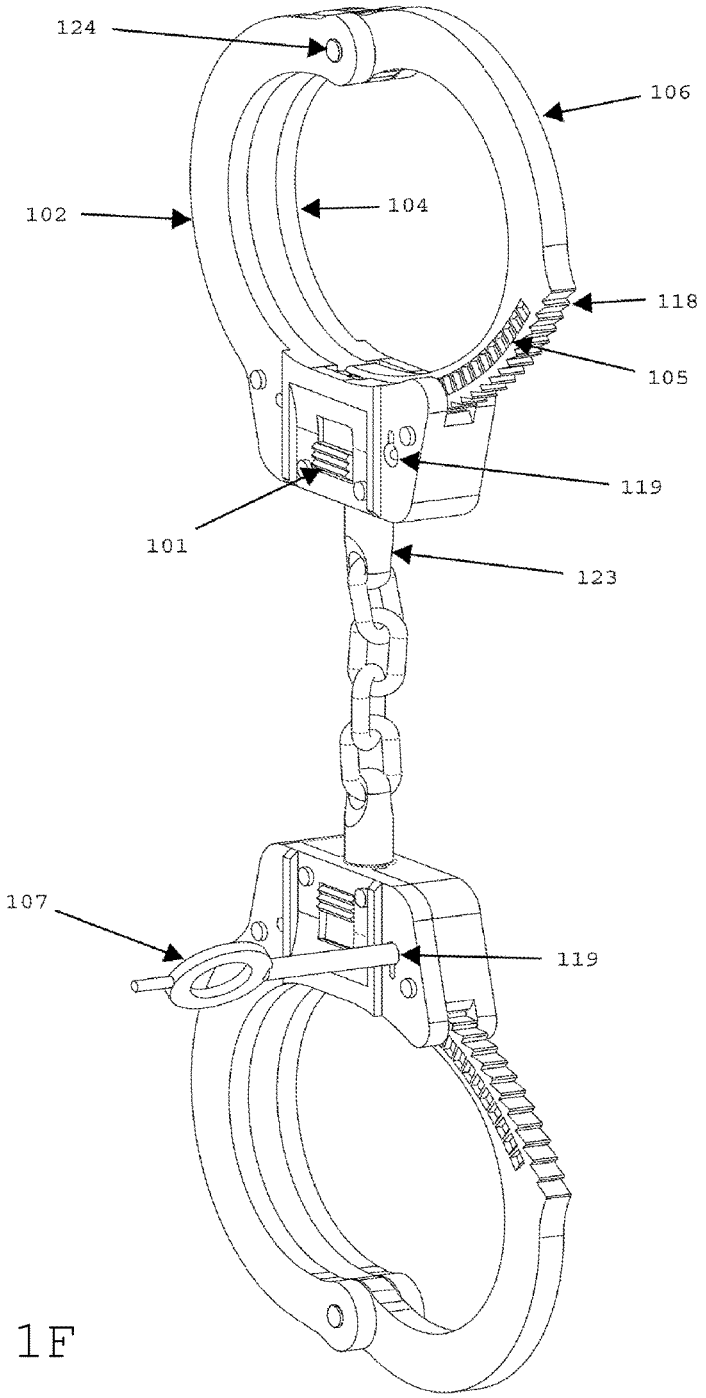
FIG. 1F shows the exterior of a set of handcuffs of the first embodiment.
Figure 1G:
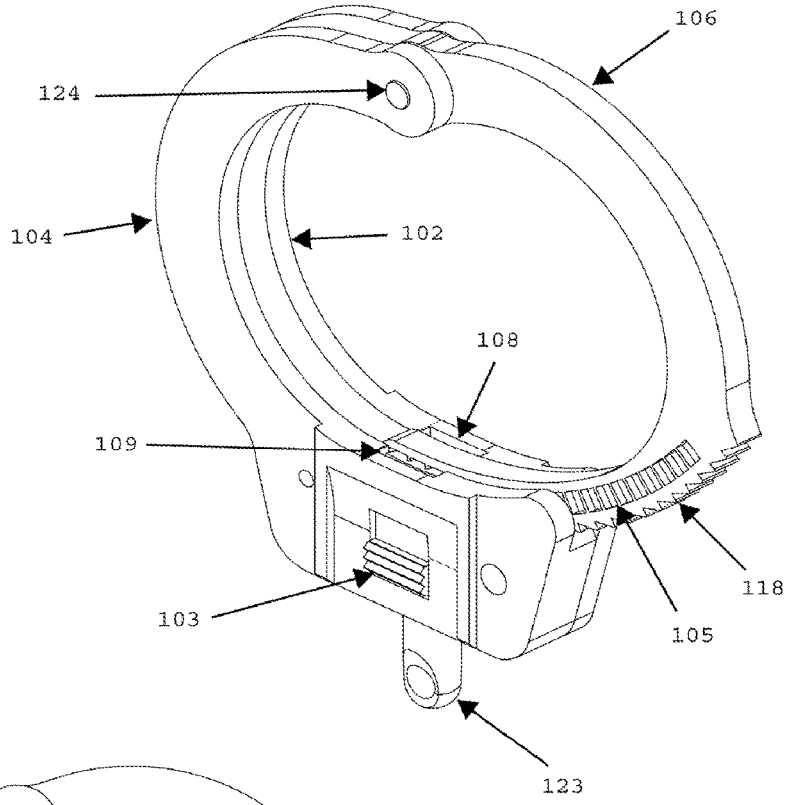
FIG. 1G shows the exterior of a handcuff of the first embodiment.
Figure 1H:
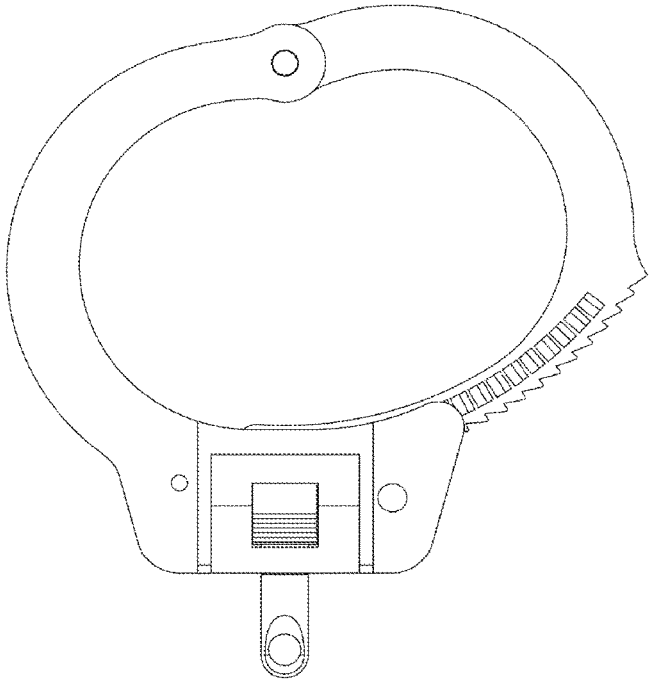
FIG. 1H is an alternate view of the exterior of a handcuff of the first embodiment.
Figure 1I:
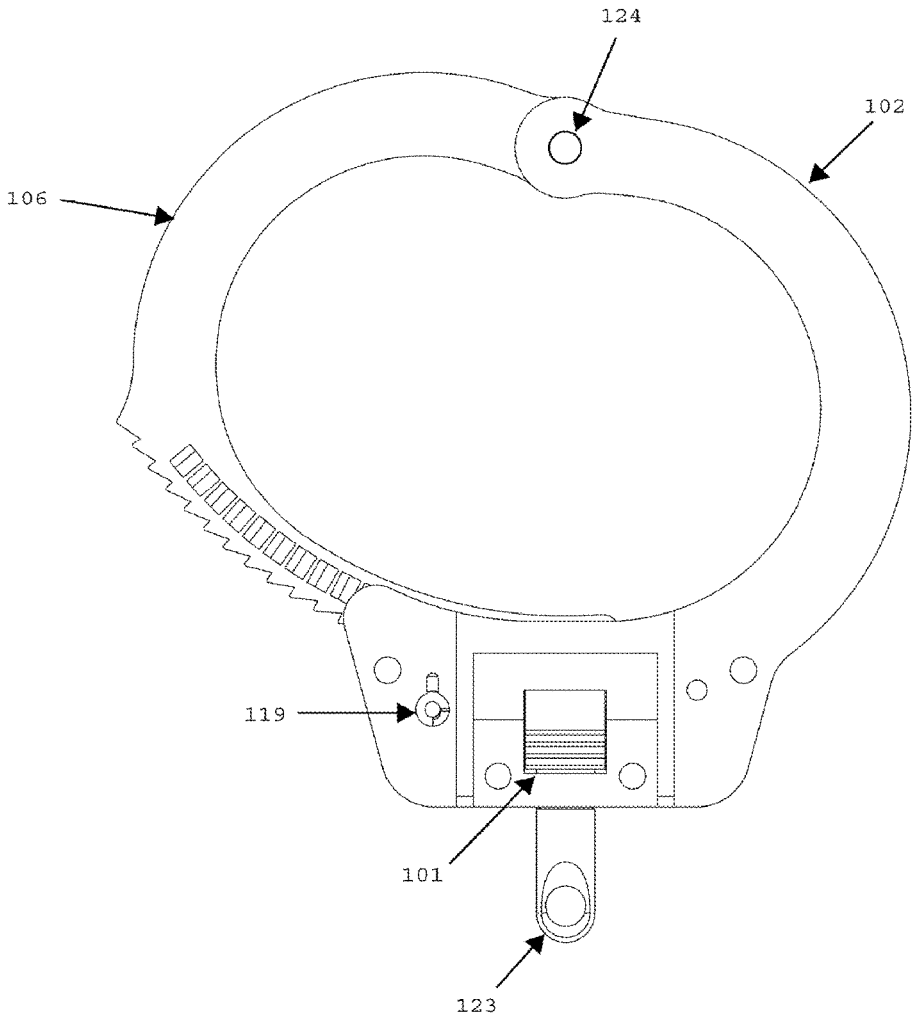
FIG. 1I is another view of the exterior of the handcuff of the first embodiment.
Figure 1J:
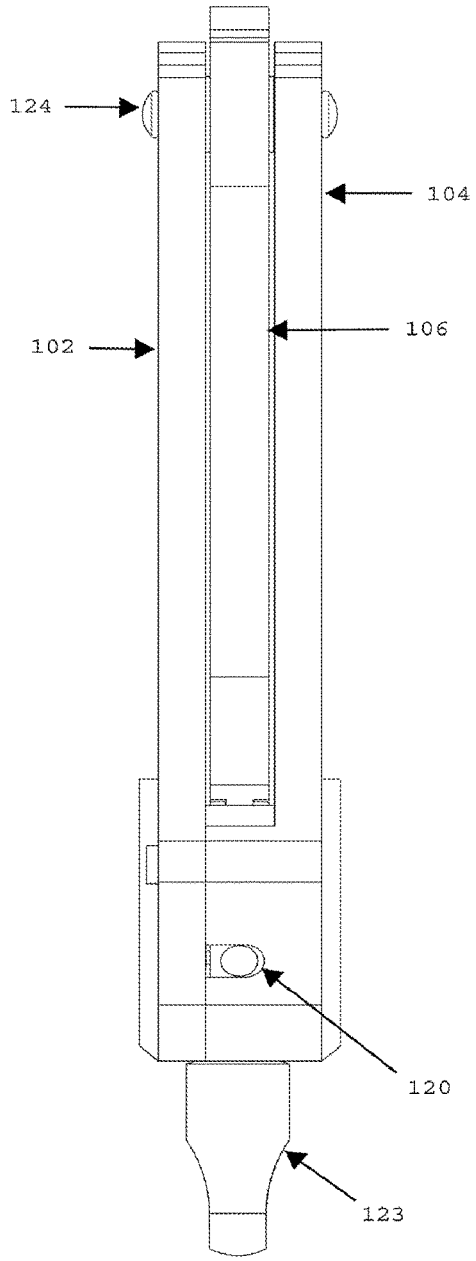
FIG. 1J shows the left side of a handcuff of the first embodiment.
Figure 1K:
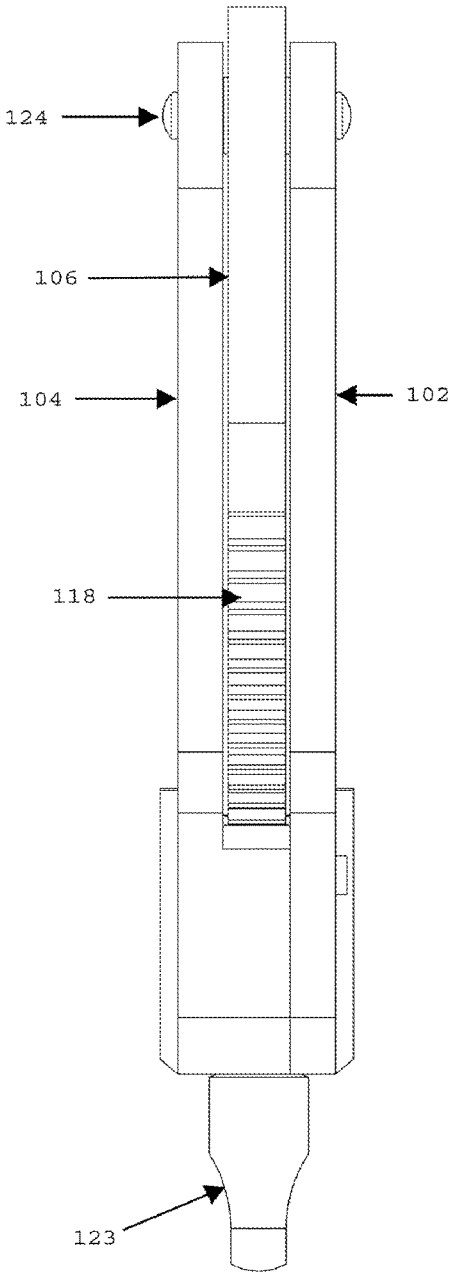
FIG. 1K shows the right side of a handcuff of the first embodiment.
Figure 1L:
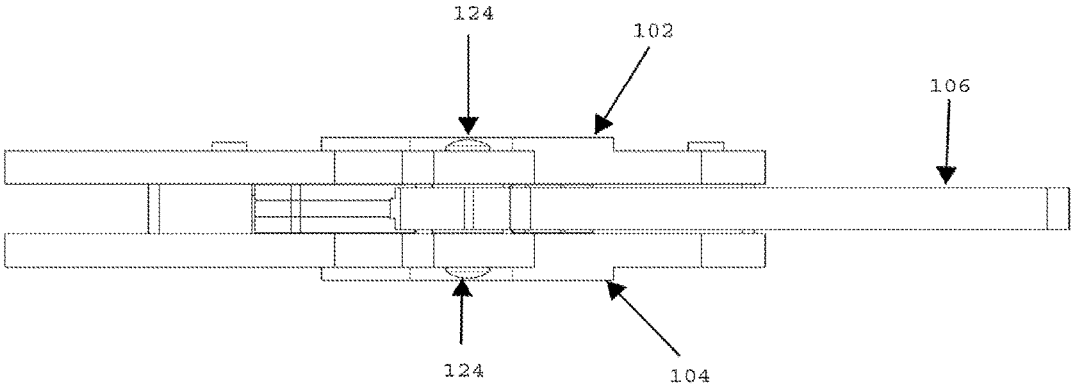
FIG. 1L shows the top of a handcuff according to the first embodiment.
Figure 1M:
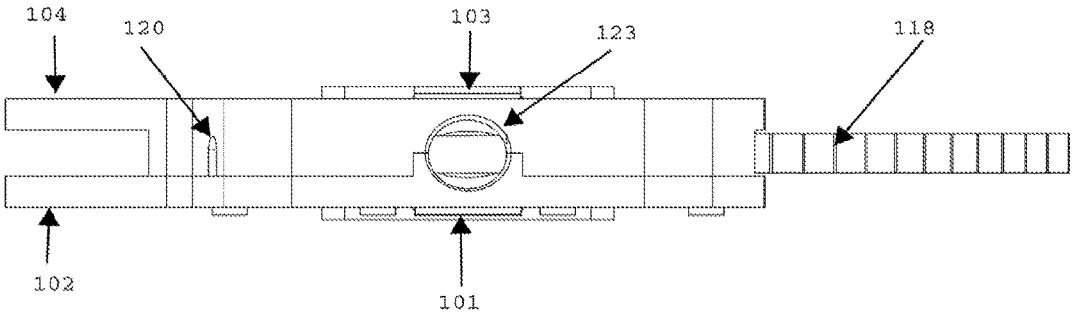
FIG. 1M shows the bottom of a handcuff according to the first embodiment.
Figure 1O:
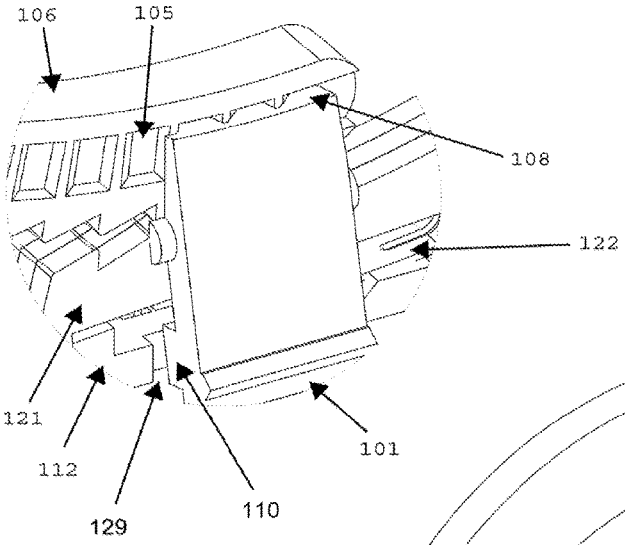
FIG. 1O is a close view of a selected locking portion of the embodiment of FIG. 1N.
Figure 1N:
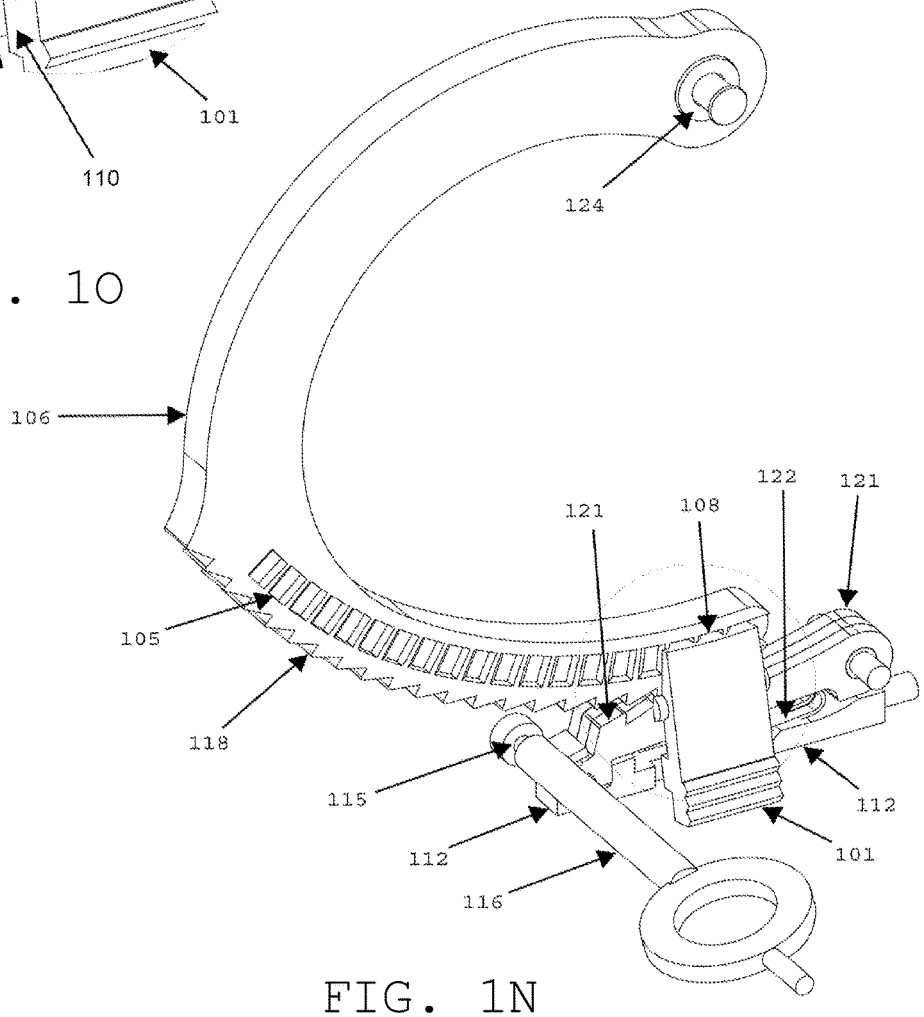
FIG. 1N shows front ratchet button, single strand ratchet 106 and handcuff key 107.

FIGS. 1N and 1O show the teeth 118 of the single strand 106 engaged with the teeth of the key pawls 121. Simultaneously, the protrusions 108 of the front ratchet button 101 are engaged with the ratchet side indentations 105 on both sides of the single strand. This creates a system whereby ratchet teeth and pawls are located on three different planes on the single strand 106 of the handcuff, making it more difficult to shim the handcuffs. FIGS. 1N and 1O also show the double lock bar 112 in the unlocked position, which allows the key pawls 121 to move up and down in an unimpeded manner when the single strand ratchet 106 is tightened without the use of a key. Additionally, while the double lock bar 112 is in the unlocked position, the double lock bar notches 129 are aligned with the ratchet button lower protrusions 110 and 111. This alignment allows the protrusions 110 and 111 to freely enter double lock bar notches 129 thereby allowing the single strand ratchet 106 to move when tightened or unlocked.

FIGS. 1N and 1O also show a universal handcuff key 107 inserted into the keyhole 119 of the handcuffs. FIGS. 1N and 1O show the handcuff key 107 has been turned clockwise thereby the handcuff key bit 117 engages with the key pawls 121. If the handcuff key 107 is turned clockwise, the key bit 117 depresses the key pawls 121 and disengages them from the ratchet teeth 118. In this depiction, however, the front ratchet button 101 is held under pressure by the ratchet button springs 113 and causes the front ratchet button upper protrusions 108 and the rear ratchet button upper protrusions 109 to engage both sides of the ratchet side indentations 105, also called single strand side indentations.

Figure 1P:
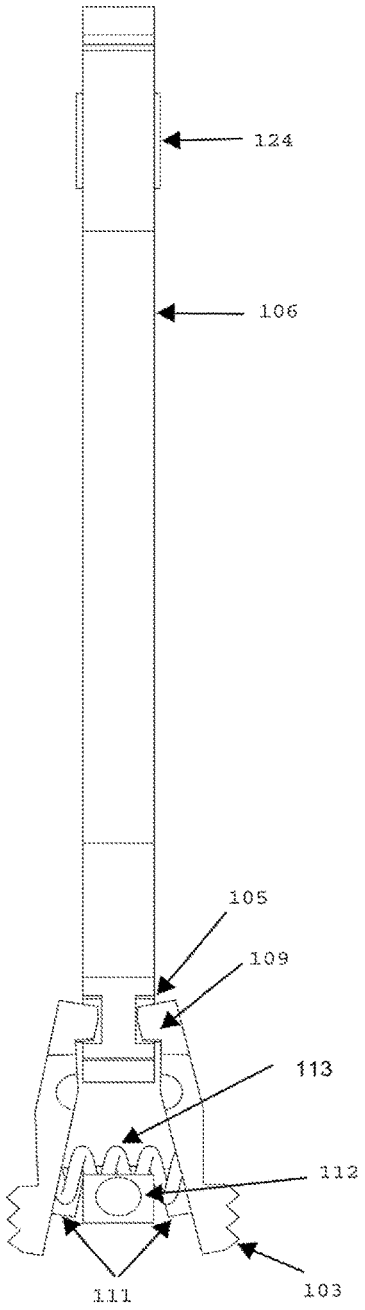
FIG. 1P shows a view of the ratchet button spring engagement with the ratchet buttons when they are not depressed.
Figure 1Q:
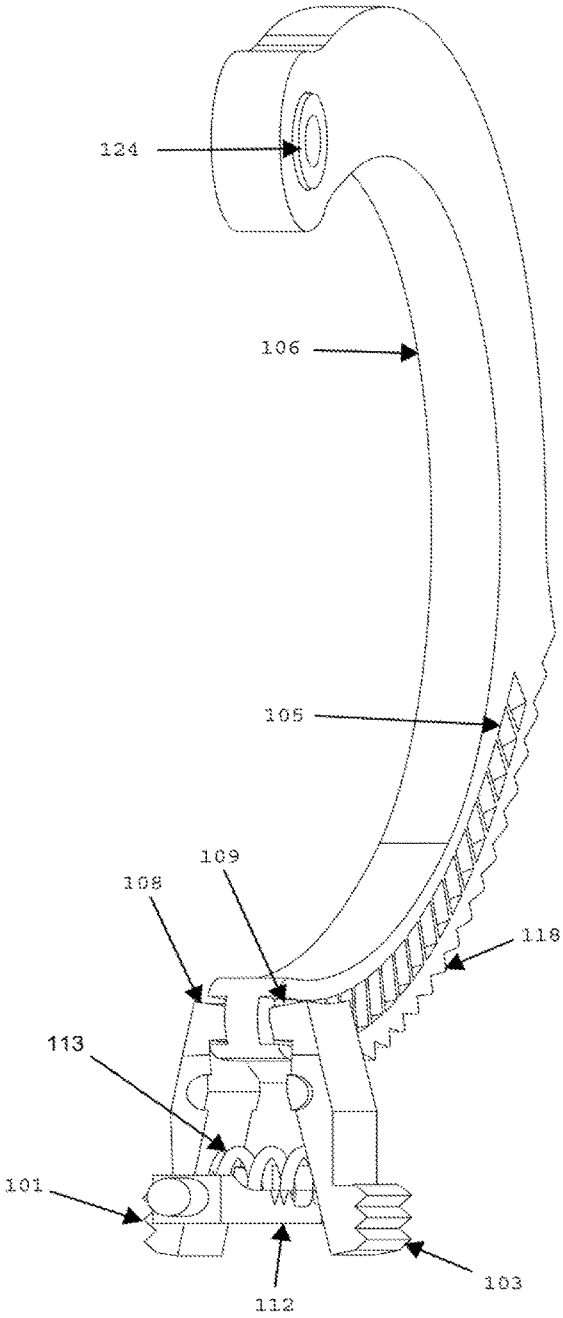
FIG. 1Q is an alternate view of FIG. 1P.

FIGS. 1P and 1Q show the single strand side indentations 105 of the single strand ratchet 106 being simultaneously engaged by front ratchet button upper protrusions 108 and rear ratchet button upper protrusions 109. Positive spring pressure is exerted outward by the ratchet button springs 113 into the bottom of the front ratchet button 101 and the rear ratchet button 103. Such a construction and pressure create a rocker switch effect whereby the harder the ratchet button springs 113 pushes, the harder the front ratchet button upper protrusions 108 and rear ratchet button upper protrusions 109 engage into the single strand side indentations 105.

Figure 1R:
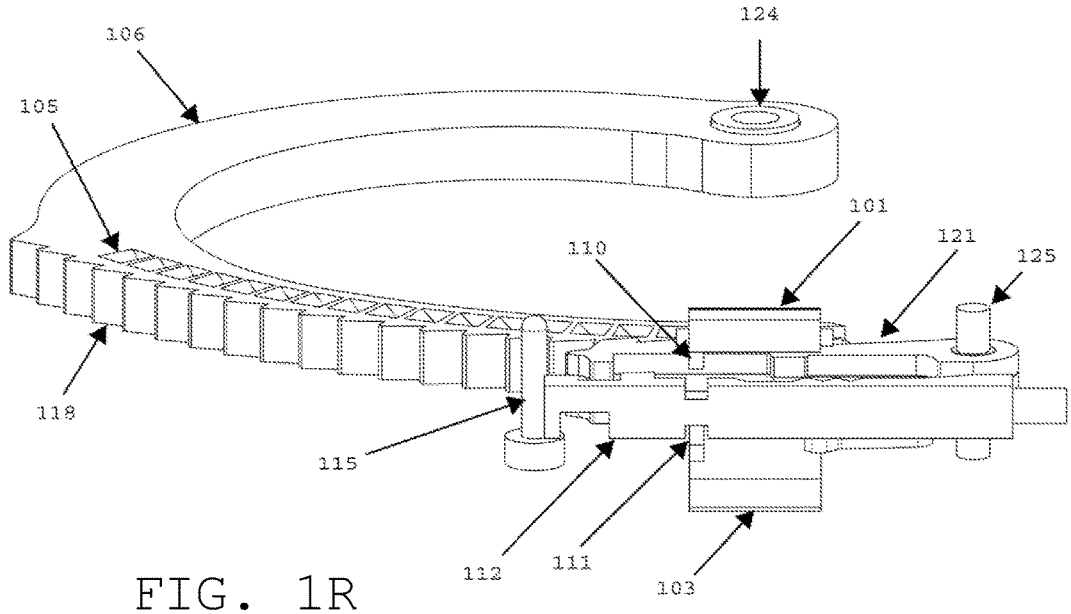
FIG. 1R shows a perspective bottom view of the first embodiment.
Figure 1S:
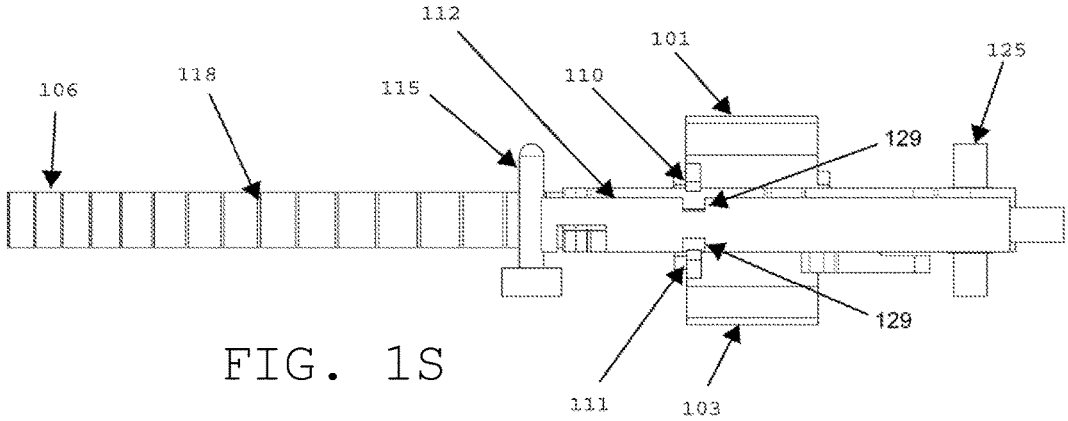
FIG. 1S is a bottom view of the first embodiment.

FIGS. 1R and 1S show the bottom of the single strand ratchet 106 as it engages key pawls 121. The front ratchet button 101 and the rear ratchet button 103 are shown as being engaged with the single strand side indentations 105 while the double lock bar notches 129 are aligned with the front ratchet button lower protrusions 110 and the rear ratchet button lower protrusions 111. This representation shows the double lock bar 112 in the unlocked position.

As long as the double lock bar 112 is in the unlocked position, the single strand ratchet 106 has the ability to tighten/close easily. This allows the handcuffs to the applied and tightened on a suspect's wrists without the need for handcuff key 107. In order to unlock or open the handcuffs, a handcuff key 107, lock pick, or similar device is placed inside the keyhole 119 and turned or manipulated so the key pawls 121 are depressed or pushed away from engagement with the single strand ratchet teeth 118. In a traditional handcuff, this action would unlock or open a standard handcuff if the double bar 112 had not been activated. With the current design, the handcuff remains locked and unable to be opened unless both the front ratchet button 101 and the rear ratchet button 103 are simultaneously depressed, along with depressing the key pawls 121, via the use of a handcuff key 107. In the current design, if the double lock bar 112 is moved into the locked position, the double lock bar notches 129 no longer align with the front ratchet button lower protrusions 110 and rear ratchet button lower protrusions 111. As a result, these protrusions 110 and 111 are blocked by the double lock bar 112 from moving, thereby preventing the handcuffs from being unlocked, loosened, or tightened unless the double lock bar 112 is first moved into the unlocked position.

Figure 1T:
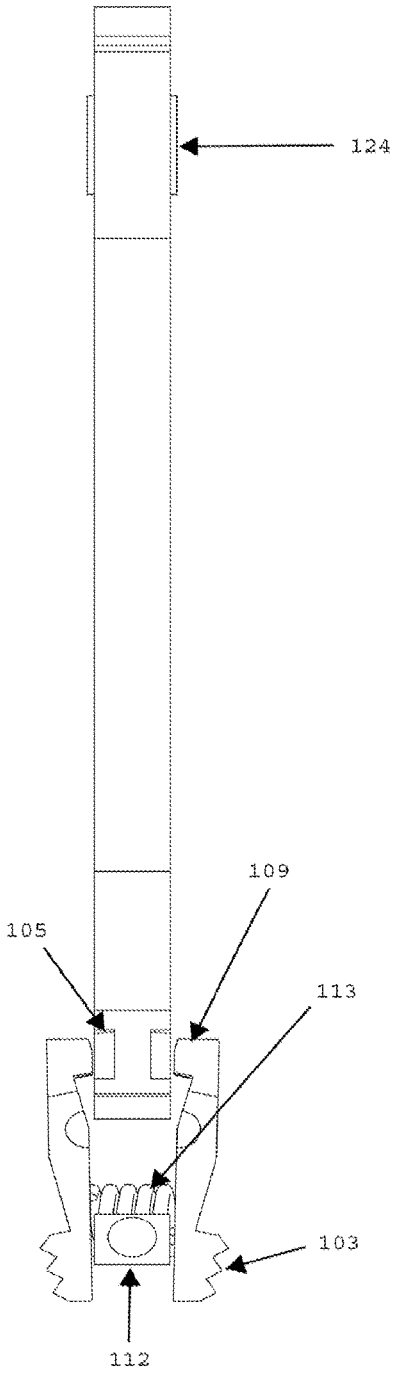
FIG. 1T shows a view of the ratchet button spring engagement with the ratchet buttons depressed.
Figure 1U:
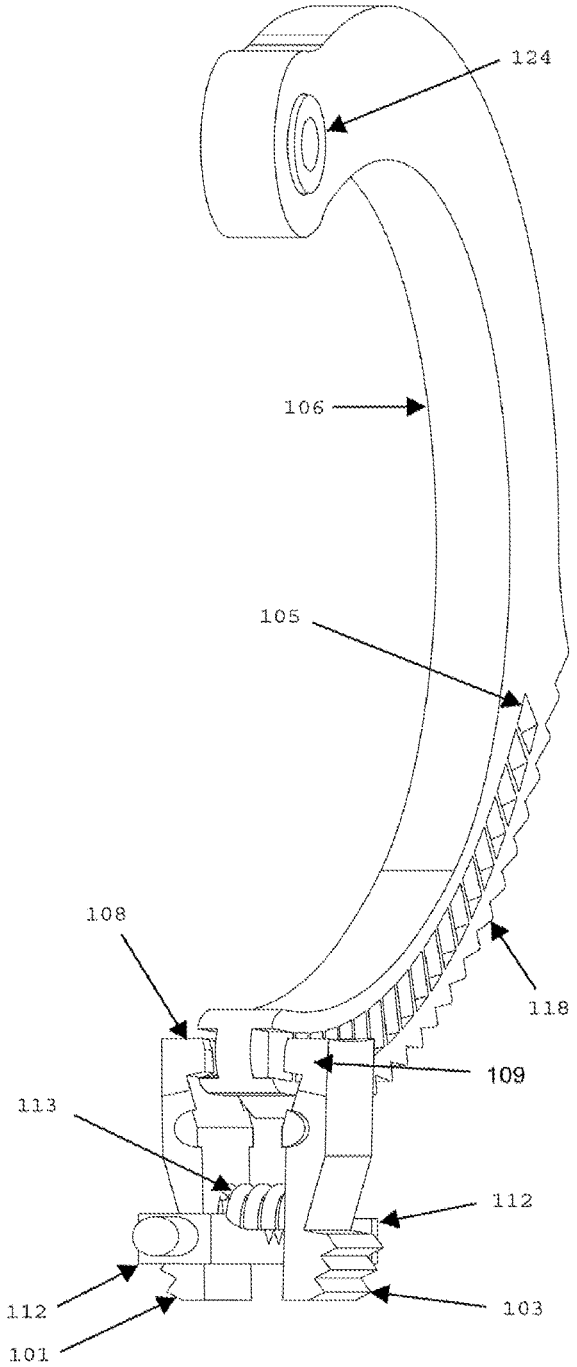
FIG. 1U is an alternate view of the ratchet button spring engagement with the ratchet buttons depressed.

FIGS. 1T and 1U represent the single strand ratchet 106 and the double lock bar 112 in the unlocked position. The front ratchet button 101 and rear ratchet button 103 are depressed in these views, thereby lifting the front ratchet button upper protrusions 108 and rear ratchet button upper protrusions 109 from the single strand side indentations 105. As long pressure is exerted on the bottom of the front ratchet button 101 and rear ratchet button 103, pressure is exerted and compresses the ratchet button springs 113.

Figure 1V:
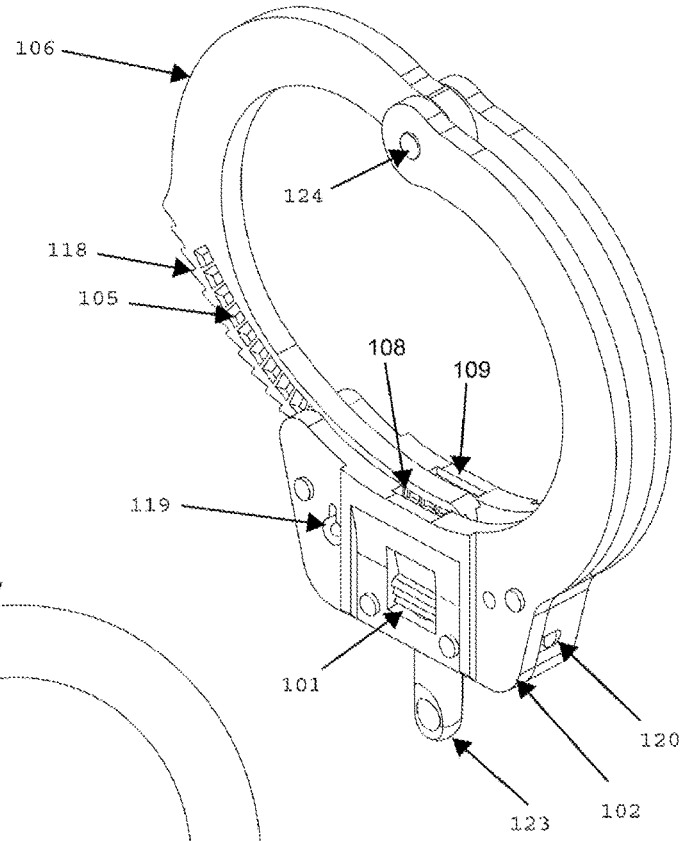
FIG. 1V shows an exterior view of a handcuff where the ratchet button has been depressed.
Figure 1W:
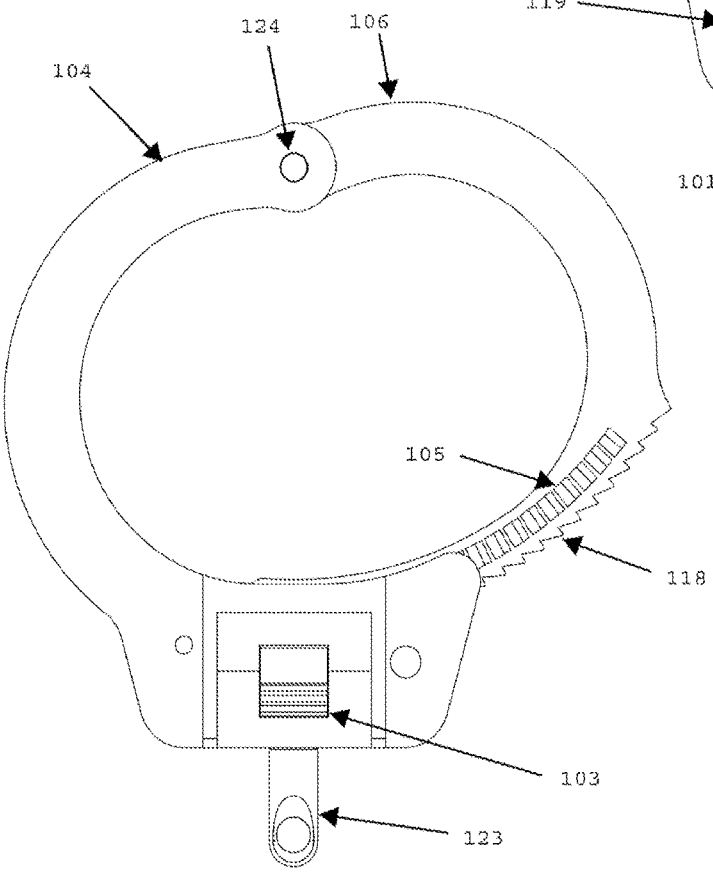
FIG. 1W is another view of a handcuff where the ratchet button has been depressed.
Figure 1X:
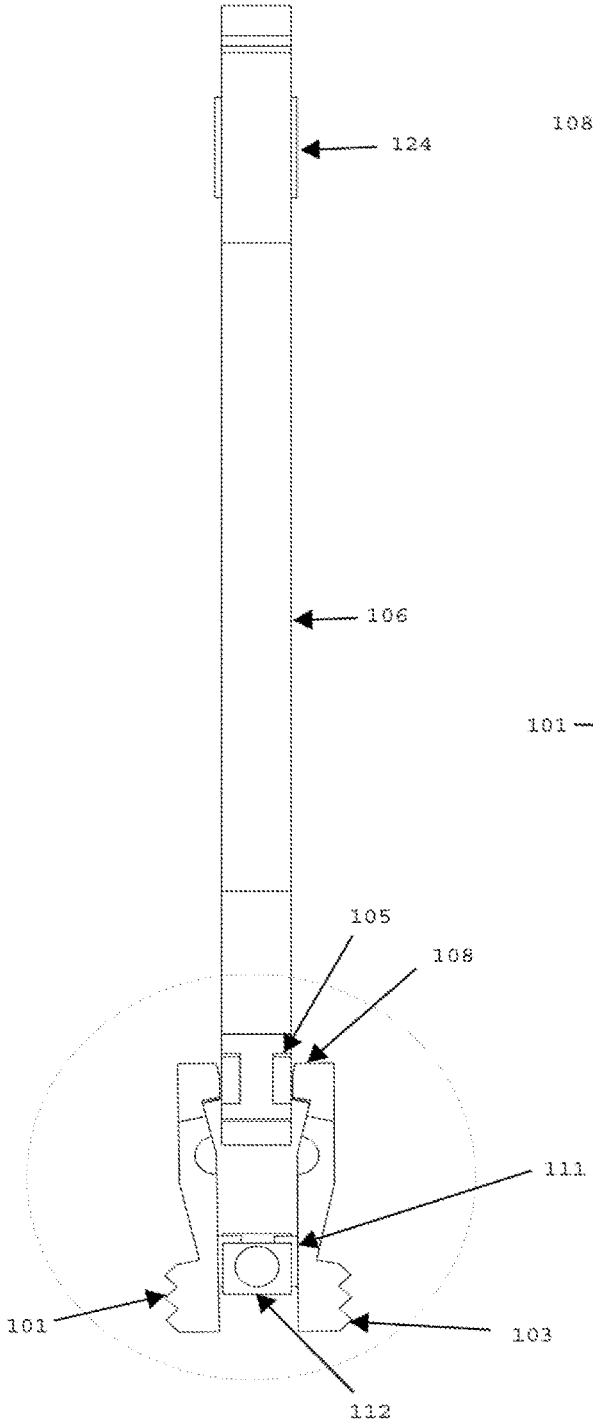
FIG. 1X shows the ratchet buttons being depressed and further engagement with the ratchet side indentations.
Figure 1Y:
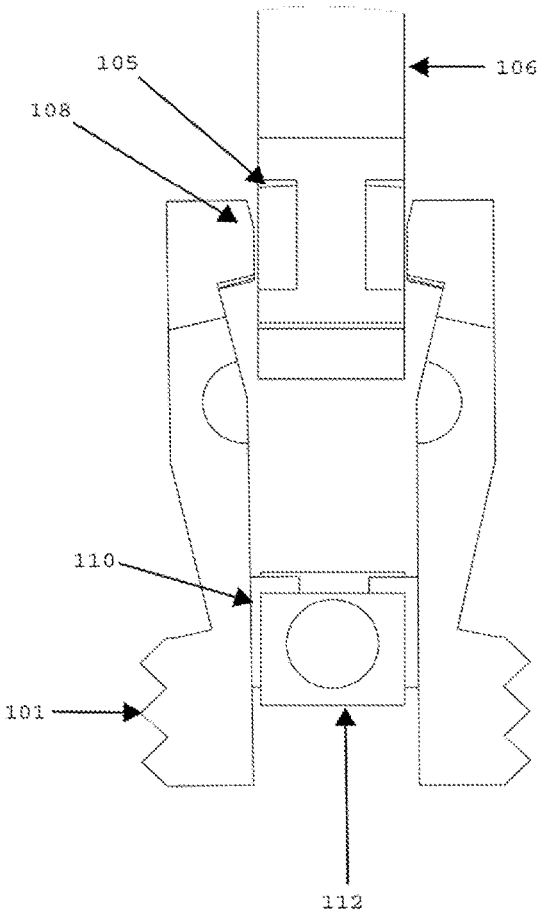
FIG. 1Y illustrates an alternate view of the ratchet buttons being depressed and further engagement with the ratchet side indentations.
Figure 1A:
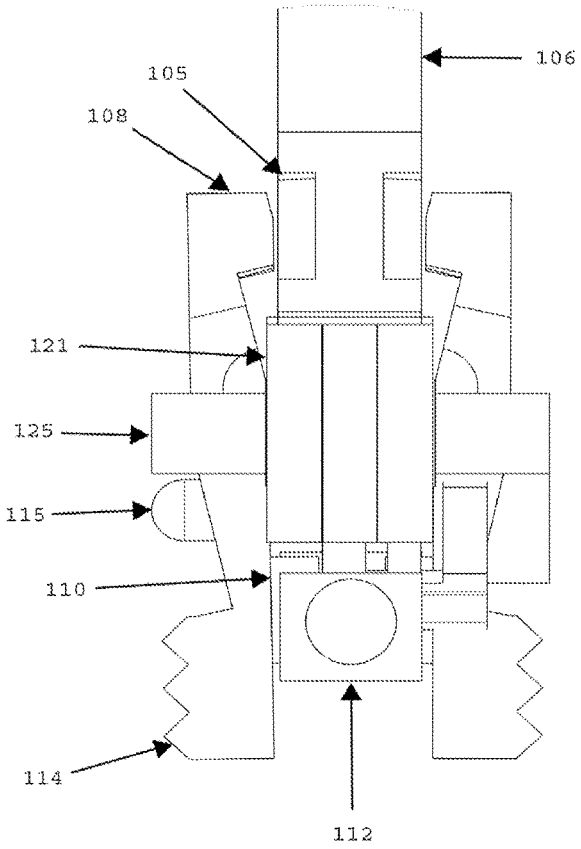
Figure 1Z:
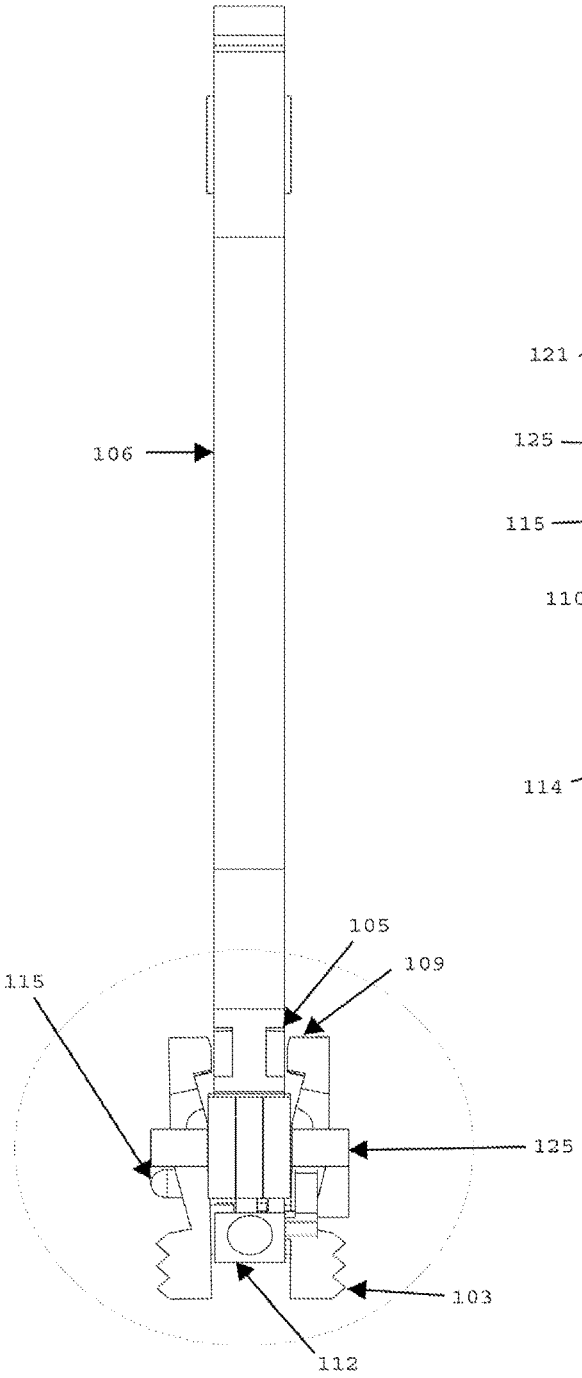
FIG. 1Z shows the ratchet buttons being depressed and still further engagement with the ratchet side indentations.
Figure 1F:
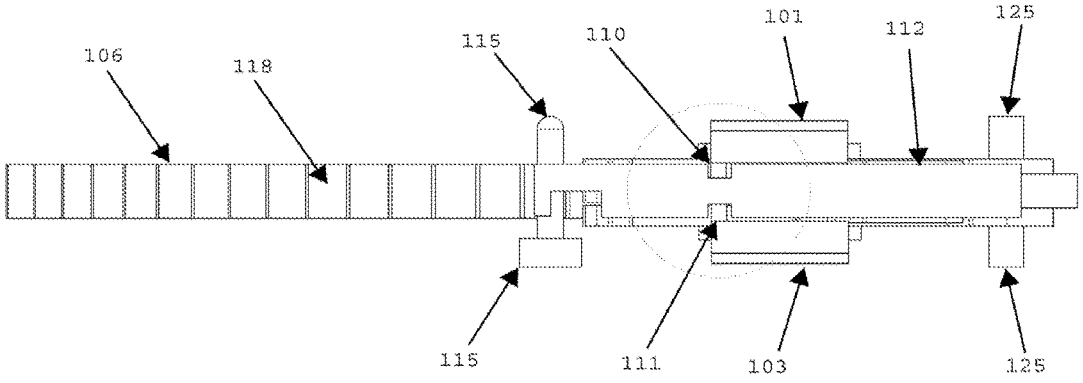
Figure 1G:
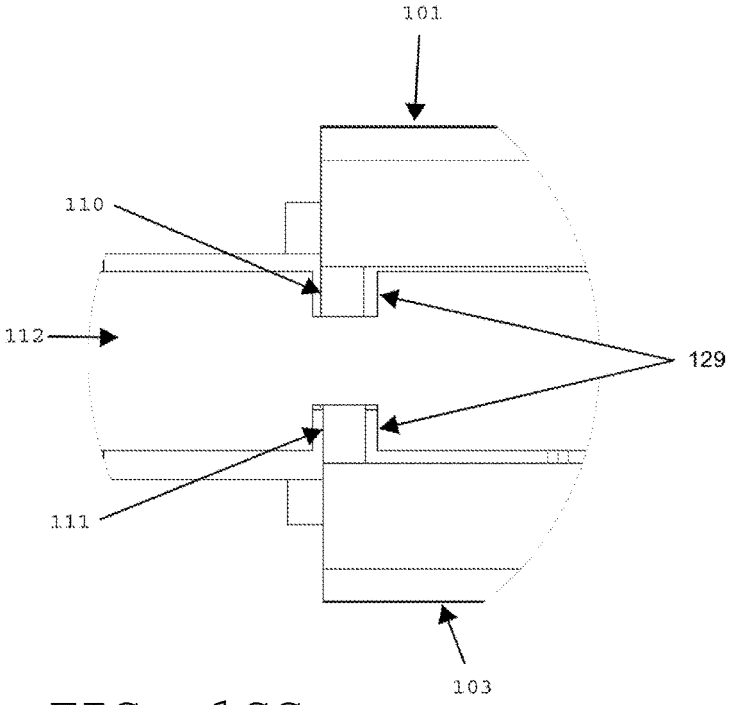
Figure 1H:
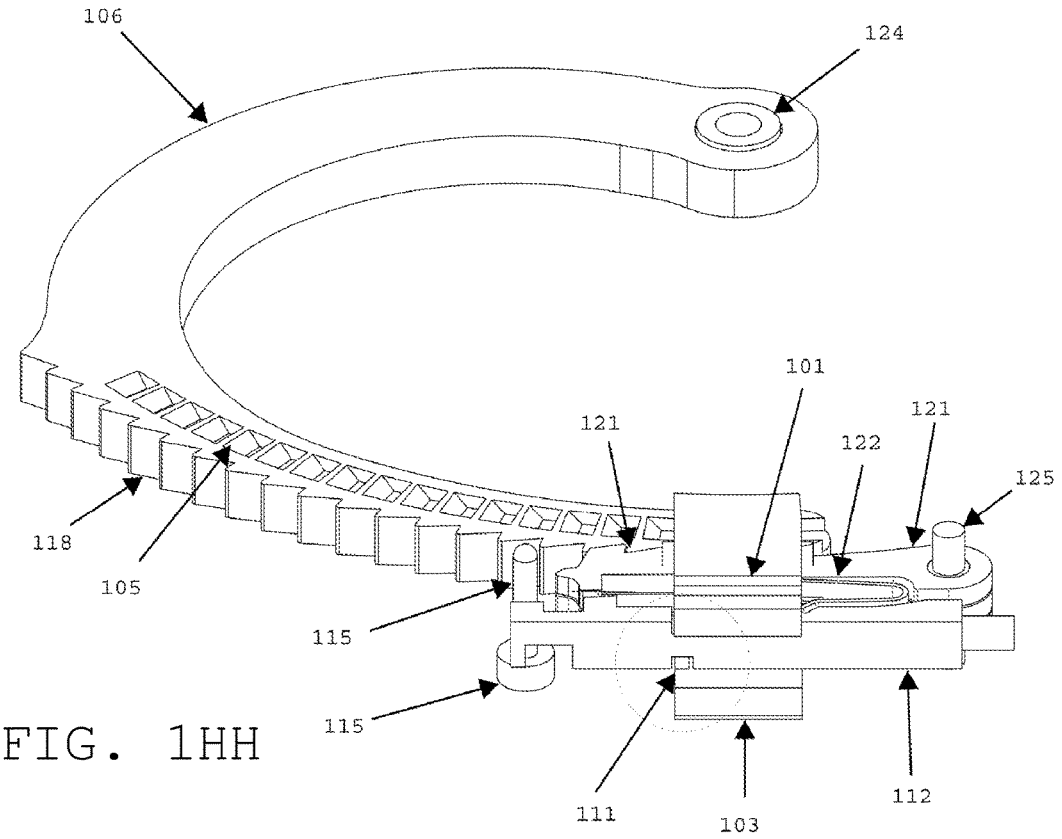
Figure 1I:
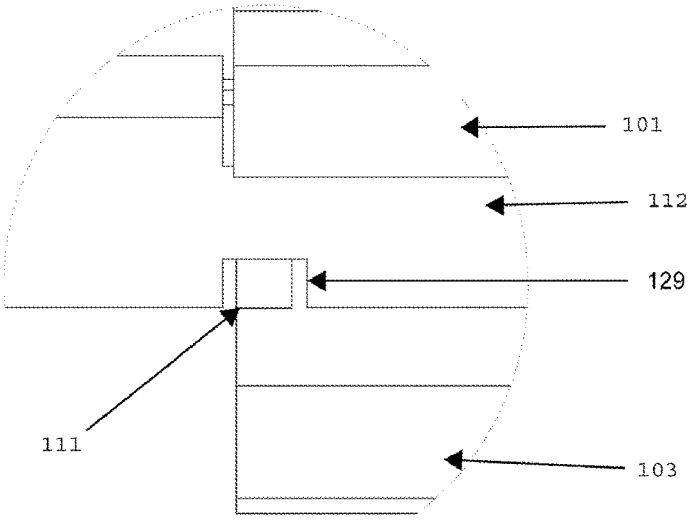
Figure 1J:
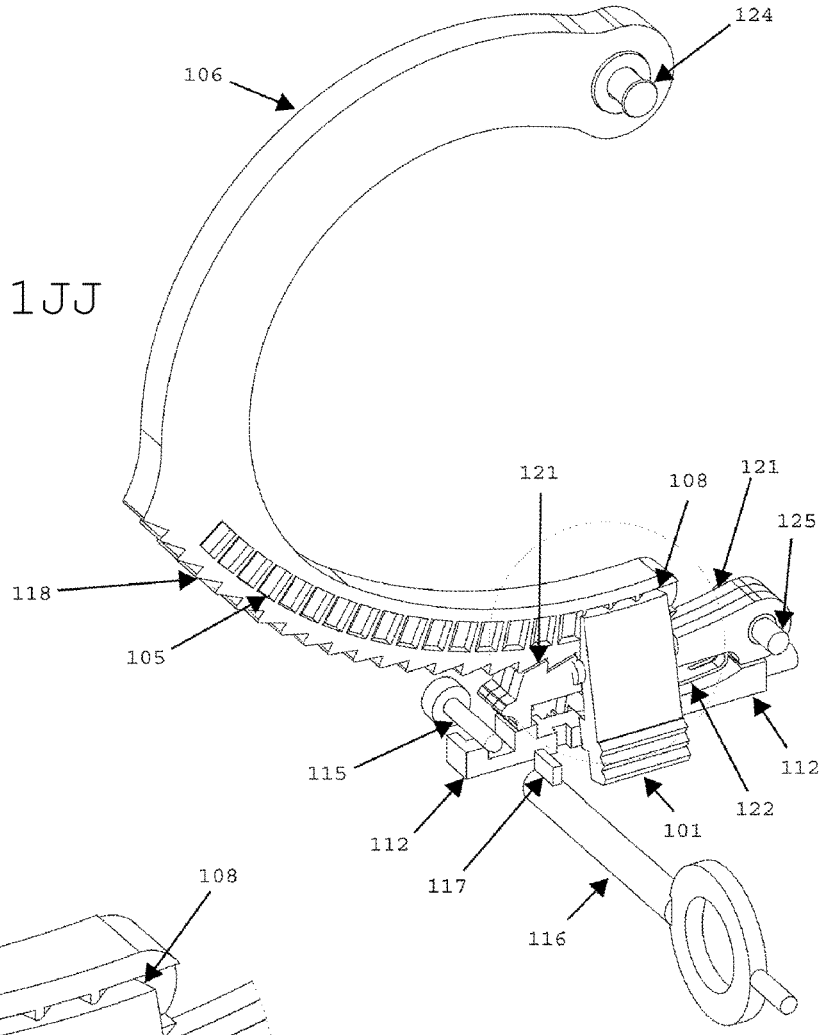
Figure 1K:
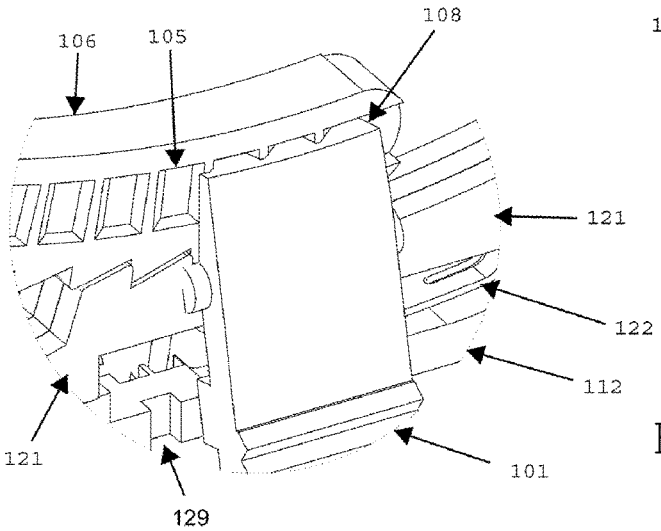
Figure 1L:
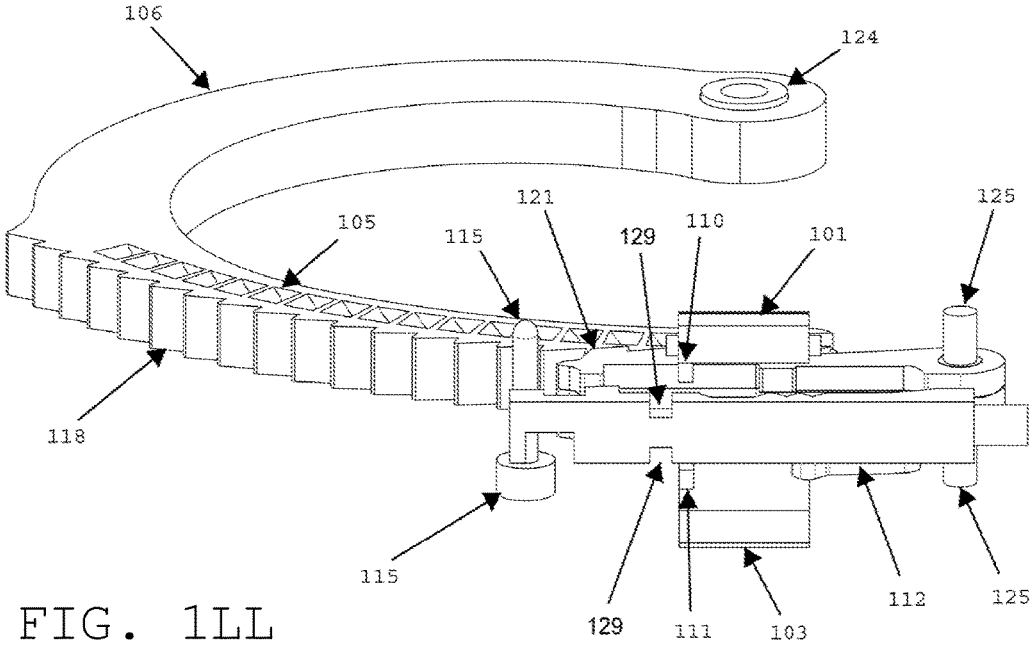
Figure 1M:
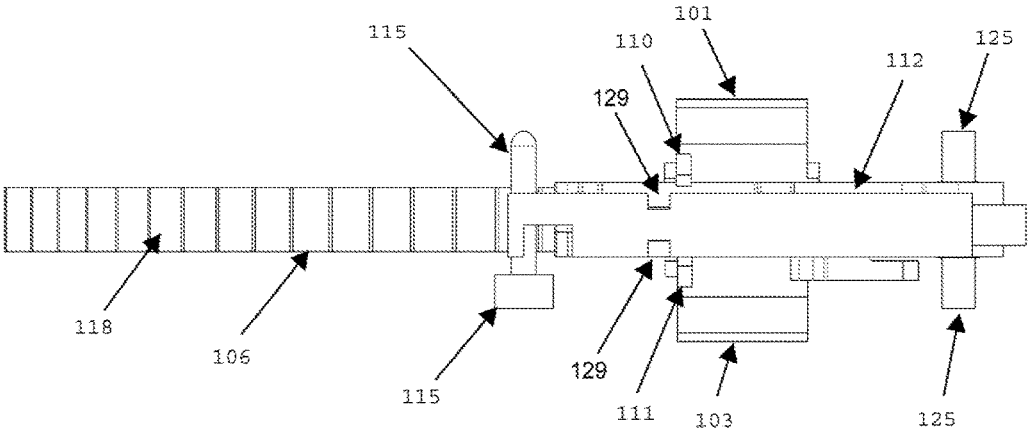
Figure 1N:
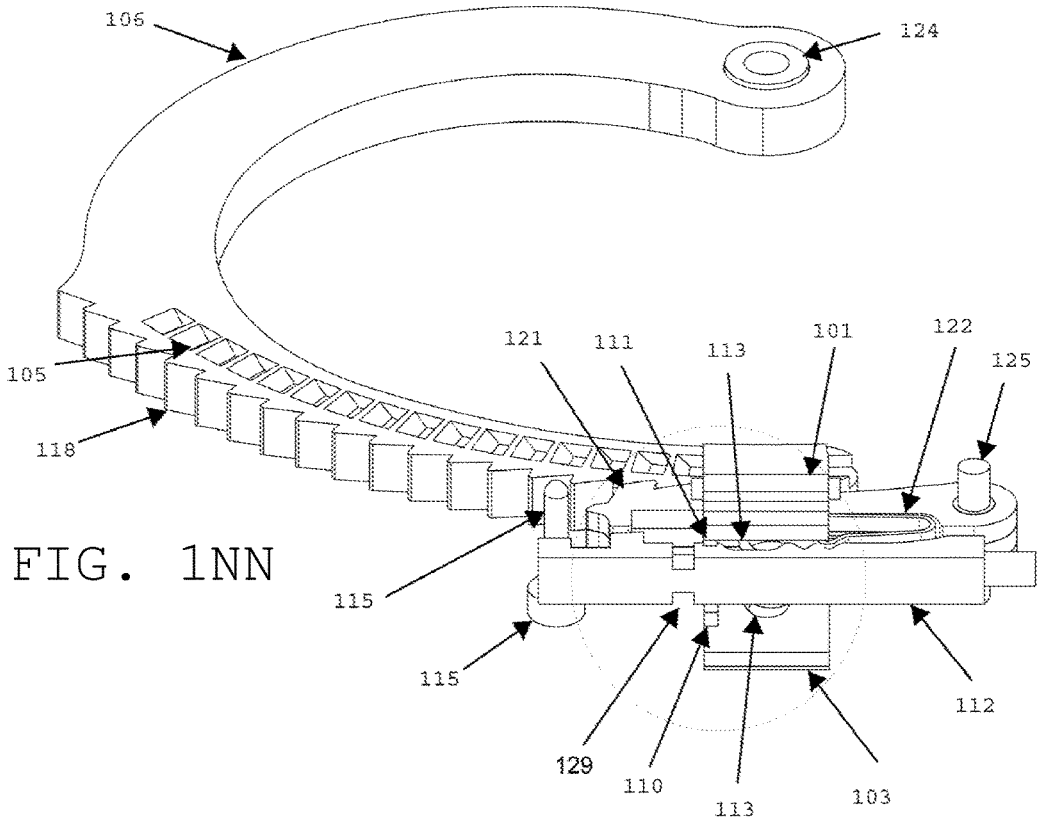
Figure 1O:
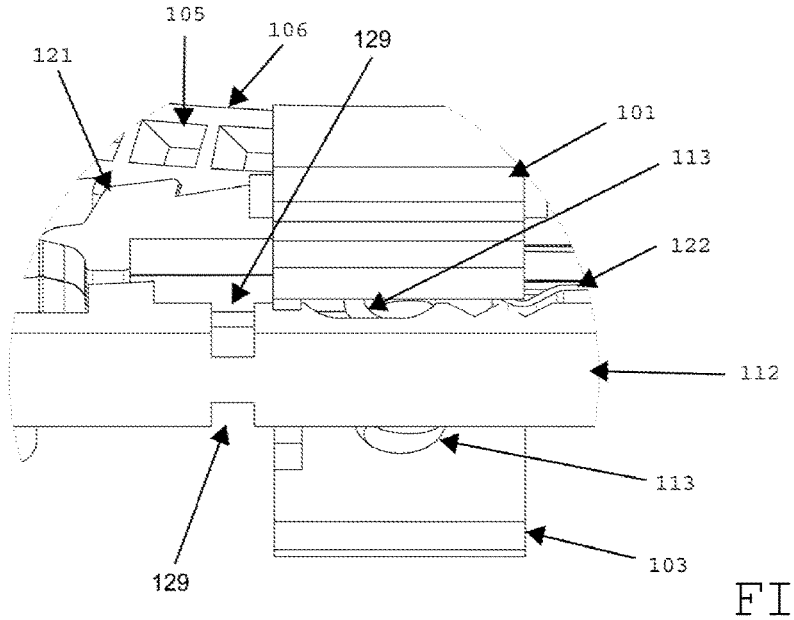

FIGS. 1V and W provide an exterior view of the handcuffs as the front ratchet button 101 is being depressed. The front ratchet button upper protrusions 108 and the rear ratchet button upper protrusions 109 are shown as being lifted from engagement with the single strand side indentations 105 of the single strand ratchet 106.

FIGS. 1X, 1Y, 1Z, and 1AA provide another set of views of the front ratchet button 101 and rear ratchet button 103 being depressed which elevates the front ratchet button upper protrusions 108 and rear ratchet button upper protrusions 109 from the single strand side indentations 105. FIGS. 1BB, 1CC, 1DD, and 1EE show the front ratchet button 101 and rear ratchet button 103 being depressed, elevating the front ratchet button upper protrusions 108 and rear ratchet button upper protrusions 109 from the single strand side indentations 105. Simultaneously, a handcuff key 107 is shown being inserted into the keyhole 119 and turned so the key bit 117 engages the key pawl 112. The key pawl is depressed and no longer engages the ratchet teeth 118 of the single strand ratchet 106. The double lock bar 112 is shown in the unlocked or unengaged position. This creates a condition whereby the single strand ratchet 106 is no longer held by the locking mechanism of the handcuff and can be opened or unlocked.

FIGS. 1FF, 1GG, 1HH, and 1II represent a bottom view of the handcuff mechanism. The double lock bar 112 is in the unlocked position and the front ratchet button lower protrusions 110 and the rear ratchet button lower protrusions 111 are engaged with the double lock bar notches 129. FIGS. 1JJ through 1QQ show the double lock bar 112 in the engaged or locked position. When in the locked position, the front ratchet button lower protrusions 110 and the rear ratchet button lower protrusions 111 are no longer aligned with the double lock bar notches 129. The front ratchet button 101 and rear ratchet button 103 can no longer be depressed which prohibits the front ratchet button upper protrusions 108 and the rear ratchet button upper protrusions 109 from disengaging from the single strand side indentations 105. This effectively locks the handcuffs and prevents them from being unlocked, loosened or tightened unless the double lock bar 112 is first moved in the unlocked position and then the front ratchet button 101 and the rear ratchet button 103 must be depressed as the key pawl 121 is simultaneously depressed via the use of a handcuff key 107 or locking picking tool.

Materials employed in all embodiments of the present design may include virtually any appropriate in the circumstances, including but not limited to metals, plastics, composites, and so forth. Certain components may be made of metal, including various types of metal appropriate for the application (steel, etc.), while certain components may be made of similar or different materials, such as plastics (e.g. PEEK, polyether ether ketone) or other materials. In one embodiment, the double lock bar may be constructed of PEEK while other parts of the handcuff are formed of different materials such as steel. In all, different materials may be used in different parts of the inventive handcuffs presented, and any acceptable manner of constructing the handcuffs may be employed, including metal fabrication, 3D printing, and so forth.

Figure 2A:
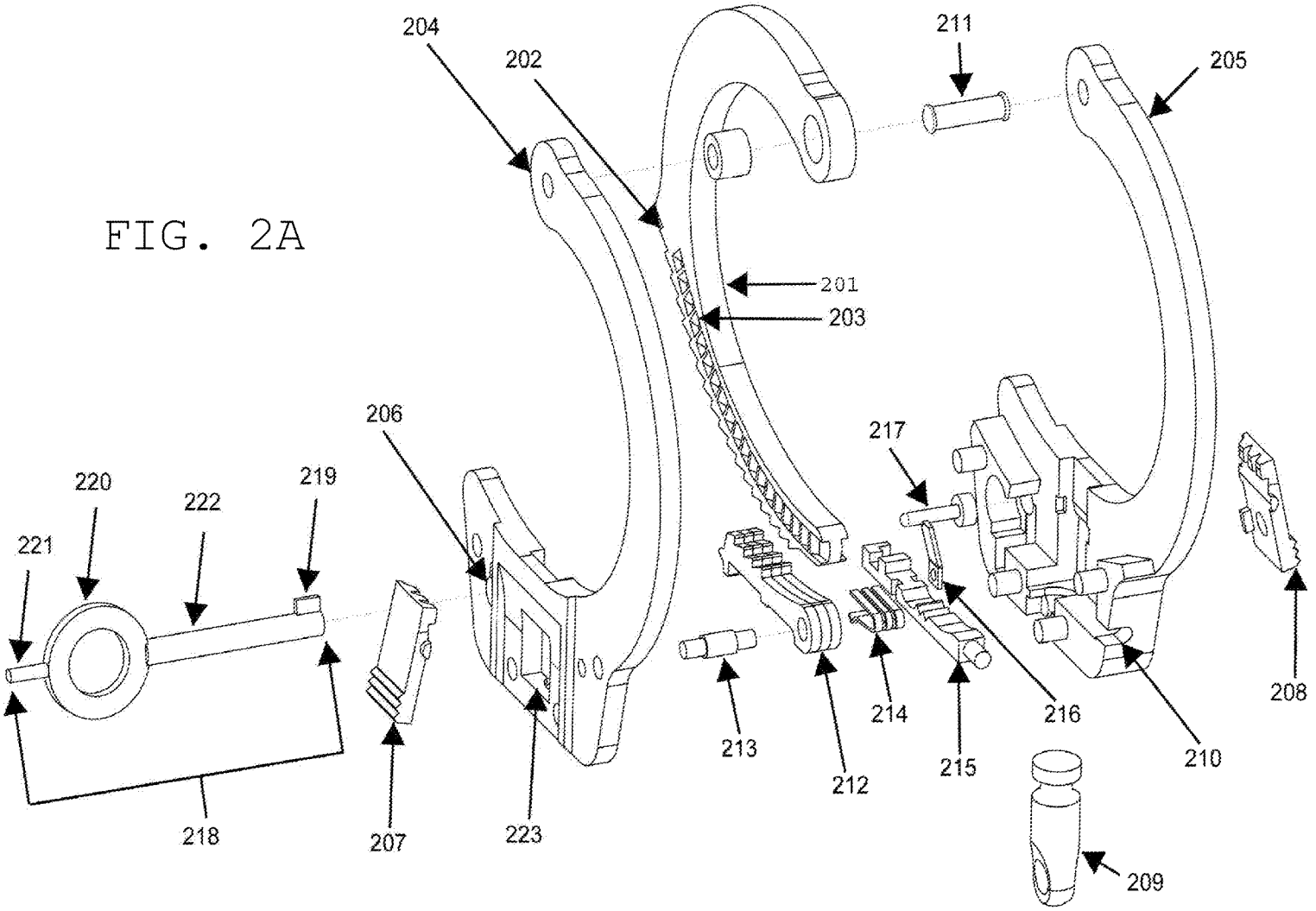
FIG. 2A illustrates an exploded view of a second embodiment.

A second variation of the design is presented in FIG. 2A in an exploded view. FIG. 2A shows various components including a single strand 201, ratchet teeth 202, ratchet side indentations 203, front double strand 204, rear double strand 205, keyhole 206, front ratchet button 207, rear ratchet button 208, swivel 209, double lock bar activation hole 210 and a double strand hinge 211. The illustration also depicts key pawls 212, key pawl pin 213, pawl spring 214, double lock bar 215, double lock bar security spring 216, handcuff key guidepost 217, handcuff key 218, handcuff key bit 219, handcuff key bow 220, handcuff key spike 221, handcuff key barrel 222 and the front ratchet button recess 223.

In this embodiment of the design, key pawls 212 engage with the ratchet teeth 202 of the single strand 201 while the front ratchet button 207 and the rear ratchet button 208 simultaneously engage with the ratchet side indentations 203 of the single strand 201. When the double lock bar 215 is in the unlocked position, the single strand is able to tighten freely as the configuration of the key pawls 212, front ratchet button 207 and the rear ratchet button 208 prevent the single ratchet from opening or moving backwards without the use of a handcuff key 218.

The double lock bar 215 can be pushed into the locked position by placing the handcuff key spike 221 inside the double lock bar activation hole 210 and pushing the double lock bar 215. The double lock bar 215 is pushed towards the keyhole 206 thereby locking the key pawls 212, front ratchet button 207 and rear ratchet button 208 into place and preventing them from moving. This prevents the handcuff single strand 201 from opening or closing.

FIGS. 2B to 2G show the interior of a handcuff, which shows the double lock bar 215 in the unlocked position. The unlocked position allows for the key pawls 212 to move downward toward the double lock bar as the single strand ratchet 201 is tightened without the use of a handcuff key 218. This embodiment of the design includes a double lock bar security spring 216, which may be affixed permanently or temporarily to the bottom of the area of the rear double strand 205. The double lock bar security spring 216 is bent at an angle to provide positive forward pressure towards the front double strand plate 204. The top corner of the double lock bar security spring 216 may have a scalloped corner, which engages against the handcuff key post 217. As shown in FIGS. 2B to 2G, the double lock bar security spring 216 is held flat and under pressure against the rear double strand plate 205 by the side of the double lock bar 215.

Figure 2B:
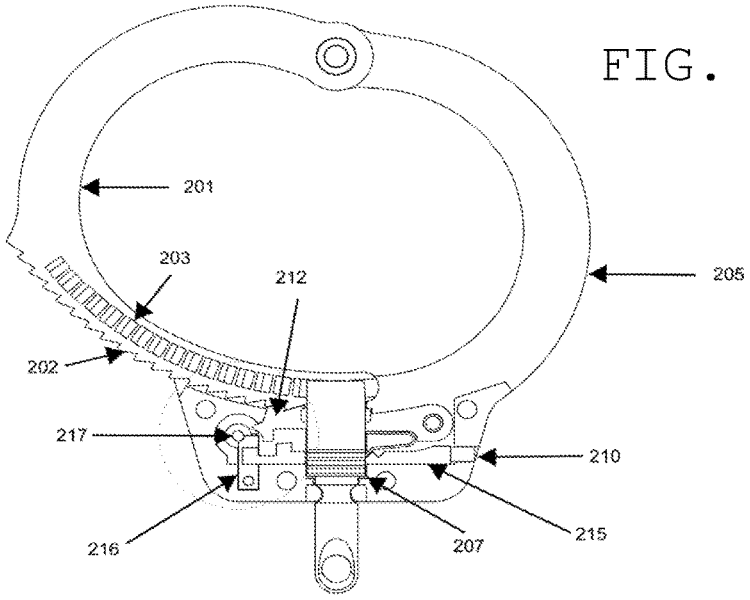
FIG. 2B is a view of the second embodiment highlighting the interior of the handcuff design.
Figure 2C:
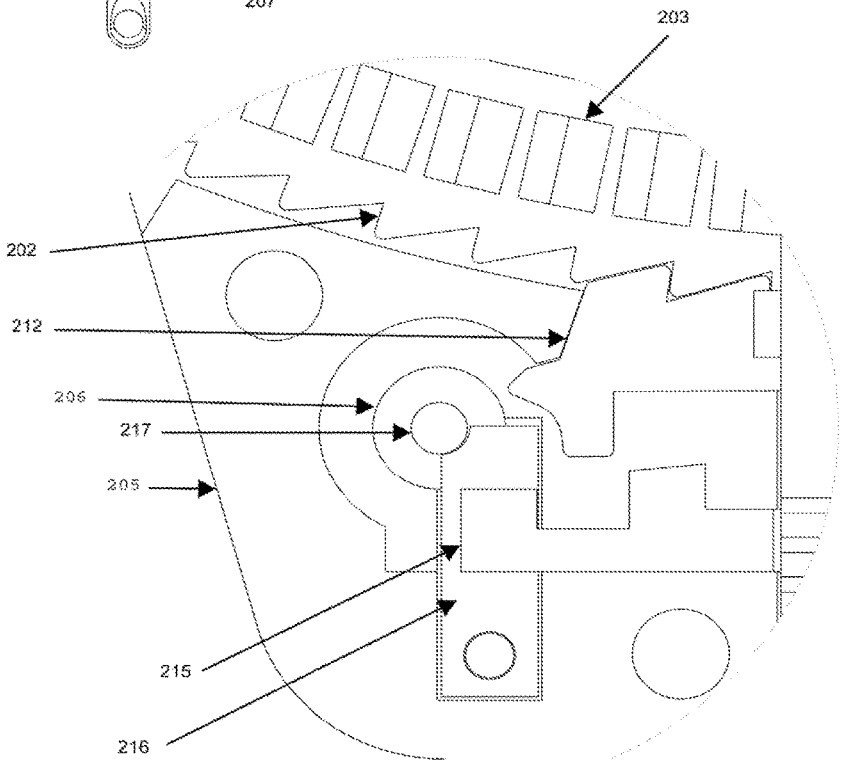
FIG. 2C is an expanded view showing the interior of the handcuff design.
Figure 2D:
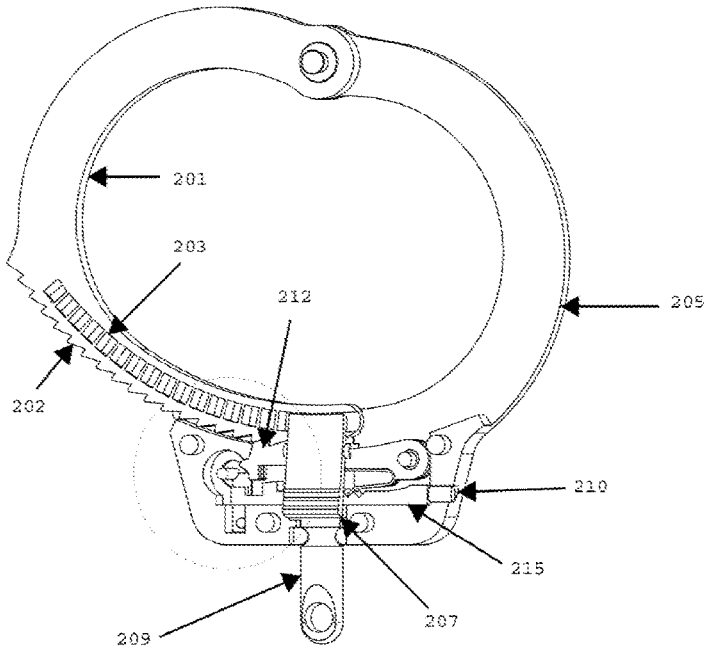
FIG. 2D shows the double lock bar in the unlocked position.
Figure 2E:
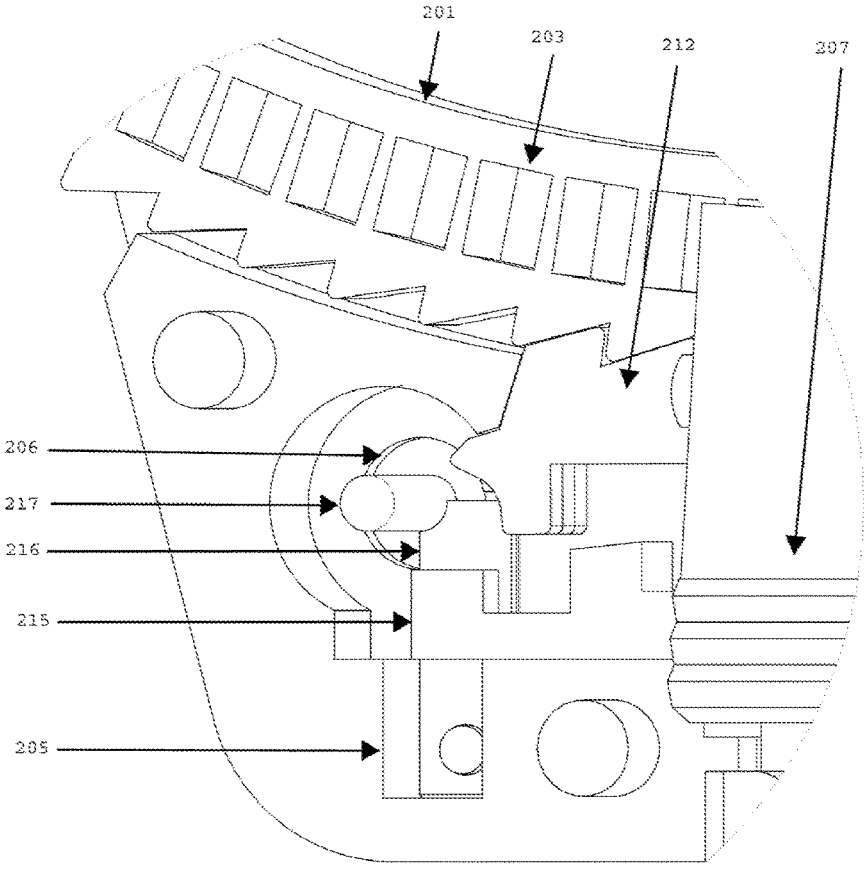
FIG. 2E is an expanded view of the double lock bar in the unlocked position.
Figure 2F:
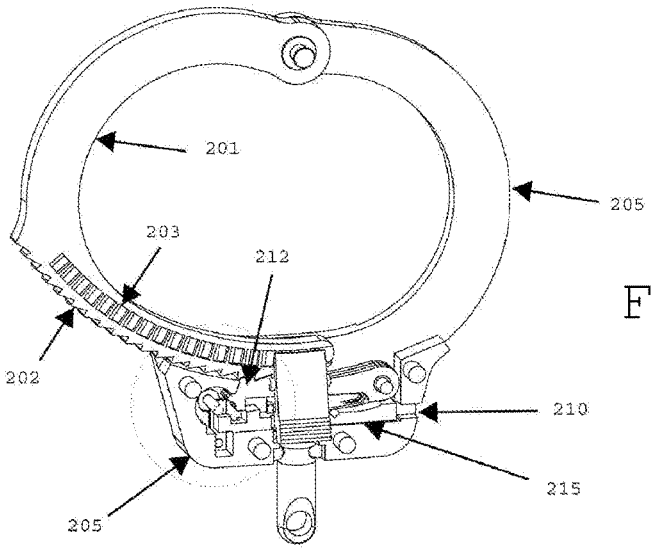
FIG. 2F further shows the double lock bar in the unlocked position.
Figure 2G:
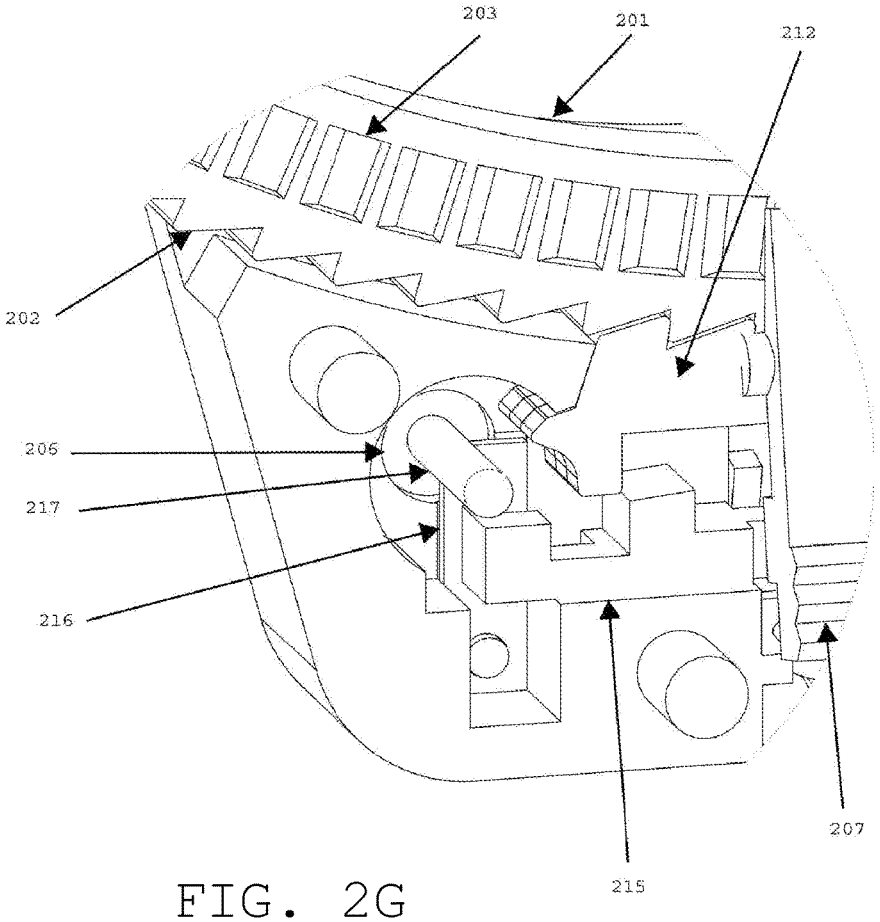
FIG. 2G illustrates an expanded view of the double lock bar in the unlocked position.
Figure 2H:
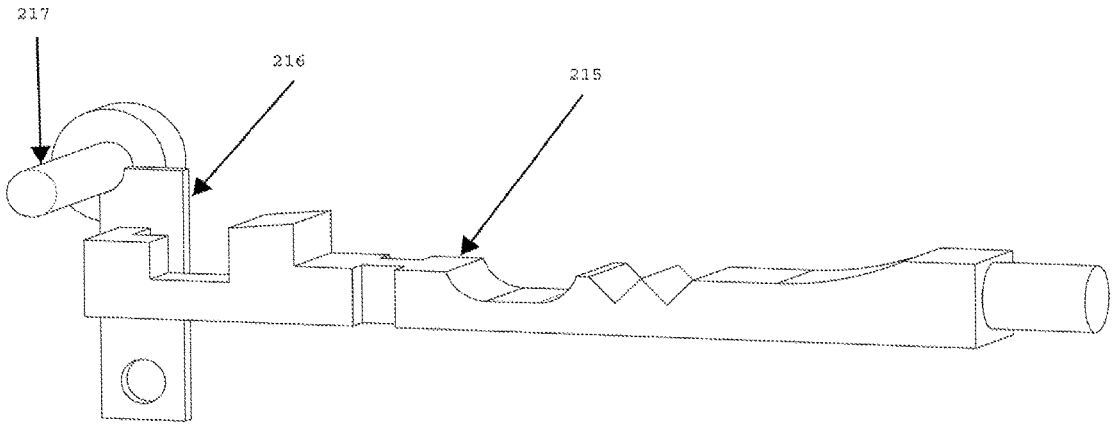
FIG. 2H shows the double lock bar and the double lock bar security spring.
Figure 2I:
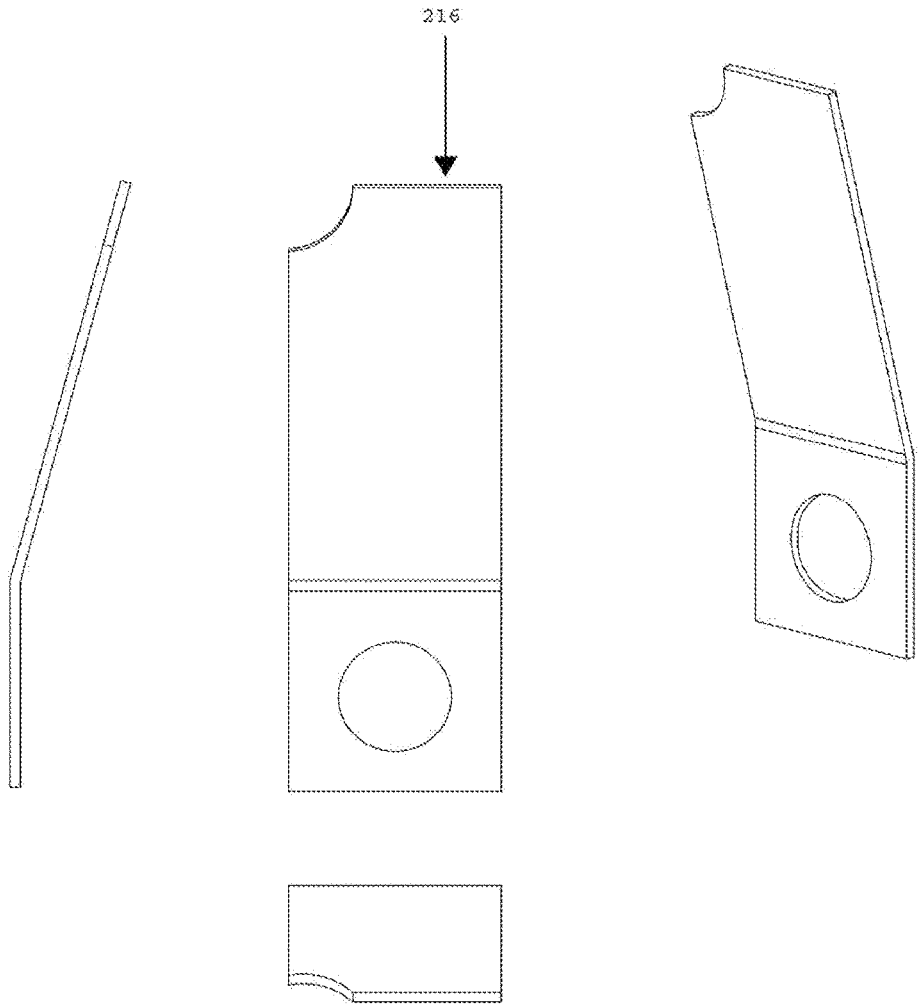
FIG. 2I shows the double lock bar security spring.
Figure 2J:
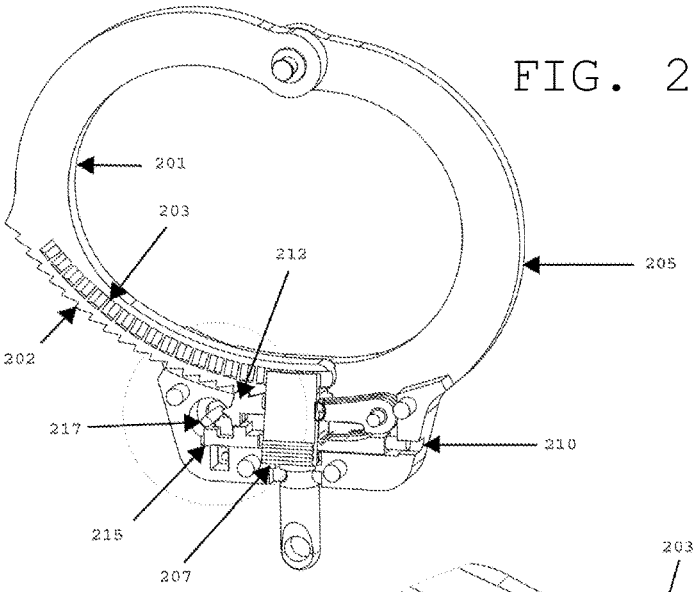
FIG. 2J shows the double lock bar security spring engaging with the double lock bar.
Figure 2K:
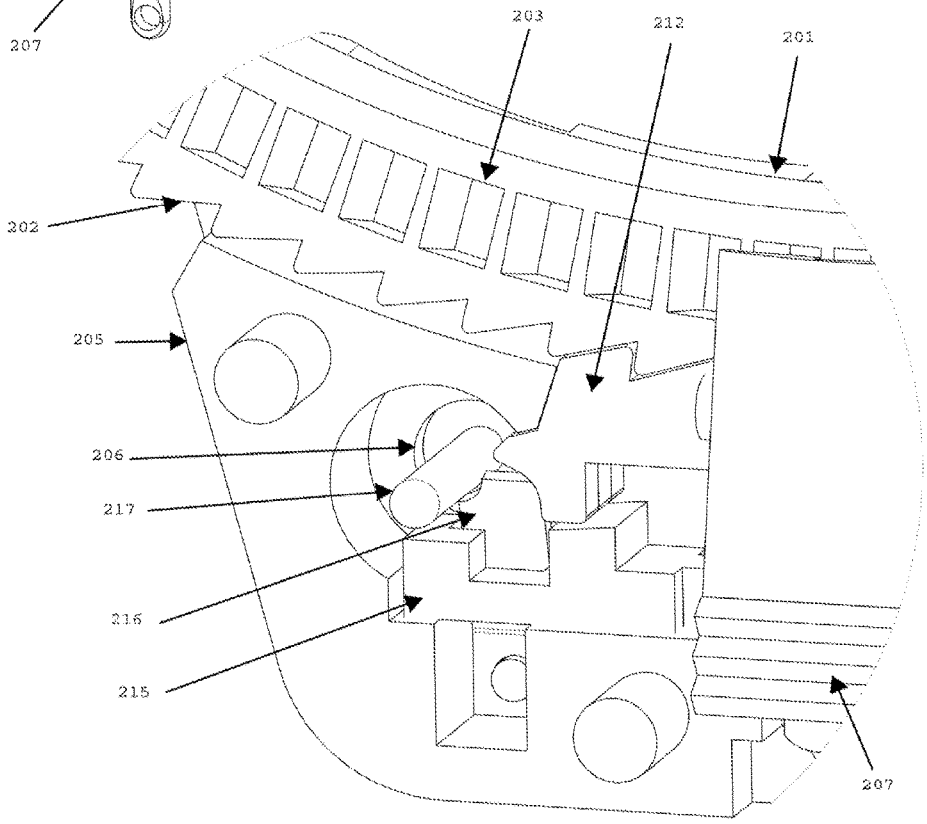
FIG. 2K is an expanded view of the double lock bar security spring engaging with the double lock bar.
Figure 2L:
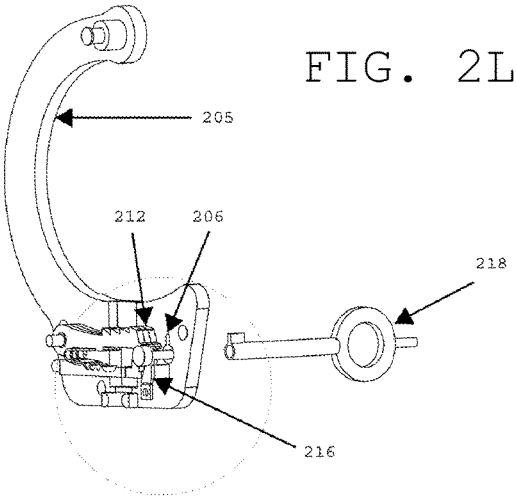
FIG. 2L shows the double lock bar security spring engaging with the double lock bar.
Figure 2M:
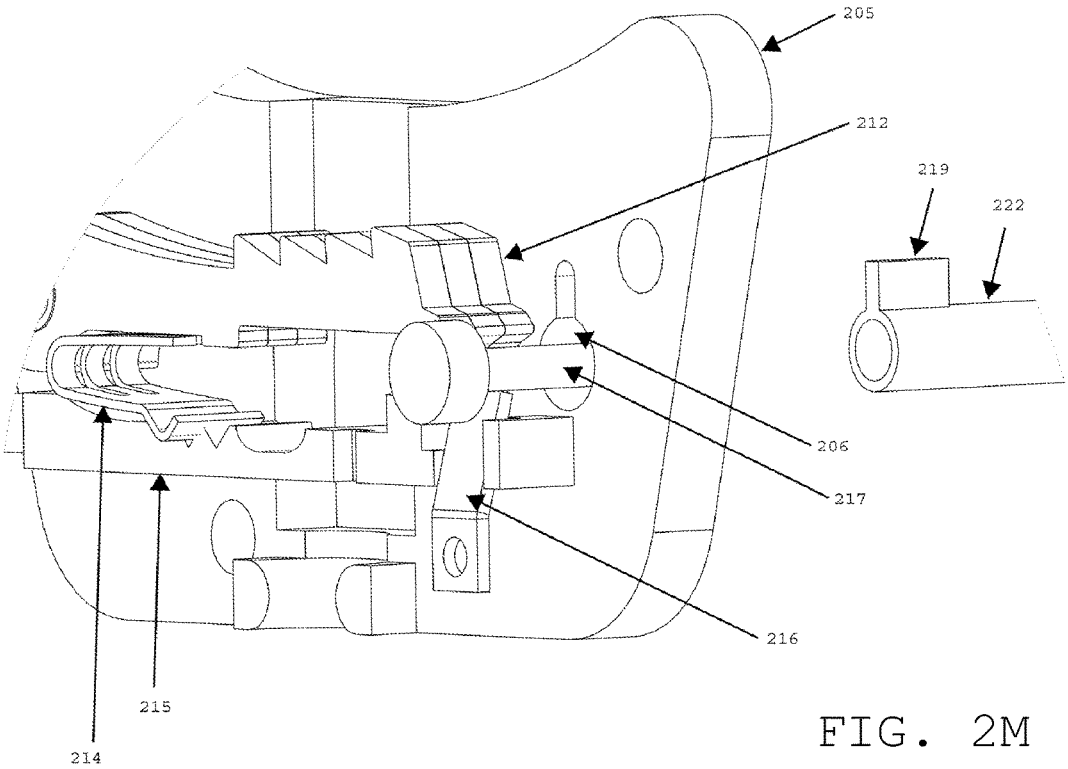
FIG. 2M is an expanded view of the double lock bar security spring engaging with the double lock bar.
Figure 2N:
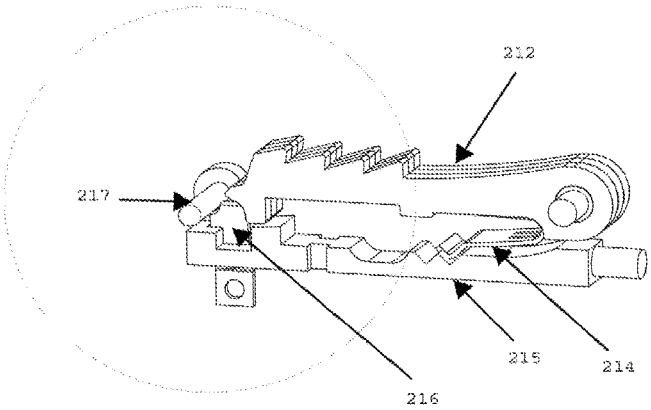
FIG. 2N shows the double lock bar security spring engaging with the double lock bar.
Figure 2O:
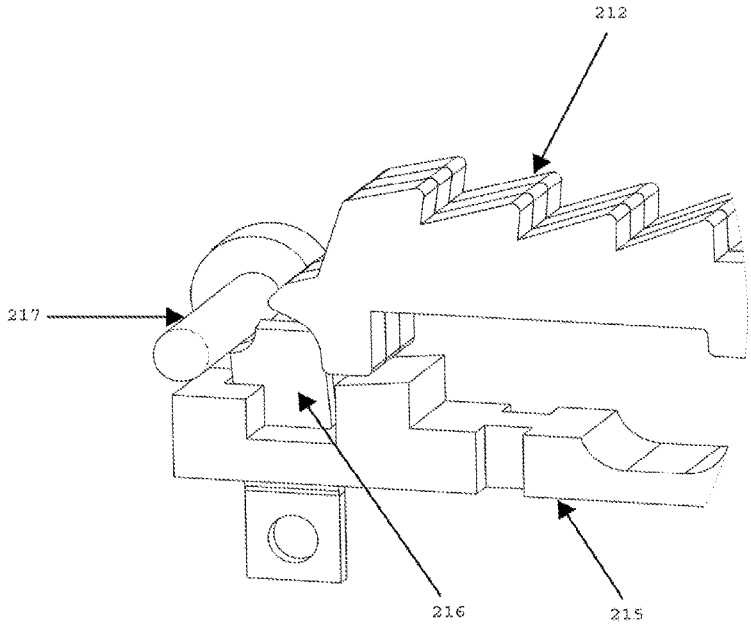
FIG. 2O is an expanded view of FIG. 2N.
Figure 2P:
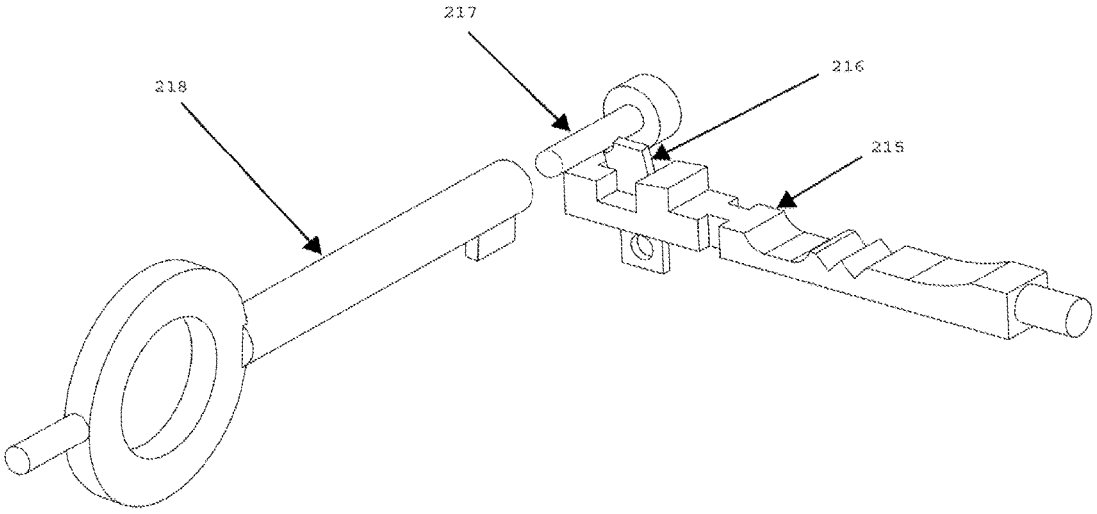
FIG. 2P shows the double lock bar security spring engaging with the double lock bar.

FIG. 2H shows the double lock bar 215 in the unlocked position with the side of the double lock bar security spring 216 being held under pressure. The double lock bar security spring 216 is shown with a scalloped corner and engaged with the lower edge of the handcuff key post 217. FIG. 2I shows the double lock bar security spring 216 configuration. A hole or other mechanism is integrated into the bottom of the double lock bar security spring 216 in order to stake or secure the spring to the interior of the handcuff. The natural state of the spring 216 without pressure is with an angled bend.

Figure 2Q:
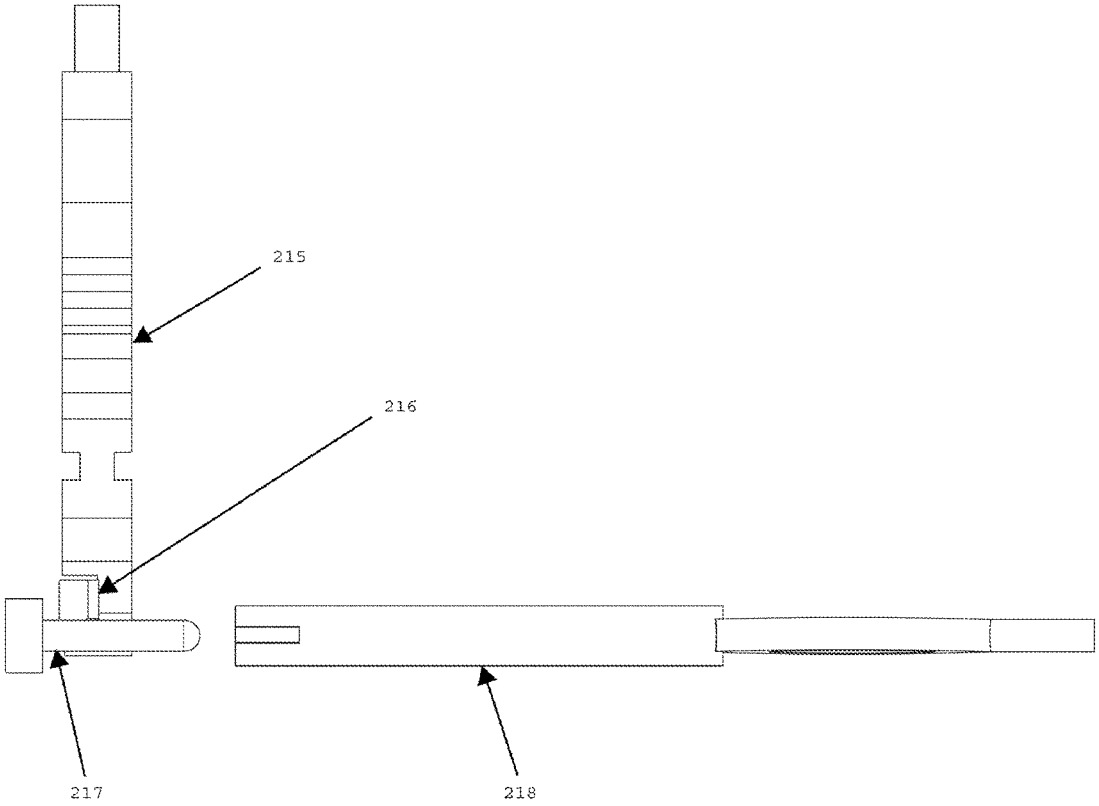
FIG. 2Q shows the top view of the double lock bar security spring engaging with the double lock bar.

FIGS. 2J to 2P show the interior of the handcuff wherein the double lock bar 215 has been activated and pushed into the locked position. When in this position, the double lock bar 215 prevents the key pawls 212 from moving downward which in turn prevents the handcuff single strand 201 from moving. When the double lock bar 215 is in the locked position, the double lock bar security spring 216 engages forward into a notch in the double lock bar 215. This engagement prevents the double lock bar 215 from moving into an unlocked position. FIG. 2Q is an overhead view of the double lock bar 215, handcuff key guidepost 217 and handcuff key 218. FIG. 2Q shows the double lock bar security spring 216 engaged into a notch in the double lock bar 215.

Figure 2R:
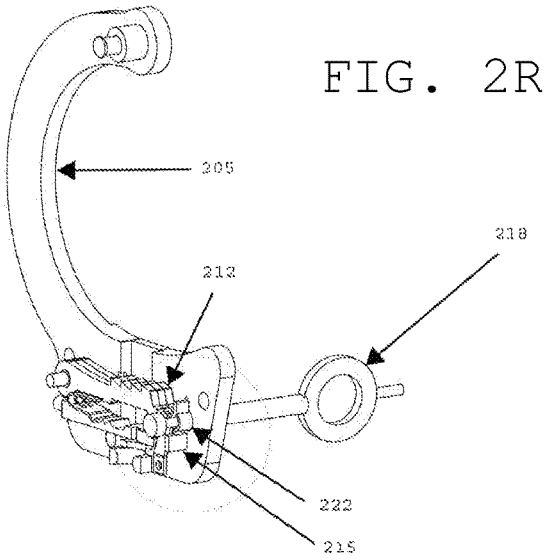
FIG. 2R shows a handcuff key inserted into the keyhole.
Figure 2S:
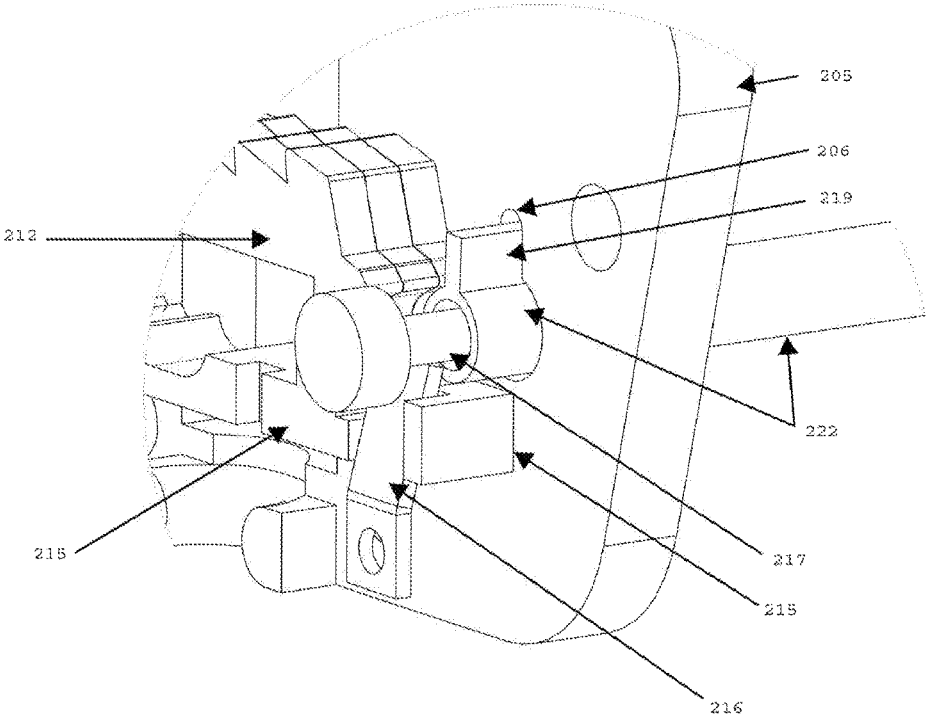
FIG. 2S is an expanded view of a handcuff key inserted into a keyhole.
Figure 2T:
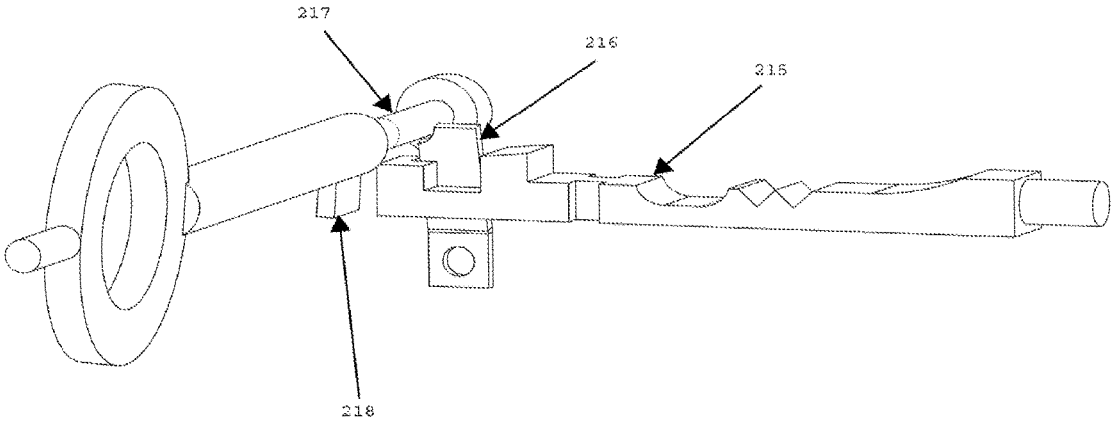
FIG. 2T shows a handcuff key engaging the handcuff key guidepost.

FIGS. 2R, 2S, and 2T show the interior of a handcuff with the double lock bar 215 in the locked position. The double lock bar security spring 216 is engaged into the notch of the double lock bar 215 thereby preventing it from being moved into the unlocked position. The universal handcuff key 218 is depicted with the handcuff key barrel 222 being inserted onto the handcuff key guidepost 217 through the handcuff keyhole 206.

Figure 2U:
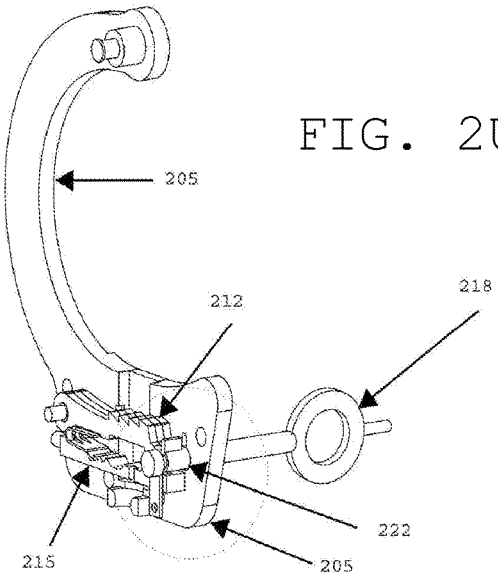
FIG. 2U shows a handcuff key depressing double lock bar security spring.
Figure 2V:
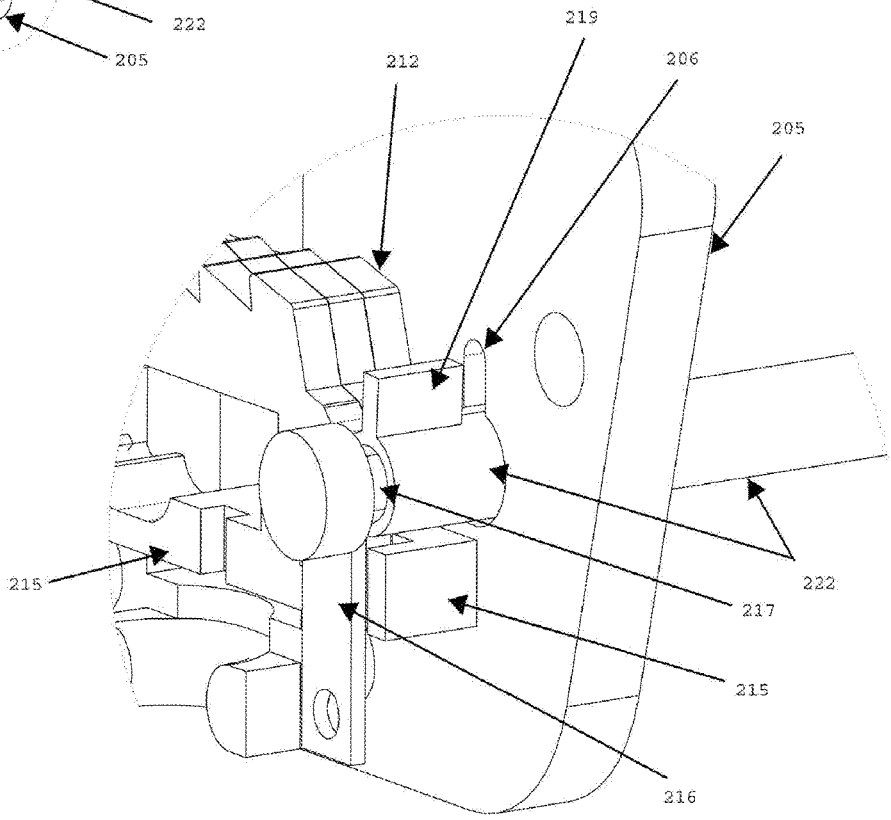
FIG. 2V is an expanded view of a handcuff key depressing double lock bar security spring.
Figure 2W:
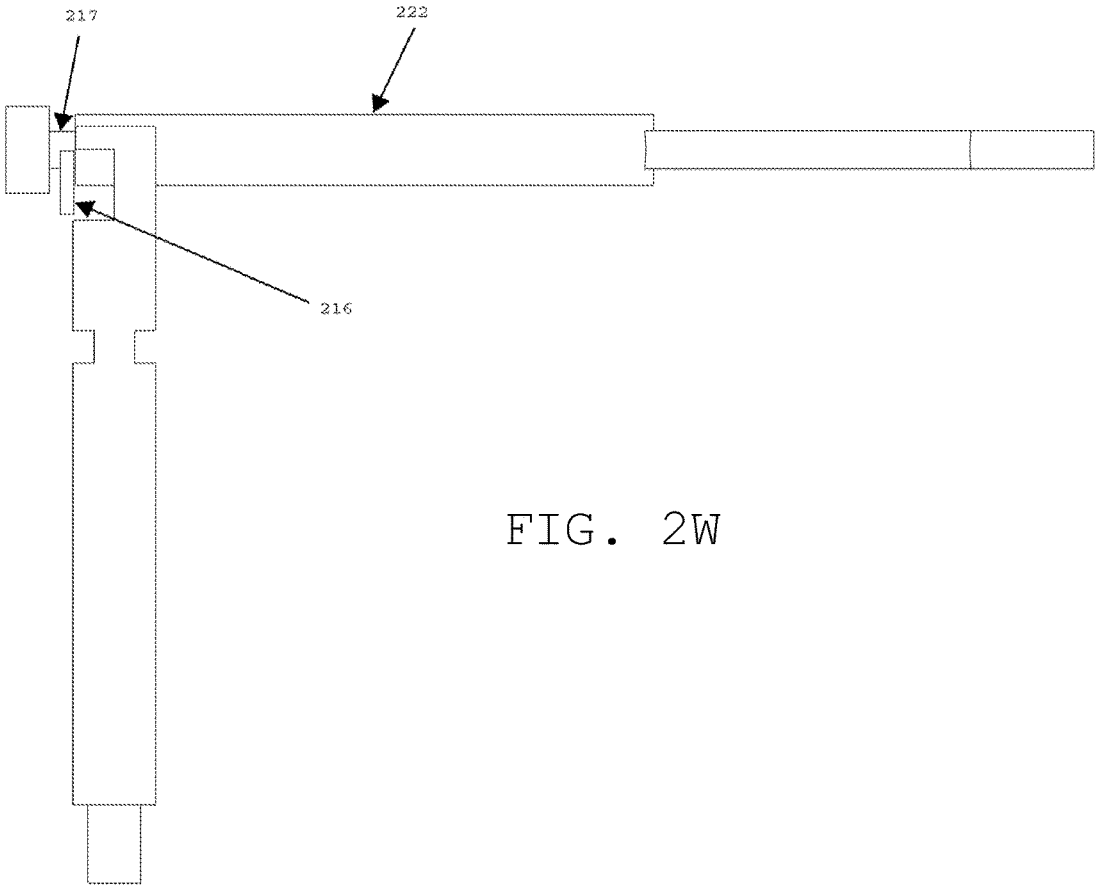
FIG. 2W shows the top view of a handcuff key depressing double lock bar security spring.

FIGS. 2U and 2V show a universal handcuff key 218 inserted into the keyhole 206 with the barrel 222 of the key enveloping the handcuff key guidepost 217. The key 218 is pushed towards the rear double strand 205 thereby depressing the double lock bar security spring 216, which disengages it from the notch of the double lock bar 215. FIG. 2W shows a view from the bottom in which the barrel 222 of the handcuff key 218 is depressing the double lock bar security spring 216.

Figure 2X:
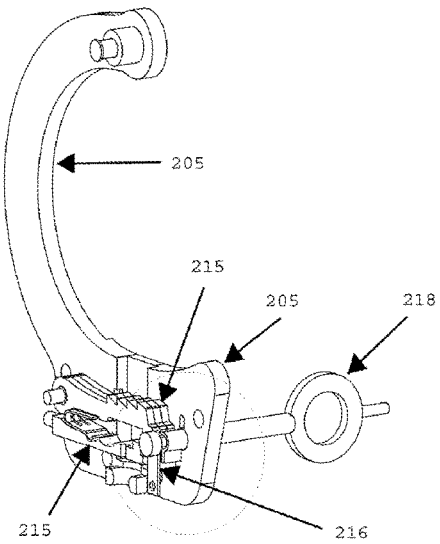
FIG. 2X shows a handcuff key depressing double lock bar security spring and pushing the double lock bar into the unlocked position.
Figure 2Y:
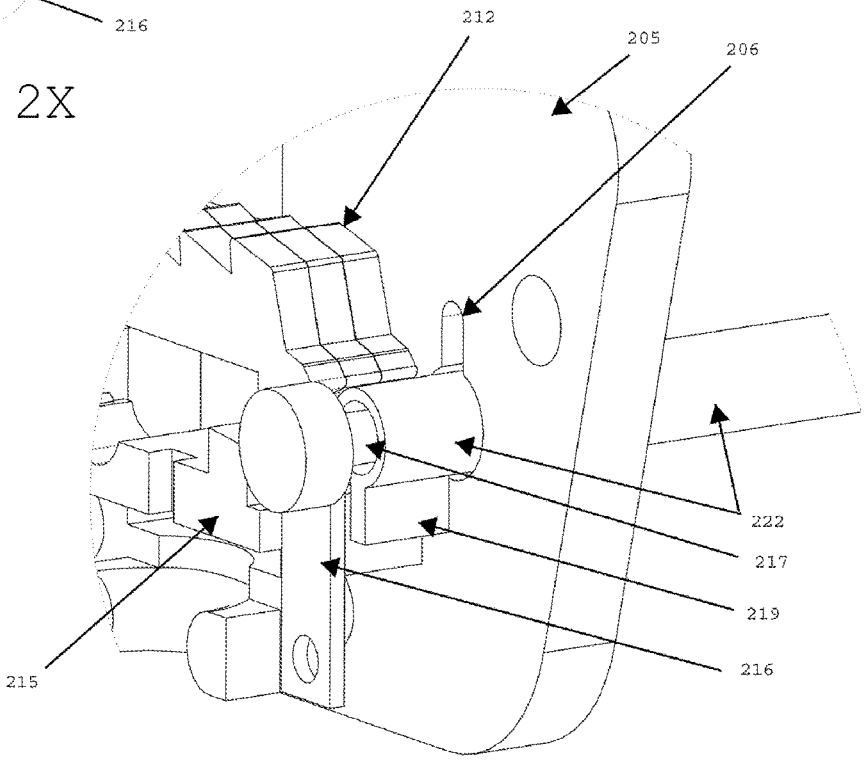
FIG. 2Y is an expanded view of FIG. 2X.
Figure 2Z:
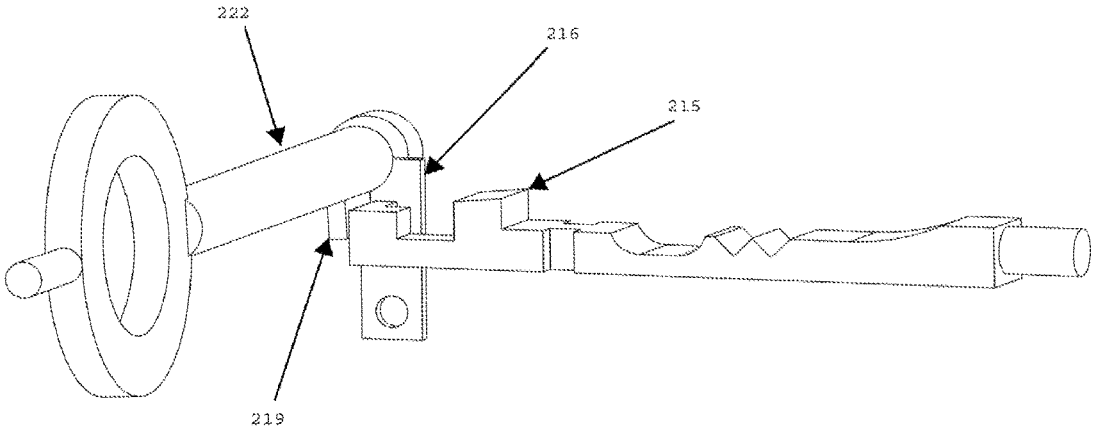
FIG. 2Z shows a handcuff key depressing double lock bar security spring and pushing the double lock bar into the unlocked position.
Figure 2A:
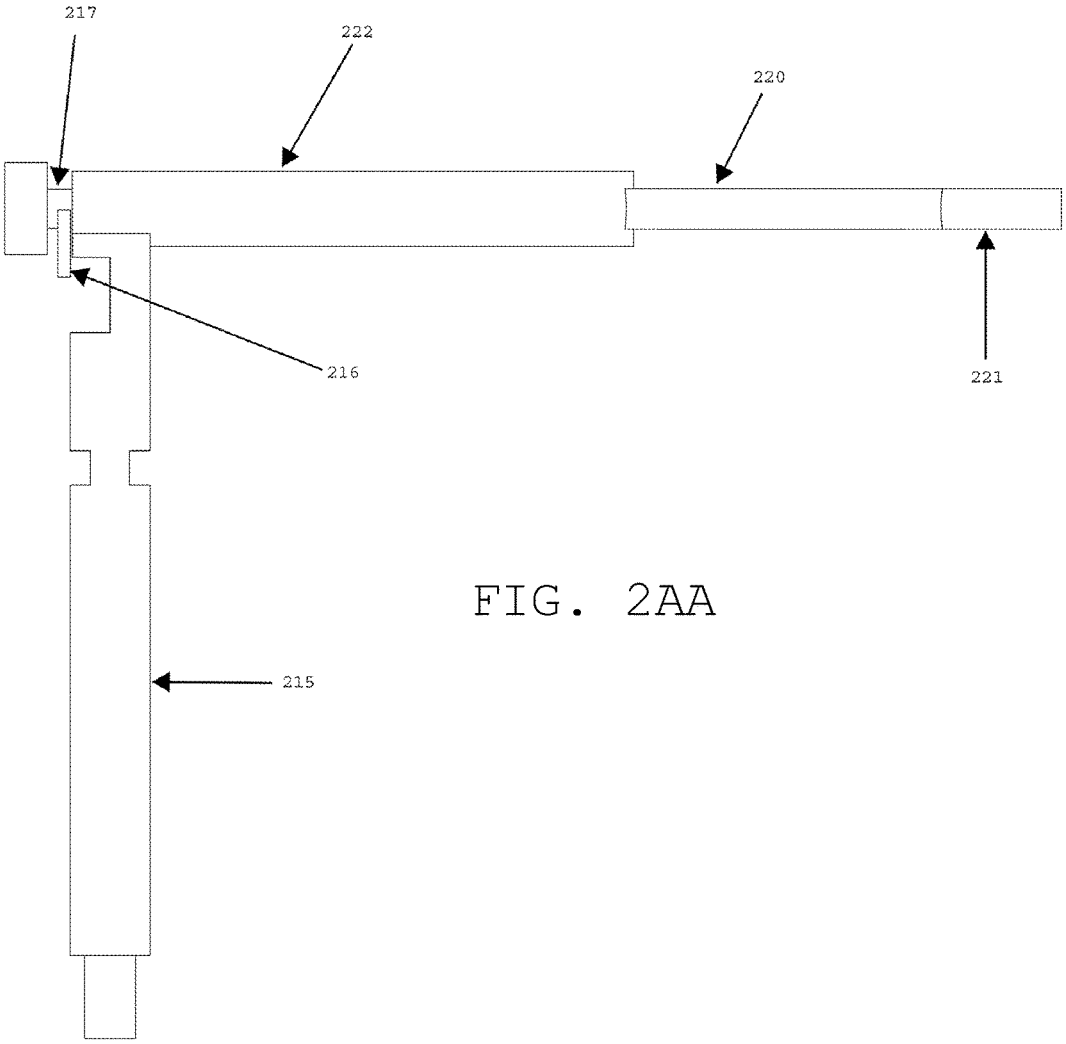
Figure 2B:
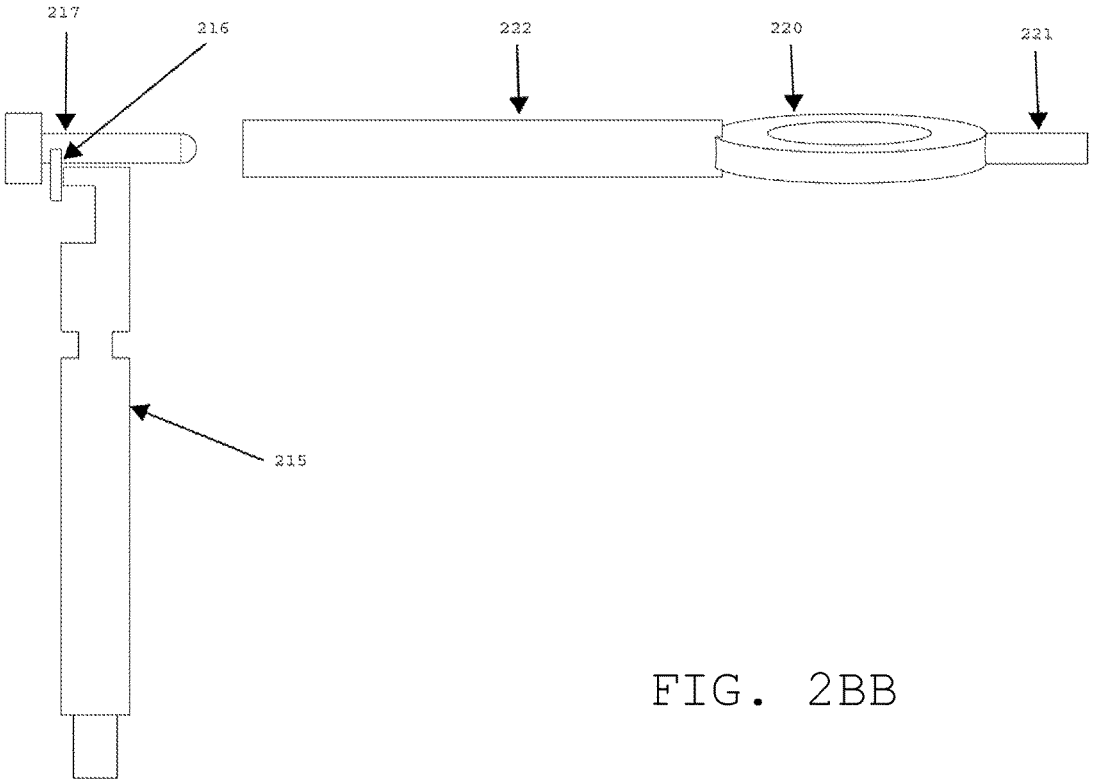

FIGS. 2X, 2Y, and 2Z show the handcuff key 218 depressing the double lock bar security spring 216. The handcuff key 218 has been turned counterclockwise, allowing the handcuff key bit 219 to engage with the side of the double lock bar 215. While the key 218 is depressing the double lock bar security spring 216, the key bit 219 is able to move the double lock bar 215 into the unlocked position. Once this occurs, the area of double lock bar 215 without the notch depresses the double lock bar security spring 216 and keeps under tension and from moving forward. FIG. 2AA shows the top of the double lock bar 215 in the unlocked position with the double lock bar security spring 216 under tension with handcuff key 218 inserted onto the handcuff key guidepost 217. FIG. 2BB illustrates the key 218 being removed from the key guidepost 217.

Figure 3A:
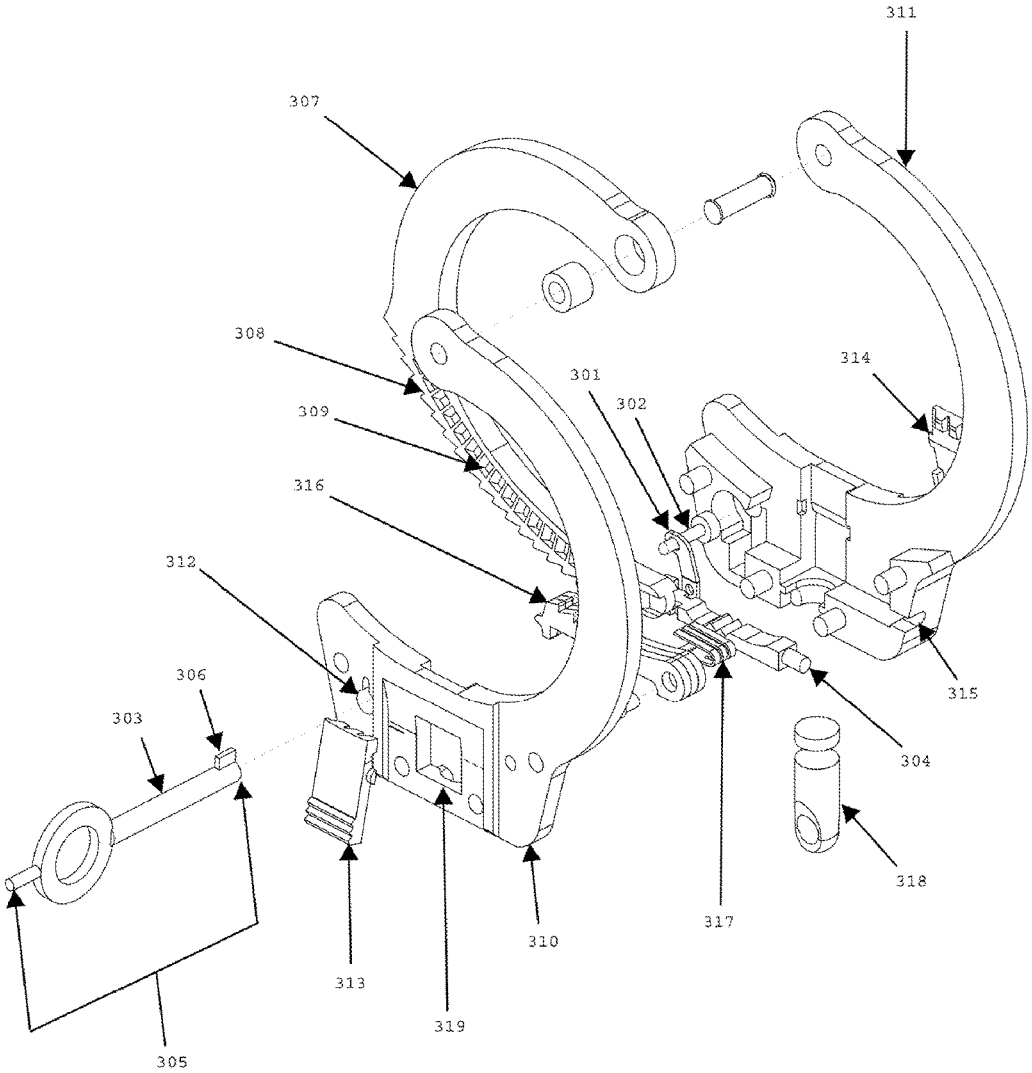
FIG. 3A illustrates an exploded view of a third embodiment.

FIG. 3A illustrates another embodiment of the design, utilizing a double lock bar security spring 301 having a circular shape on top. The circular portion of the spring 301 provides for a hole in the center. The handcuff key guidepost 302 is shown inserted into the double lock bar security spring 301. FIG. 3A also shows the handcuff key barrel 303, double lock bar 304, handcuff key 305, handcuff key bit 306, single strand 307, ratchet teeth 308, ratchet side indentations 309, front double strand 310, rear double strand 311, keyhole 312, front ratchet button 313, rear ratchet button 314, double lock bar activation hole 315, key pawls 316, pawl spring 317, swivel 318 and the front ratchet button recess 319.

Figure 3B:
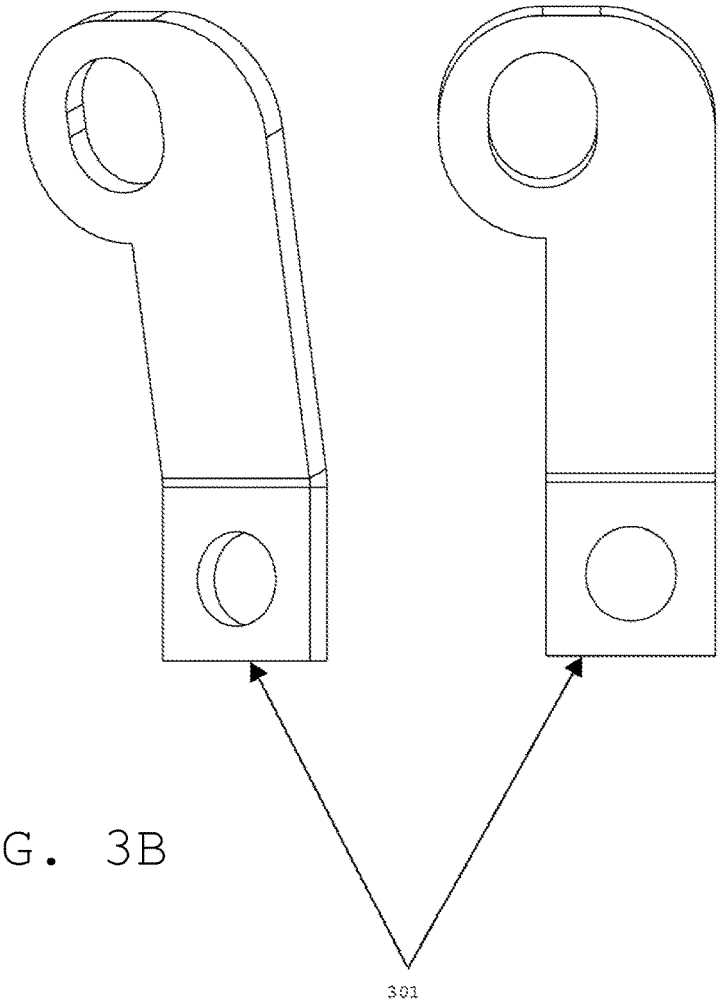
FIG. 3B shows the double lock bar security spring.

FIG. 3B shows the double lock bar security spring 301 with a circular area on top with a hole in the middle. The hole may be oval in shape to allow free movement of the handcuff key guidepost 302, but other shapes may be employed. The spring 301 in this embodiment has a forward bend to provide spring pressure onto the side of the double lock bar 304.

Figure 3E:
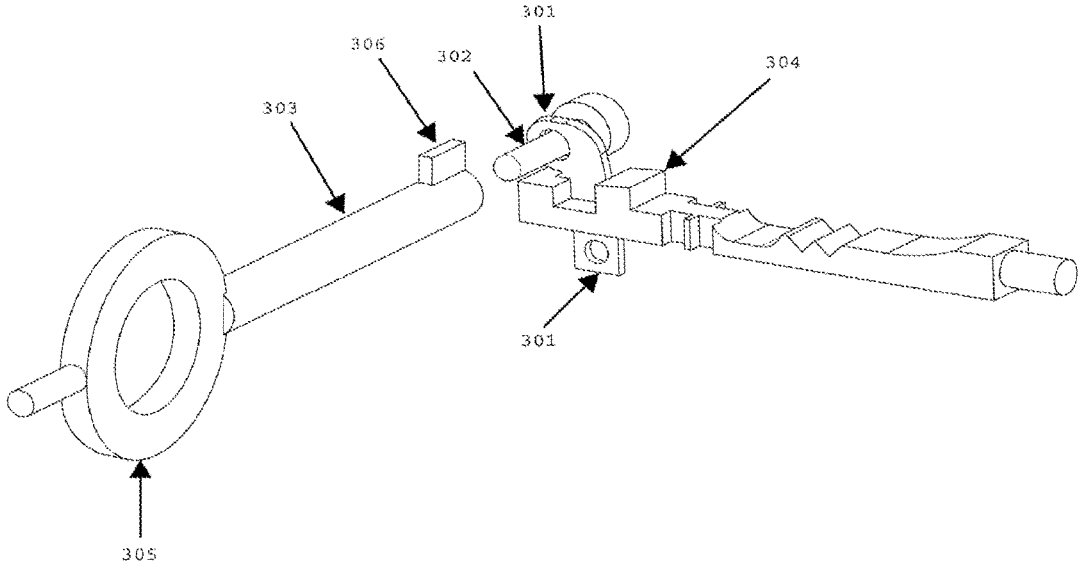
FIG. 3E shows the double lock bar in the unlocked position.
Figure 3H:
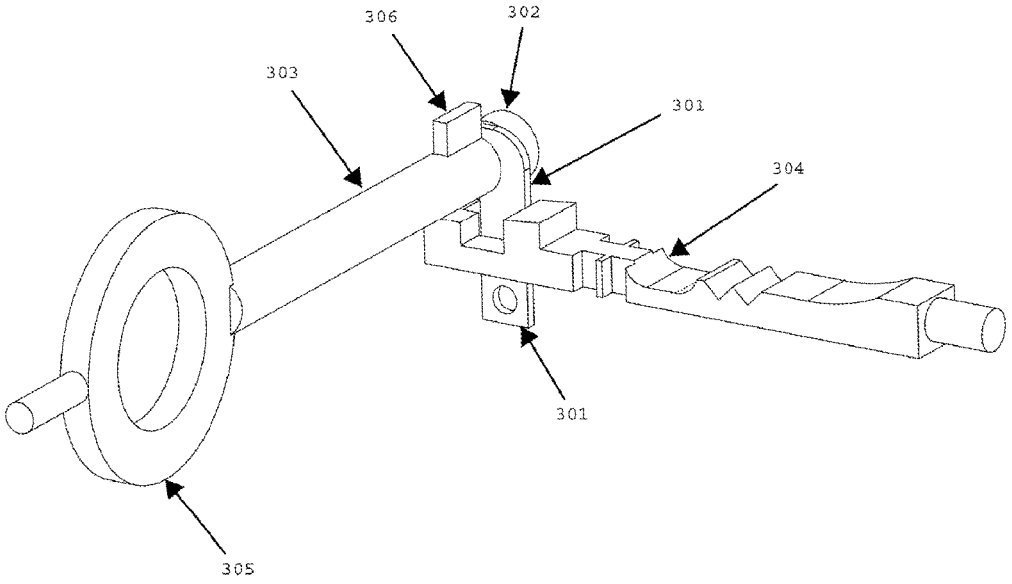
FIG. 3H shows a handcuff key depressing double lock bar security spring.
Figure 3I:
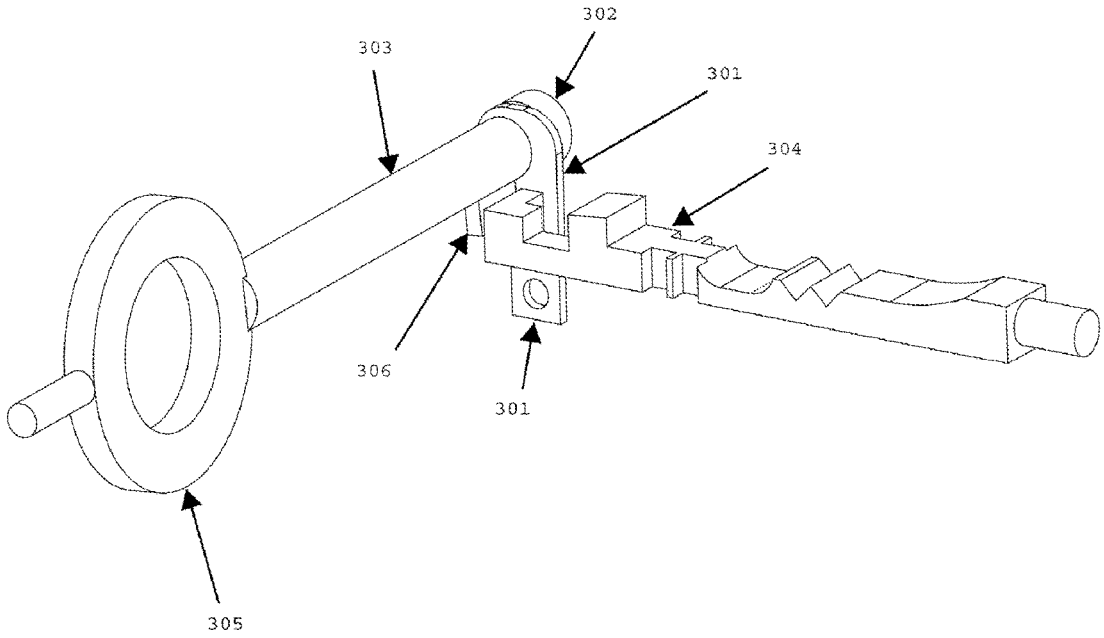
FIG. 3I shows a handcuff key depressing double lock bar security spring and pushing the double lock bar into the unlocked position.

FIGS. 3C, 3D, and 3E collectively show the handcuff with the handcuff key 305 about to be inserted into the keyhole 312 (not shown in these views). FIGS. 3F, 3G, and 3H show the handcuff key 305 inserted into keyhole 312, thereby depressing the double lock bar security spring 301 out of the engagement notch of the double lock bar 304. FIG. 3I shows the bit 306 of the handcuff key 305 being turned counter clockwise so the bit 306 engages the side of the double lock bar 304. As long as the handcuff key barrel 303 is depressing the double lock bar security spring 301, the handcuff key bit 306 can be used to move the double lock bar 304.

Figure 3J:
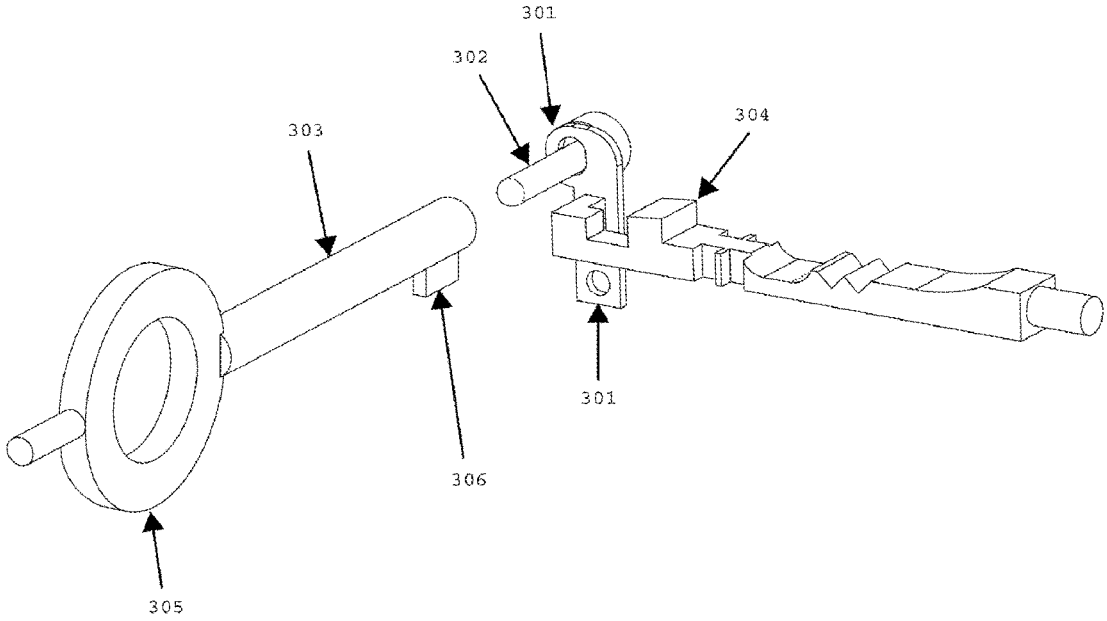
FIG. 3J shows the top view of the unlocked double lock bar holding the double lock bar security spring.
Figure 3K:
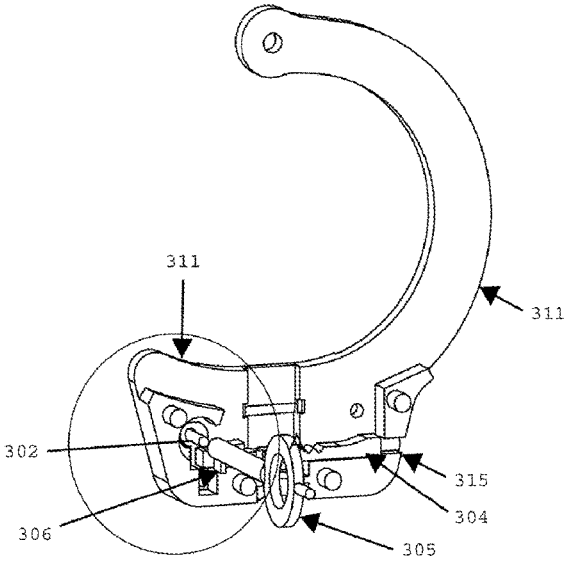
FIG. 3K shows the top view of the unlocked double lock bar holding the double lock bar security spring.
Figure 3L:
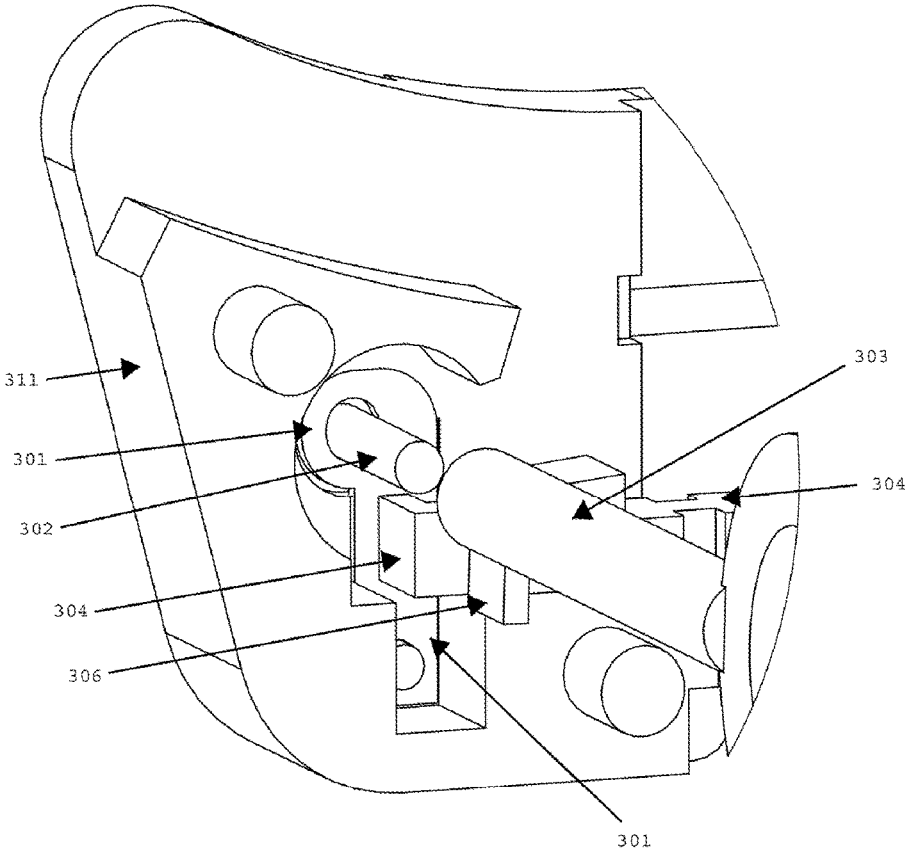
FIG. 3L is an expanded view of the unlocked double lock bar holding the double lock bar security spring.

FIGS. 3J, 3K, and 3L collectively show the double lock bar 304 in the unlocked position, which holds the double lock bar security spring 301 out of the notch of the double lock bar 304.

Figure 4A:
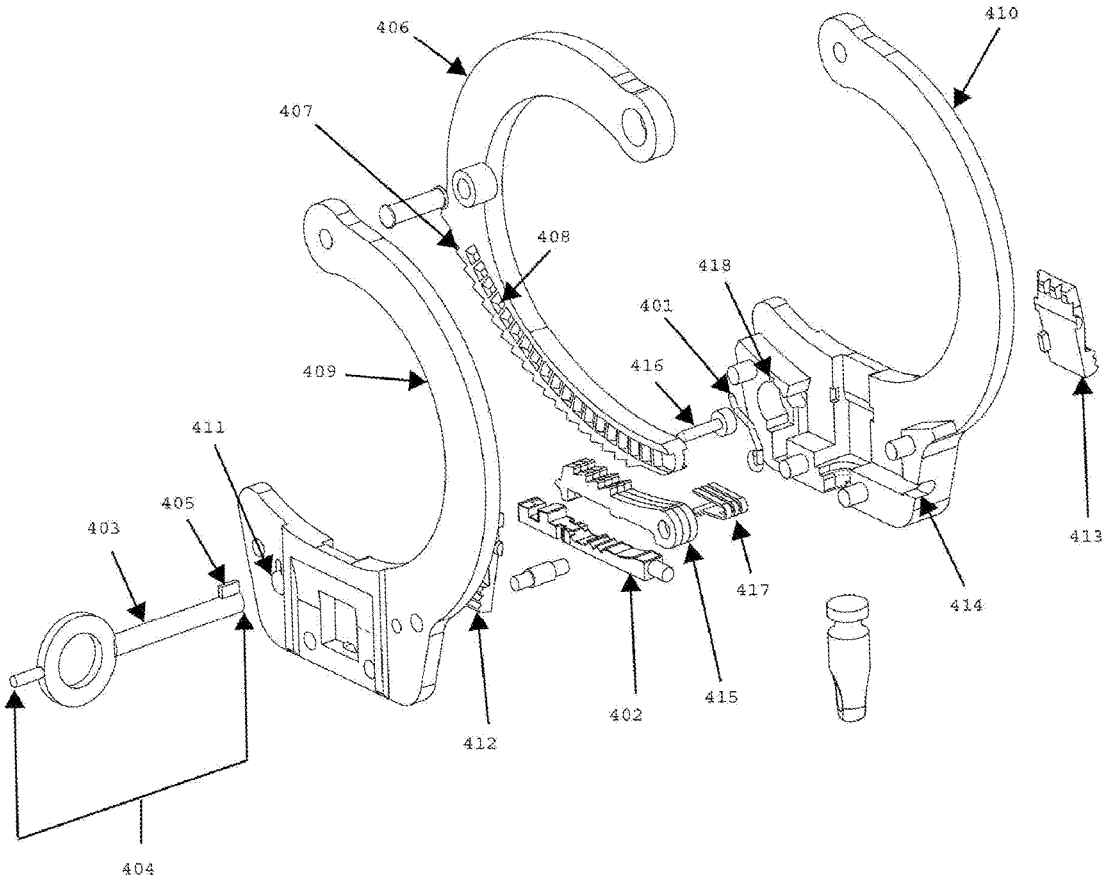
FIG. 4A illustrates an exploded view of a fourth embodiment.

FIG. 4A illustrates a further embodiment of the design that utilizes a rounded spring instead of a flat spring for the double lock bar security spring 401. The rounded spring provides a smaller and rounded surface area that may be depressed in order for the spring 401 to be disengaged from the double lock bar 402. Such a construction helps prevent locking and other countermeasures utilized by suspect attempting to unlock the handcuffs. The rounded double lock bar security spring 401 allows for a lock pick to slip off the rounded spring area 401 unless the lock pick is large and flat in shape and continuously depressed downward, adding a level of security to the handcuffs.

FIG. 4A also shows the handcuff key barrel 403, handcuff key 404, handcuff key bit 405, single strand 406, ratchet teeth 407, ratchet side indentations 408, front double strand 409, rear double strand 410, keyhole 411, front ratchet button 412, rear ratchet button 413, double lock bar activation hole 414, key pawls 415, handcuff key guidepost 416, pawl spring 417 and double lock bar security spring notch 418.

FIG. 4A shows the double lock bar security spring 401 as having a small bend. The bend provides the ability for the spring to be perpendicular to the double lock bar 402 and have a bend to engage a flat area of the handcuff key guidepost 416. The top end of the double lock bar security spring 401 continues past the handcuff key guidepost 416 and into the double lock bar security spring notch 418. The notch 418 enables the end of the spring 401 to move upward and/or downward as the double lock bar security spring 401 is depressed by the barrel 403 of the handcuff key 404. The bottom of the double lock bar security spring 401 may be secured to the bottom of the rear double strand 410.

Figure 4B:
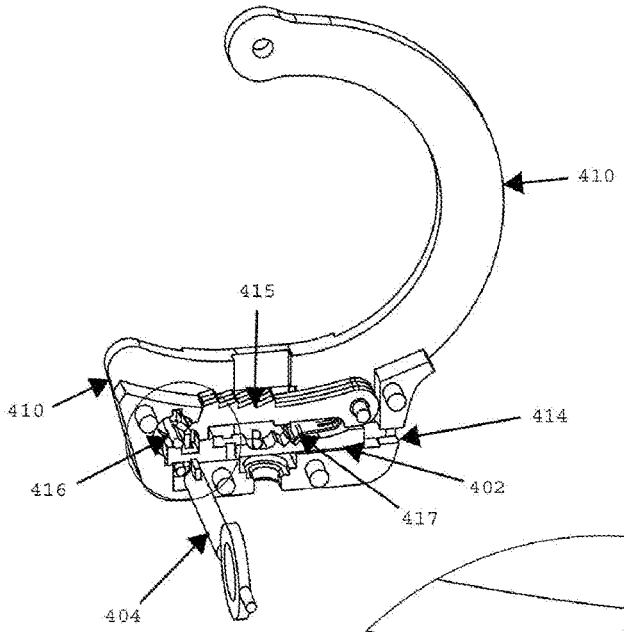
FIG. 4B shows the double lock bar security spring engaging the double lock bar.
Figure 4C:
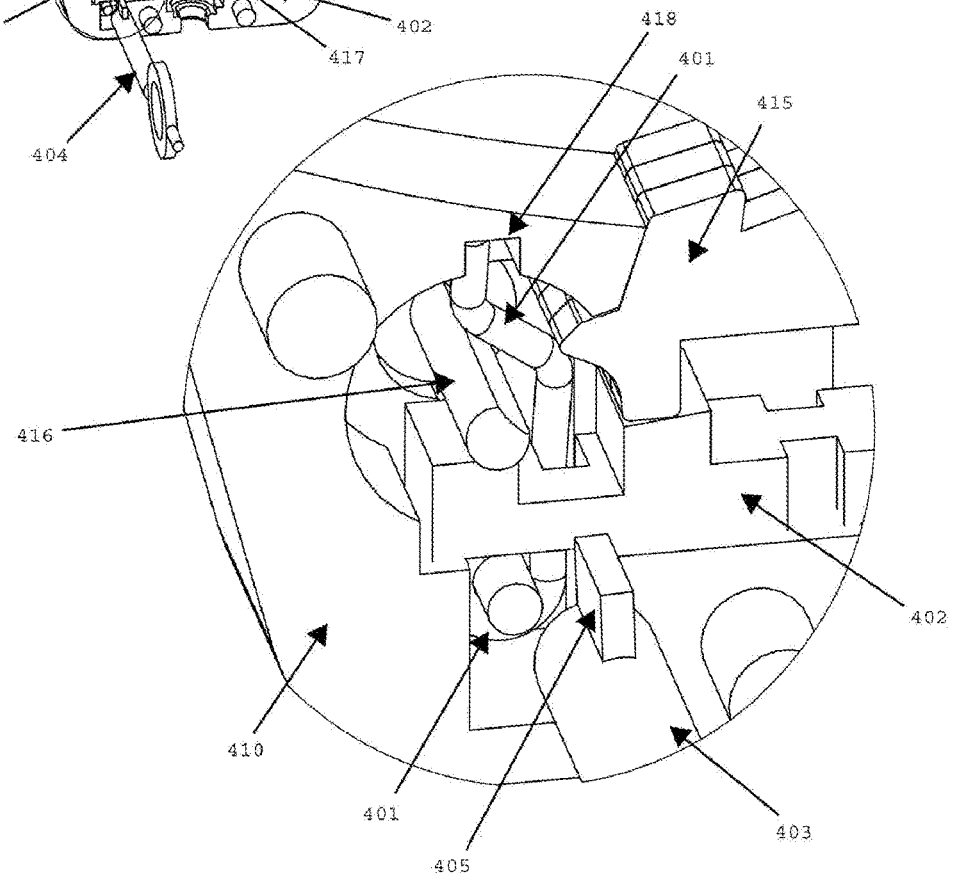
FIG. 4C is an expanded view showing the double lock bar security spring engaging the double lock bar.
Figure 4D:
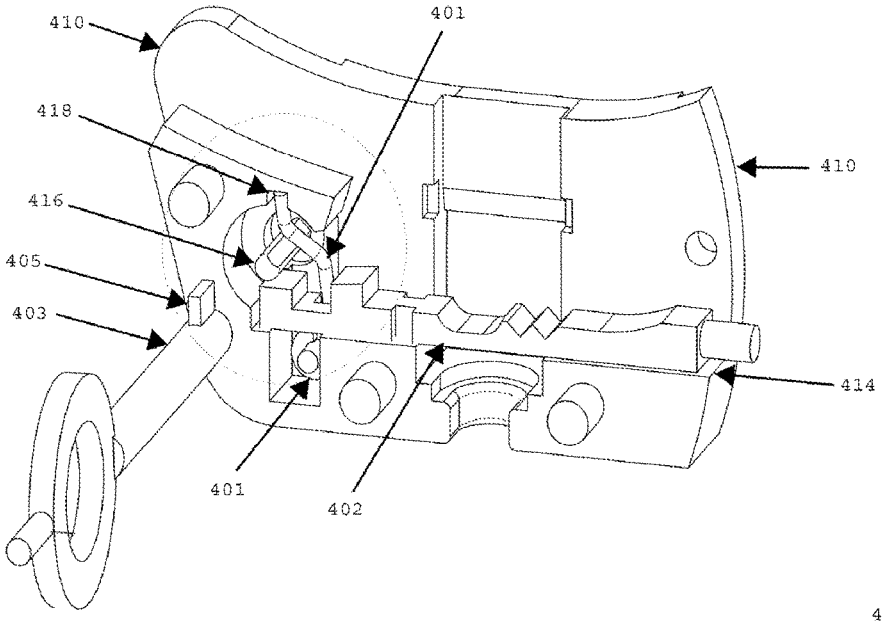
FIG. 4D shows the double lock bar security spring engaging the double lock bar.
Figure 4E:
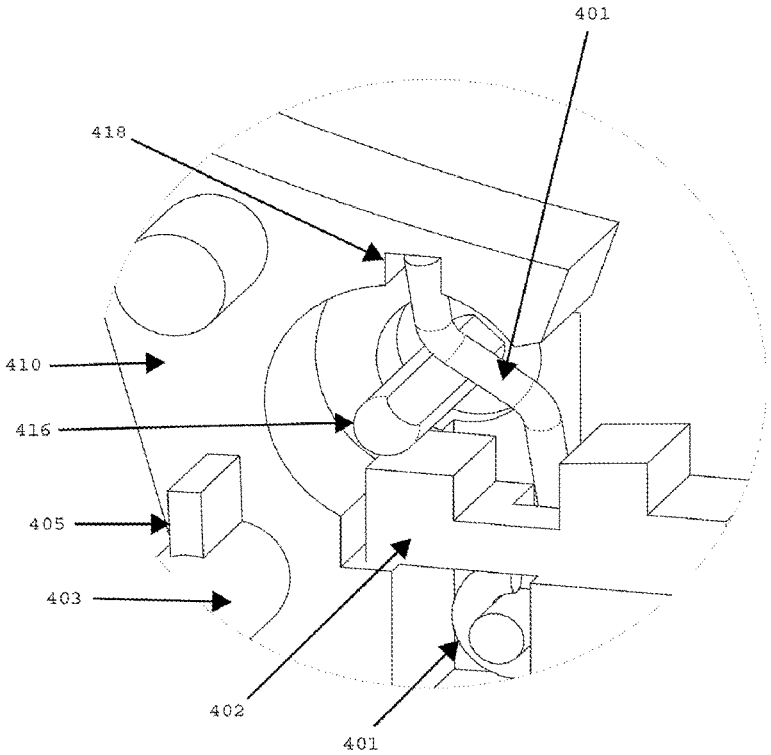
FIG. 4E is an expanded view of the double lock bar security spring engaging the double lock bar.
Figure 4F:
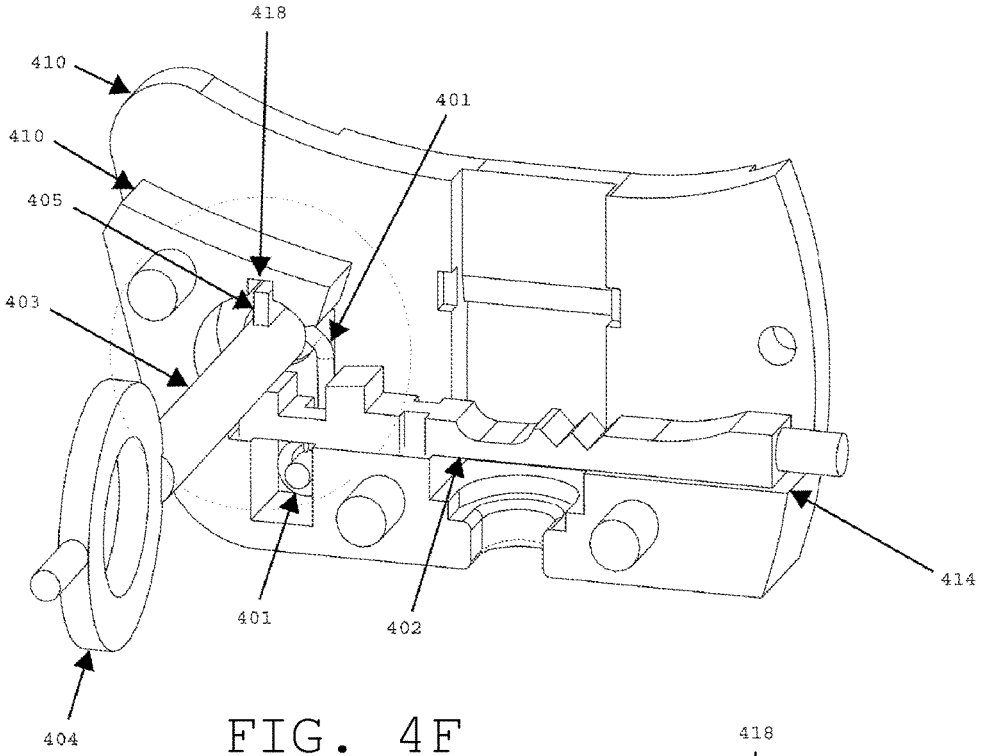
FIG. 4F shows a handcuff key depressing double lock bar security spring.
Figure 4G:
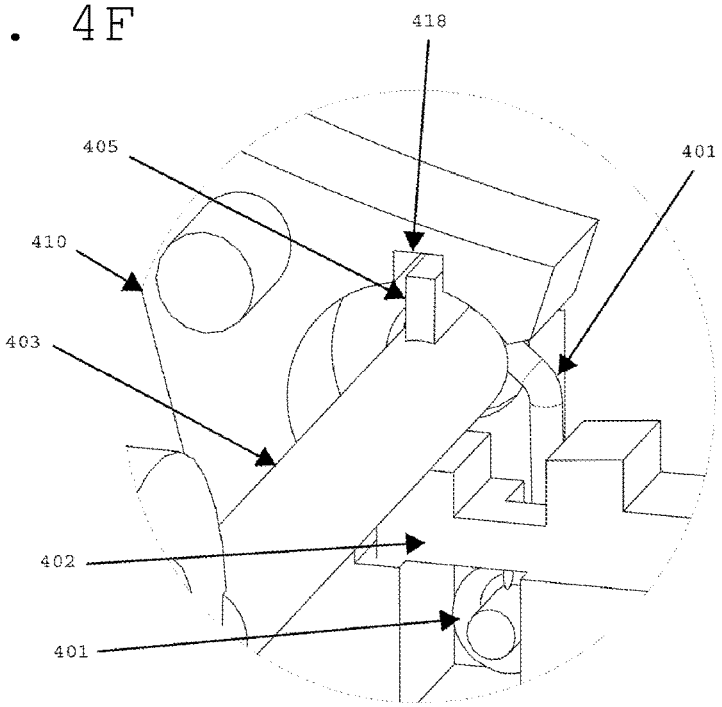
FIG. 4G is an expanded view of FIG. 4F.
Figure 4H:
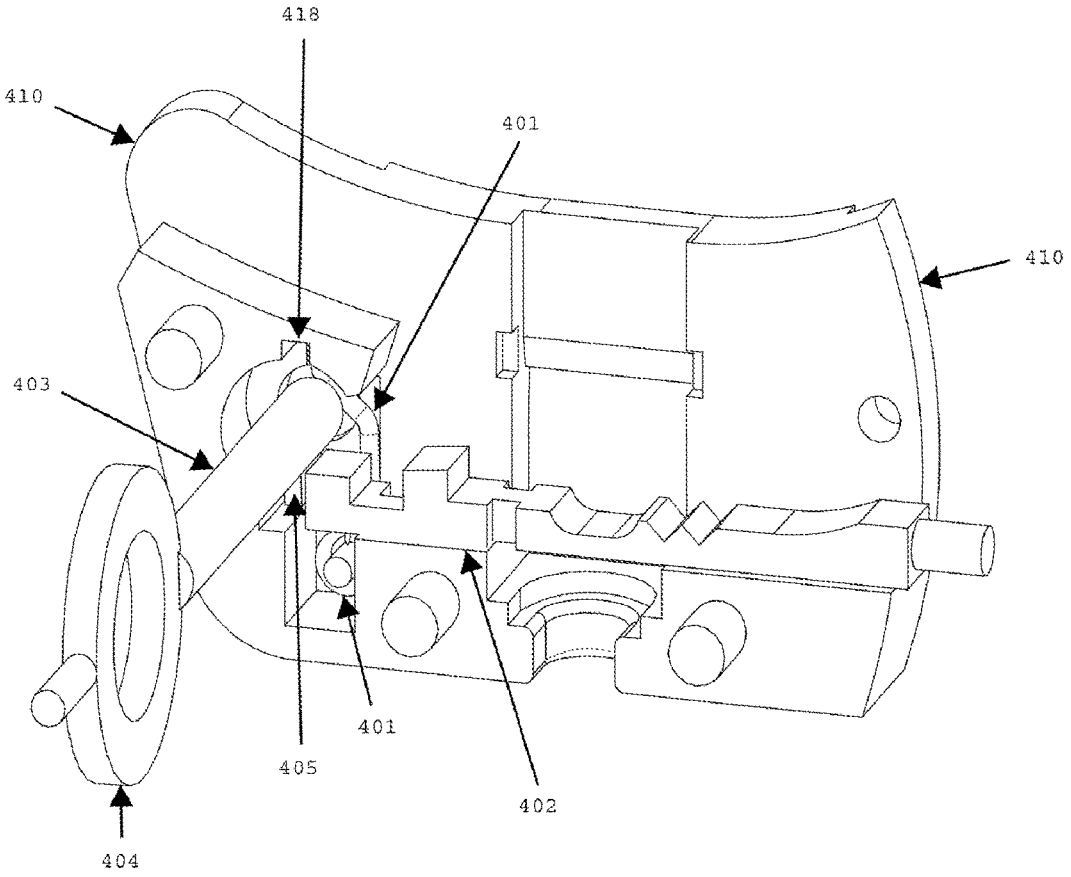
FIG. 4H illustrates a handcuff key depressing double lock bar security spring and pushing the double lock bar into the unlocked position.
Figure 4I:
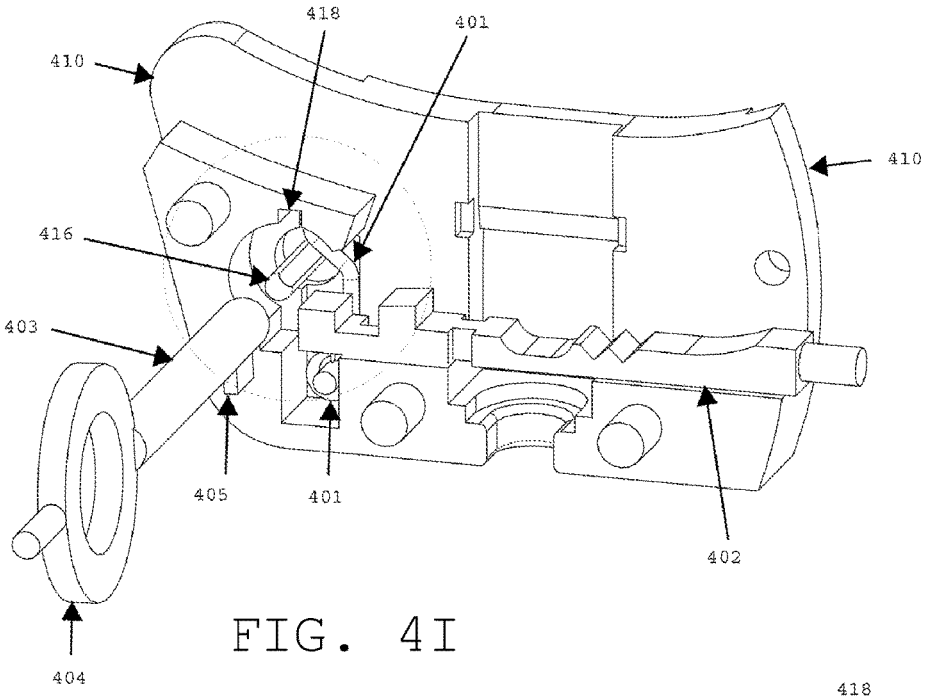
FIG. 4I shows the unlocked double lock bar holding the double lock bar security spring.
Figure 4J:
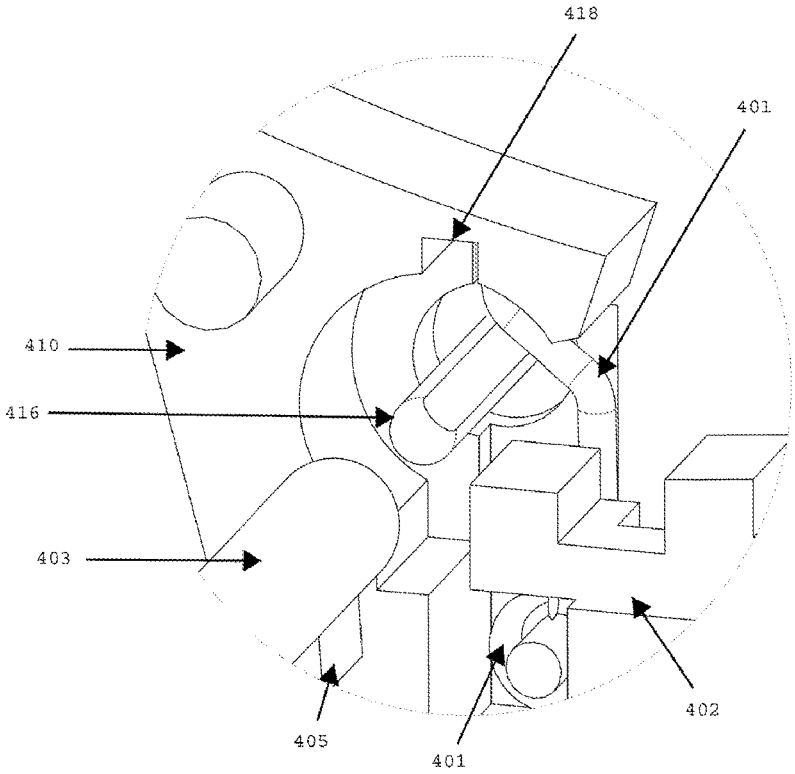
FIG. 4J is an expanded view showing the unlocked double lock bar holding the double lock bar security spring.

FIGS. 4B, 4C, 4D, and 4E show the double lock bar 402 in the locked position. The double lock bar security spring 401 is engaged in the notch of the double lock bar 402. The double lock bar security spring 401 prevents the double lock bar 402 from being unlocked unless the double lock bar security spring 401 is depressed simultaneously. FIGS. 4F and 4G show the handcuff key 404 inserted and depressing the double lock bar security spring 401 so the spring is no longer engaged in the notch of the double lock bar 402. FIG. 4H shows the handcuff key 404 turning counter clockwise and the key bit 405 pushing the double lock bar 402 into the unlocked position. FIGS. 4I and 4J show the double lock bar 402 in the unlocked position, holding the double lock bar security spring 401 out of the notch of the double lock bar 402.

Figure 4K:
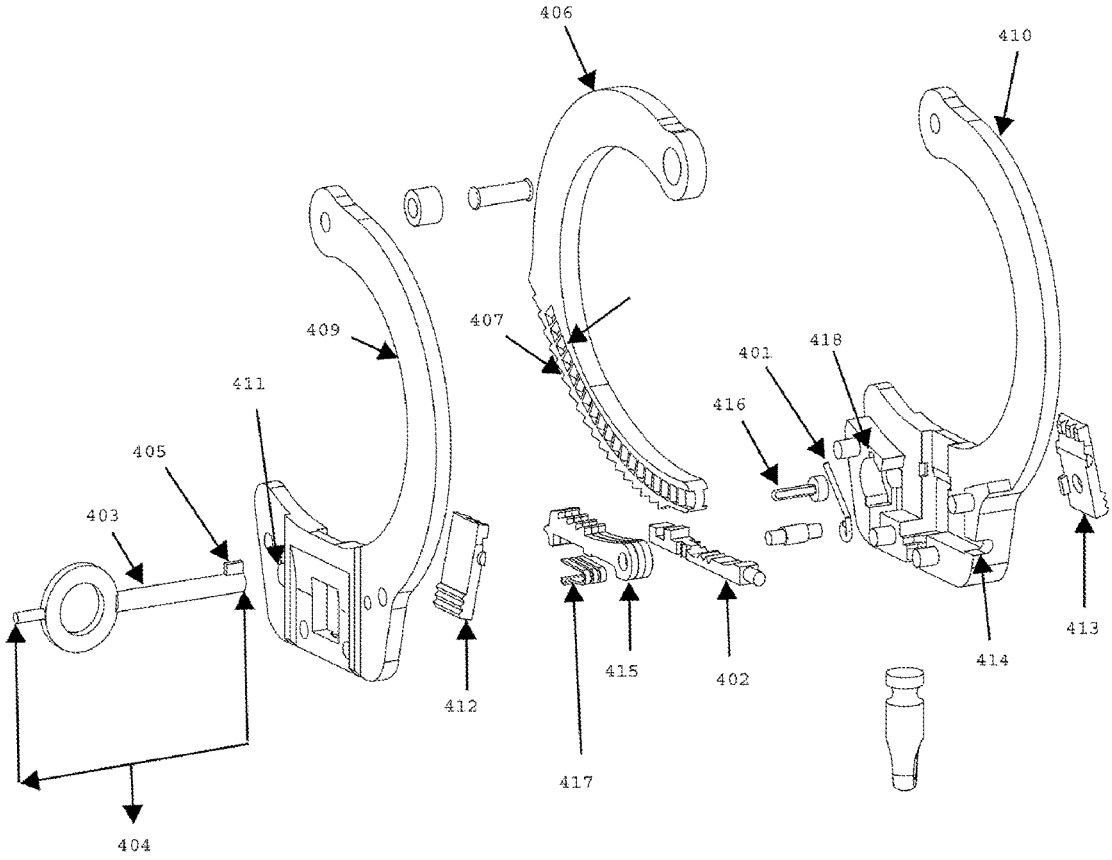
FIG. 4K is an exploded view of an alternative version of the third embodiment.
Figure 4M:
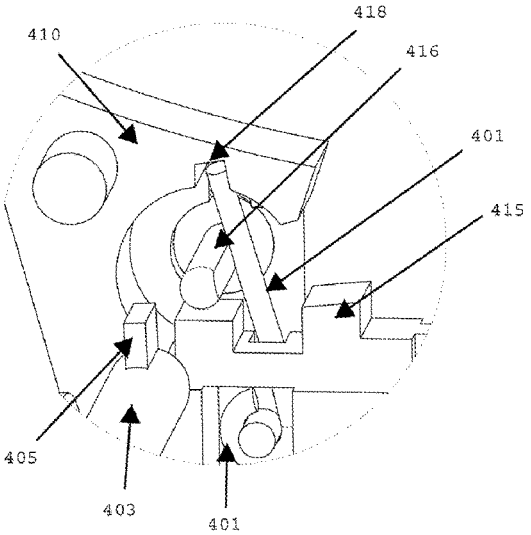
FIG. 4M illustrates and expanded view of the double lock bar security spring engaging the double lock bar.
Figure 4L:
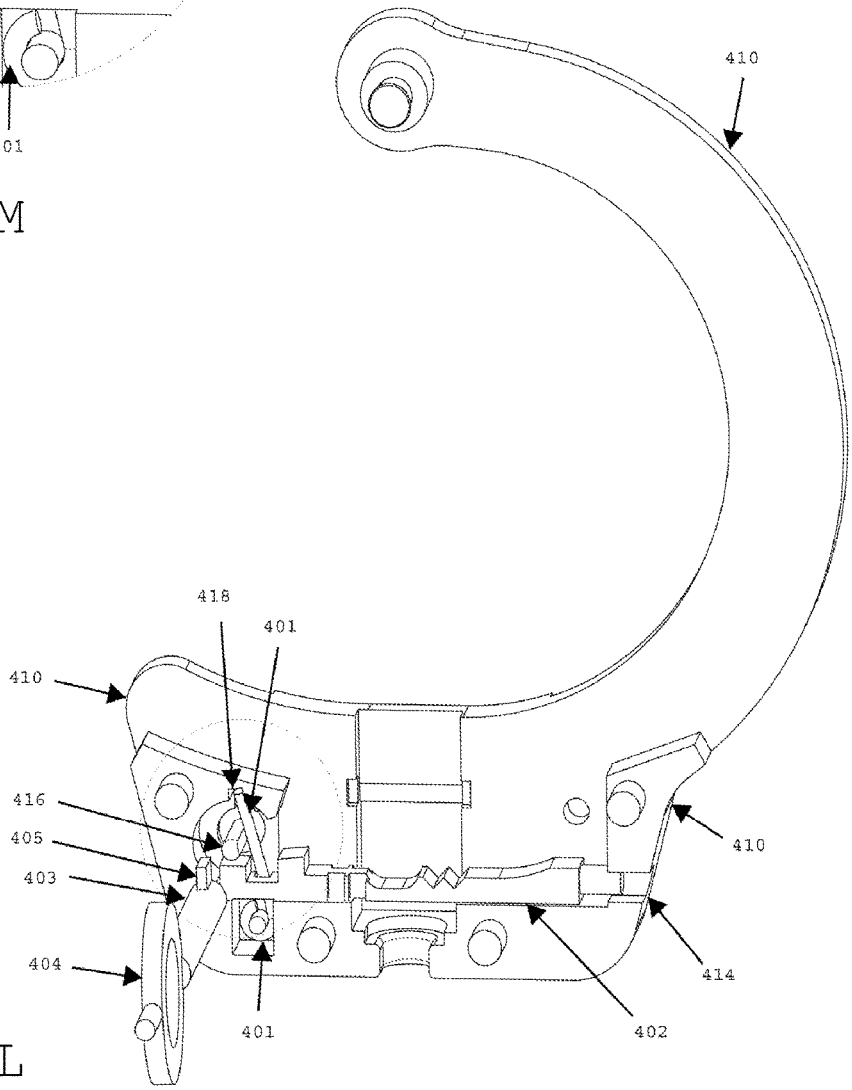
FIG. 4L shows the double lock bar security spring engaging the double lock bar.
Figure 4P:
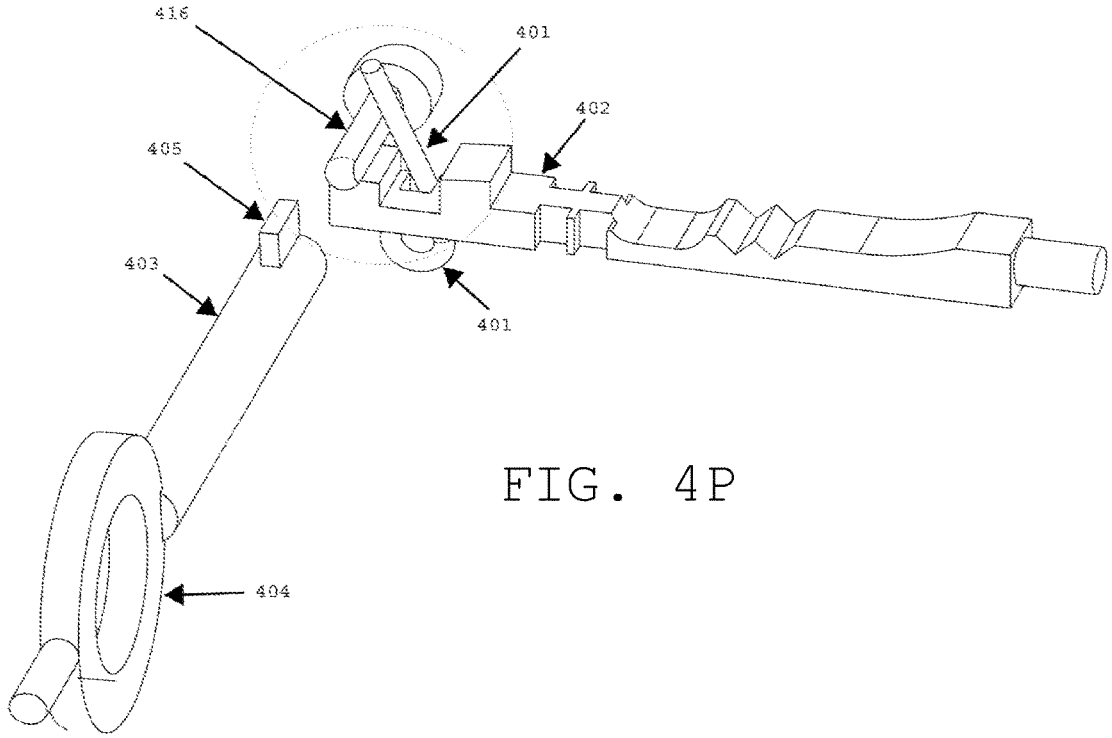
FIG. 4P shows the double lock bar security spring engaging the double lock bar.
Figure 4Q:
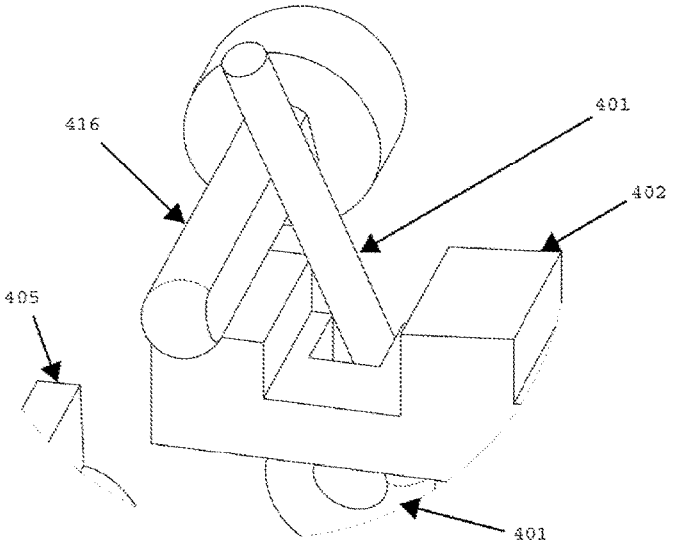
FIG. 4Q is an expanded view of the double lock bar security spring engaging the double lock bar.
Figure 4R:
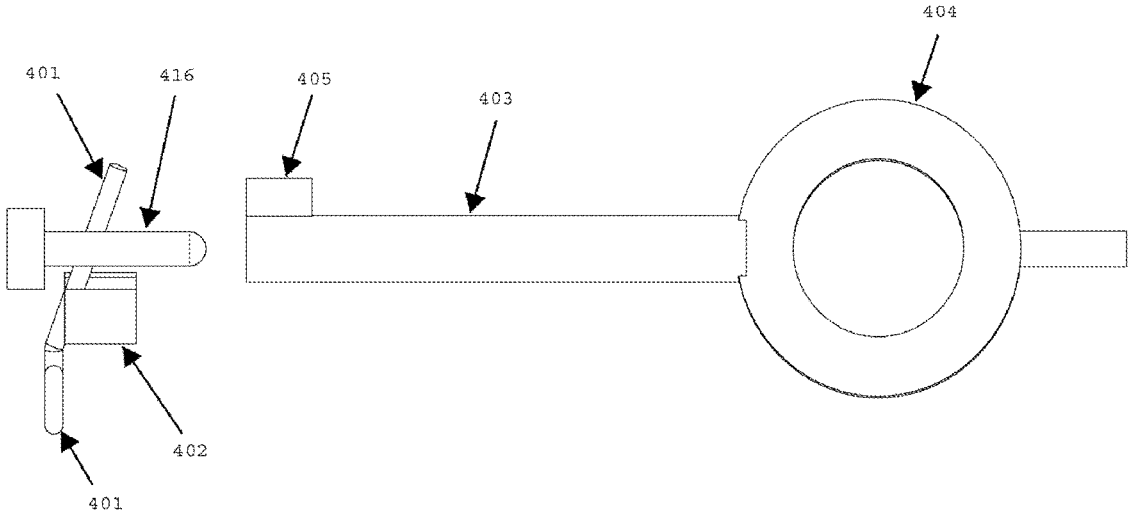
FIG. 4R shows a side view of the double lock bar security spring engaging the double lock bar.
Figure 4S:
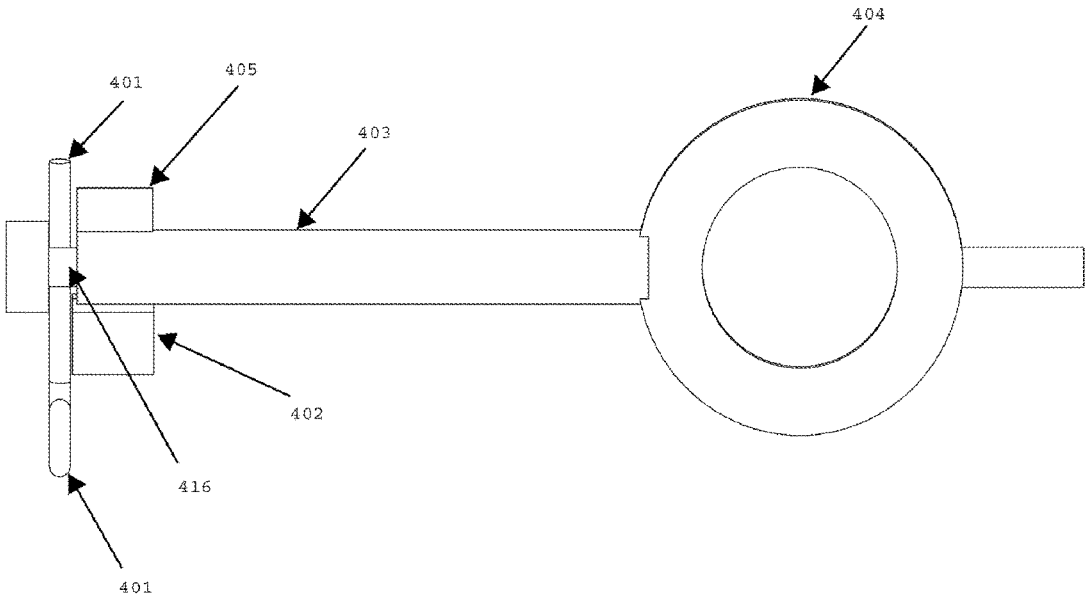
FIG. 4S shows a side view of a handcuff key depressing double lock bar security spring.
Figure 4T:
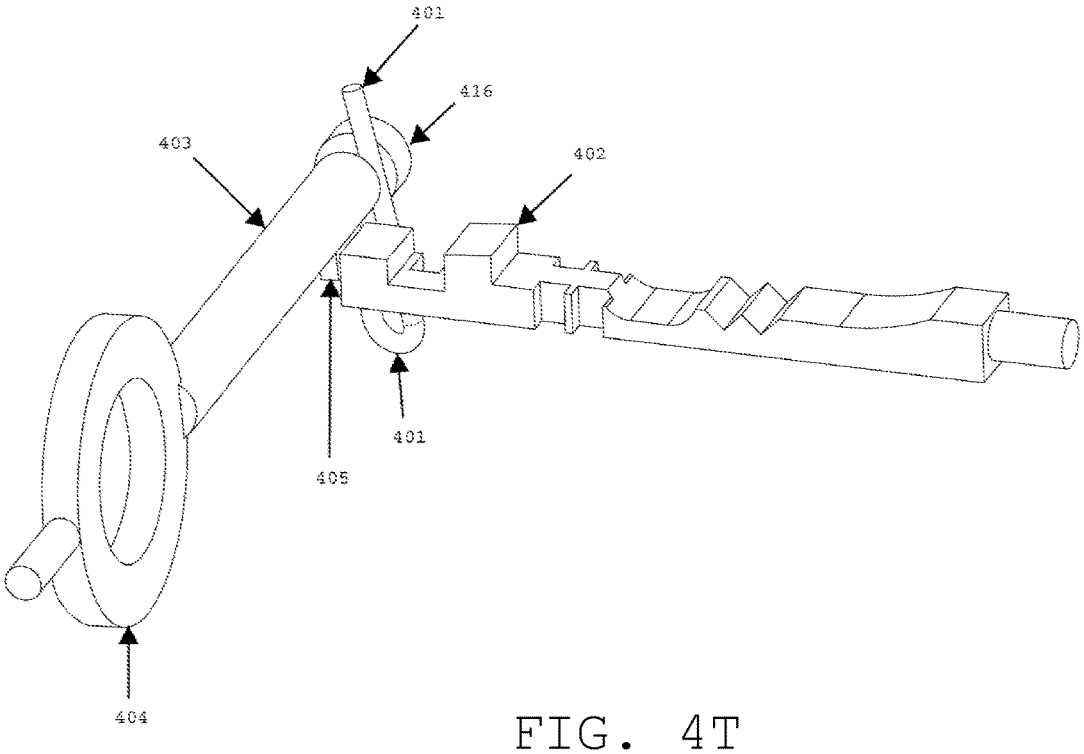
FIG. 4T is a side view of a handcuff key depressing double lock bar security spring and pushing the double lock bar into the unlocked position.

FIG. 4K shows a similar design as described above. However, in this embodiment, the configuration of double lock bar security spring 401 is straight instead of possessing a bend as shown in FIGS. 4B and 4C. FIGS. 4L through 4R show the double lock bar 402 in the locked position. The double lock bar security spring 401 is engaged in the notch of the double lock bar 402. The double lock bar security spring 401 prevents the double lock bar 402 from being unlocked unless the double lock bar security spring 401 is depressed simultaneously. FIG. 4S shows the handcuff key 404 depressing the double lock bar security spring 401 so it is no longer engaged in the notch of the double lock bar 402. While FIG. 4T shows the handcuff key 404 being turned counter clockwise and the key bit 405 pushing the double lock bar 402 into the unlocked position.

Figure 4U:
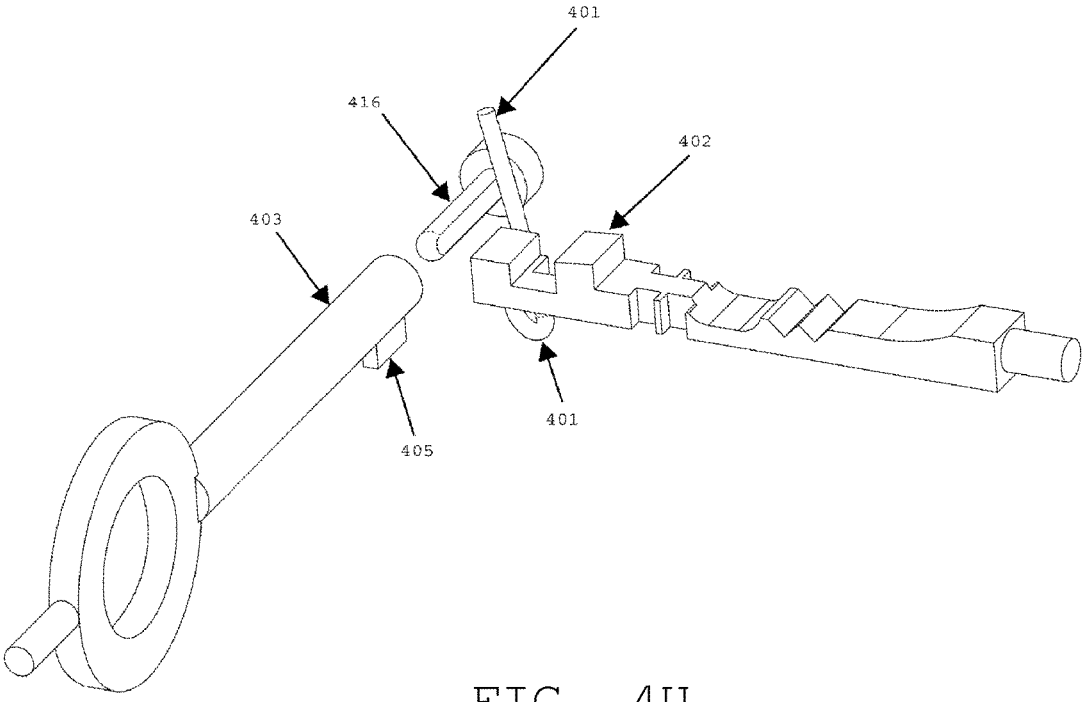
FIG. 4U illustrates the unlocked double lock bar holding the double lock bar security spring.
Figure 4V:
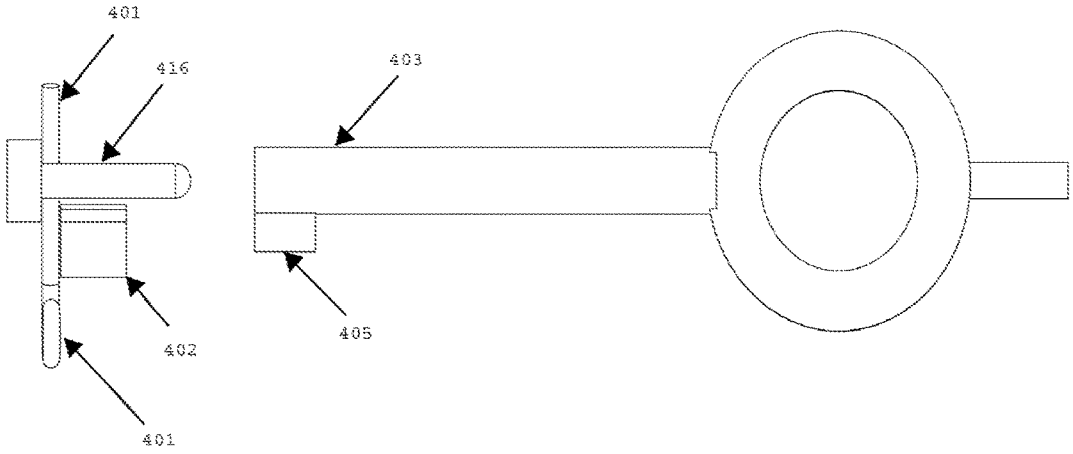
FIG. 4V shows a side view of the unlocked double lock bar holding the double lock bar security spring.

FIG. 4U and FIG. 4V illustrate the double lock bar 402 in the unlocked position, which holds the double lock bar security spring 401 out of the notch of the double lock bar 402.

FIG. 5A is another embodiment of the design including a double lock bar security spring 501 that may be attached to the front double strand plate 509. The double lock bar security spring 501 engages a notch in the double lock bar 502. This arrangement can prevent the double lock bar 502 from being unlocked unless the double lock bar security spring 501 is disengaged first.

FIG. 5A also shows the handcuff key barrel 503, handcuff key 504, handcuff key bit 505, single strand 506, ratchet teeth 507, ratchet side indentations 508, front double strand 509, rear double strand 510, keyhole 511, front ratchet button 512, rear ratchet button 513, double lock bar activation hole 514, key pawls 515, handcuff key guidepost 516, pawl spring 517 and double lock bar security spring notch 518.

FIGS. 5B through 5I show the configuration and position of the double lock bar security spring 501 and how the spring engages the double lock bar 502 when in the double locked position. The double lock bar security spring 501 prevents the double lock bar 502 from being moved into the unlock position unless the spring 501 is first pushed out of the way. FIGS. 5K through 5N show a handcuff key 504 inserted into the keyhole 511, while FIGS. 5O through 5R illustrate a handcuff key 504 inserted into the keyhole 511 and turned counter clockwise. The handcuff key bit 505 engages the double lock bar security spring 501 as it continues to rotate. The double lock bar security spring 501 in this embodiment is U shaped with the apex of the spring resting against the double lock bar 502. This provides a ramped protrusion shape of the spring 501, which allows the bit 505 of the handcuff key 504 to depress as it turns towards the double lock bar 502.

FIGS. 5S and 5T show the handcuff key bit 505 pushing the double lock bar security spring 501 out of the notch of the double lock bar 502. This allows the handcuff key bit 505 to push the side of the double lock bar 502 into the unlocked position. FIGS. 5U through 5X show the double lock bar 502 pushed into the unlocked position. The double lock bar security spring 501 rests against double lock bar 502, which is radiused to allow the spring 501 to move back into the notch of the double lock bar 502.

FIG. 6A illustrates an exploded view of another embodiment of the design. This design may be considered a combination of aspects of the designs depicted in FIG. 4G and FIG. 5A. The design of FIG. 6A uses a rear double lock bar security spring 601 that rests against a rear double strand 602 and double lock bar 603. The design also utilizes a front double lock bar security spring 604 that rests against the front double strand 605 and the double lock bar 603.

In this design, the rear double lock bar security spring 601 and the front double lock bar security spring 604 engage into notches of the double lock bar 603 when the double lock bar 603 is in the locked position. This prevents the double lock bar 603 from being unlocked unless both double lock bar security springs 601 and 604 are disengaged first.

FIG. 6A also shows a handcuff key barrel 606, handcuff key 607, handcuff key bit 608, single strand 609, ratchet teeth 610, ratchet side indentations 611, keyhole 612, front ratchet button 613, rear ratchet button 614, double lock bar activation hole 615, key pawls 616, handcuff key guidepost 617, pawl spring 618 and double lock bar security spring notch 619.

FIGS. 6B through 6K illustrate the double lock bar 603 in the locked position. The rear double lock bar security spring 601 is engaged in a notch in the side of the double lock bar 603. Front double lock bar security spring 604 is engaged in a notch in the side of the double lock bar 603. This arrangement can prevent the double lock bar 603 from being unlocked unless the double lock bar security springs 601 and 604 are disengaged first.

FIGS. 6L through 6O show the handcuff key barrel 606 engaged with the handcuff key guidepost 617. The handcuff key barrel 606 in these views depresses the rear double lock bar security spring 601, which disengages the spring 601 from the notch in the side of the double lock bar 603. Until the handcuff key bit 608 is turned, the front double lock bar security spring 604 remains engaged with the double lock bar 603.

FIGS. 6P through 6S show the handcuff key barrel 606 depressing the rear double lock bar security spring 601 as the handcuff key 607 is turned in a counter clockwise direction. The handcuff key bit 608 engages the front double lock bar security spring 604 as the key continues to turn. The handcuff key bit 608 pushes the front double lock bar security spring 604 against the front double strand 605 so the spring no longer engages with the double lock bar 603. The double lock bar 603 is no longer impeded by the double lock bar security springs 601 and 604, allowing the double lock bar 603 to move into the unlocked position. FIGS. 6T and 6U show the handcuff key bit 608 continuing to rotate counter clockwise and pushing the double lock bar 603 into the unlocked position.

FIGS. 6V through 6Y show the double lock bar 603 in the unlocked position. When in the unlocked position, the double lock bar 603 holds the rear double lock bar security spring 601 and the front double lock bar security spring 604 away from the double lock bar 603 notches. This allows the double lock bar 603 to move freely into the locked position, aligning the double lock bar 603 notches with the double lock bar security springs 601 and 604. The rear double lock bar security spring 601 and the front double lock bar security spring 604 may then move into the notches, locking the double bar 603 into the locked position.

FIG. 7A illustrates an exploded view of a further embodiment of the design. This embodiment utilizes a rear double lock bar security spring 701 resting against the rear double strand 702 and the double lock bar 703. The design also utilizes a front double lock bar security spring 704 resting against the front double strand 705 and the double lock bar 703.

In this design, the rear double lock bar security spring 701 and the front double lock bar security spring 704 engage into notches of the double lock bar 703 when the double lock bar 703 is in the locked position. This prevents the double lock bar 703 from being unlocked unless both double lock bar security springs 701 and 704 are disengaged first.

FIG. 7A, also depicts the handcuff key barrel 706, handcuff key 707, handcuff key bit 708, single strand 709, ratchet teeth 710, ratchet side indentations 711, keyhole 712, front ratchet button 713, rear ratchet button 714, double lock bar activation hole 715, key pawls 716, handcuff key guidepost 717, and pawl spring 718.

FIGS. 7B and 7C show the double lock bar 703 in the locked position. The rear double lock bar security spring 701 and the front double lock bar security spring 704 are engaged in notches in both sides of the double lock bar 703. FIGS. 7D, 7E, 7F, and 7G show the handcuff key 707 engaging with the handcuff key guidepost 717.

FIGS. 7H to 7L show the handcuff key 707 rotating counter clockwise. The handcuff key bit 708 engages with the side of the double lock bar 703 and is positioned to push the double lock bar 703 into the locked position. As the handcuff key bit 708 is engaging the rear double lock bar security spring 701 and the front double lock bar security spring 704, springs 701 and 704 begin disengaging from the side of the double lock bar 703. FIGS. 7M and 7N show the handcuff key bit 708 continuing to rotate and further separating the rear double lock bar security spring 701 and the front double lock bar security spring 704 from the double lock bar 703.

FIGS. 7O and 7P show the handcuff key bit 708 rotated to the point where the rear double lock bar security spring 701 and the front double lock bar security spring 704 from the double lock bar 703. The handcuff key bit 708 has pushed the double lock bar 703 into the unlocked position. The end of the double lock bar 703 is scalloped to allow the double lock bar 703 to easily engage into the locked position despite the presence of the double lock bar security springs 701 and 704.

Thus according to one aspect of the design, there is provided a handcuff comprising a handcuff strand comprising ratchet teeth with openings formed therein, a ratchet button comprising teeth configured to interface with the openings formed in the handcuff strand, a universal handcuff key receptacle configured to receive a universal handcuff key, a pawl arrangement comprising a rotatable pawl element configured to be moved in a direction away from the handcuff strand by the universal handcuff key, the pawl arrangement comprising a spring mechanism, and a lock bar configured to impede movement of the pawl arrangement unless moved to an unlocked position.

According to another aspect of the design, there is provided a restraining arrangement comprising a releasable strand comprising ratchet teeth, the releasable strand having multiple openings formed therein and configured to tighten and loosen about a wearer, a ratchet button configured to pivot and engage at least one opening formed in the releasable strand, a universal key locking receiving mechanism configured to receive a universal key, a multiple element pawl arrangement comprising at least one pawl element configured to be moved in a direction away from the releasable strand by the universal key, the multiple element pawl arrangement comprising a spring mechanism, and a lock bar configured to impede movement at least part of the multiple element pawl arrangement unless moved to an unlocked position.

According to a further aspect of the design, there is provided a set of handcuffs comprising a releasable handcuff strand having a plurality of openings formed therein and comprising ratchet teeth, the releasable handcuff strand configured to tighten and loosen about a wearer, a universal key receptacle configured to receive a universal key, a ratchet button comprising protruding elements configured to interface with the openings formed in the releasable handcuff strand, a pawl arrangement comprising a rotatable pawl element configured to be moved in a direction away from the releasable handcuff strand using the universal key, and a lock bar configured to move linearly and impede movement of the pawl arrangement unless moved to an unlocked position.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but is to be accorded the widest scope consistent with the principles and novel features disclosed herein.

What is claimed is:

1. A handcuff comprising:

a handcuff strand comprising ratchet teeth with openings formed therein;

a pair of ratchet buttons, each ratchet button comprising protruding elements configured to interface with the openings formed in the handcuff strand;

a universal handcuff key receptacle configured to receive a universal handcuff key;

a pawl arrangement comprising a rotatable pawl element configured to be moved in a direction away from the handcuff strand by the universal handcuff key, the pawl arrangement comprising a spring mechanism; and a lock bar configured to impede movement of the pawl arrangement unless moved to an unlocked position;

wherein unlocking the handcuff requires digitally actuating a first of the pair of ratchet buttons concurrently with digitally actuating a second of the pair of ratchet buttons while simultaneously employing the universal handcuff key, thereby releasing the ratchet teeth of the handcuff strand.

2. The handcuff of claim 1, wherein the pawl arrangement comprises a multiple element pawl, wherein every element of the multiple element pawl rotates about a common axis and at least one element of the multiple element pawl is engageable by the universal handcuff key.

3. The handcuff of claim 1, further comprising a movable element configured to be moved when the universal handcuff key is inserted into the universal handcuff key receptacle, thereby enabling movement of the lock bar into an unlocked position.

4. The handcuff of claim 2, wherein the spring mechanism comprises a multiple element spring.

5. The handcuff of claim 1, wherein the pair of ratchet buttons are positioned on opposite sides of the handcuff.

6. The handcuff of claim 1, wherein the lock bar is horizontally slideable and comprises an upper indentation configured to receive part of the pawl arrangement and an upper protrusion configured to inhibit movement of at least a portion of the pawl arrangement.

7. The handcuff of claim 1, wherein the lock bar comprises a notch configured to receive a movable element configured to be moved when the universal handcuff key is inserted into the universal handcuff key receptacle.

8. The handcuff of claim 1, wherein the openings are formed on two sides of the handcuff strand.

9. A restraining arrangement comprising:

a releasable strand comprising ratchet teeth, the releasable strand having multiple openings formed therein and configured to tighten and loosen about a wearer;

a plurality of ratchet buttons comprising a first ratchet button and a second ratchet button configured to pivot and engage at least one opening formed in the releasable strand;

a universal key locking receiving mechanism configured to receive a universal key;

a pawl arrangement comprising at least one pawl element configured to be moved in a direction away from the releasable strand by the universal key, the pawl arrangement comprising a spring mechanism; and a lock bar configured to impede movement at least part of the pawl arrangement unless moved to an unlocked position;

wherein unlocking the restraining arrangement requires digitally actuating the first ratchet button concurrently with digitally actuating the second ratchet button while simultaneously employing the universal handcuff key, thereby releasing the ratchet teeth of the releasable strand.

10. The restraining arrangement of claim 9, wherein the pawl arrangement comprises a three element pawl, wherein every element of the three element pawl rotates about a common axis and at least one element of the multiple element pawl is engageable by the universal key.

11. The restraining arrangement of claim 9, further comprising a movable element configured to be moved when the universal key is inserted into the universal key receptacle, thereby enabling movement of the lock bar into an unlocked position.

12. The restraining arrangement of claim 10, wherein the spring mechanism comprises a three element spring.

13. The restraining arrangement of claim 9, wherein the first ratchet button and the second ratchet button are located on opposite sides of the restraining arrangement.

14. The restraining arrangement of claim 9, wherein the lock bar is horizontally slideable and comprises an upper indentation configured to receive part of the pawl arrangement and an upper protrusion configured to inhibit movement of at least a portion of the pawl arrangement.

15. The restraining arrangement of claim 9, wherein the lock bar comprises a notch configured to receive a movable element configured to be moved when the universal key is inserted into the universal key receptacle.

16. The restraining arrangement of claim 9, wherein the openings are formed on two sides of the releasable strand.

17. A set of handcuffs comprising:

a releasable handcuff strand having a plurality of openings formed therein and comprising ratchet teeth, the releasable handcuff strand configured to tighten and loosen about a wearer;

a universal key receptacle configured to receive a universal key;

a plurality of ratchet buttons comprising a first ratchet button comprising protruding elements configured to interface with the openings formed in the releasable handcuff strand and a second ratchet button configured to interface with the releasable handcuff strand;

a pawl arrangement comprising a rotatable pawl element configured to be moved in a direction away from the releasable handcuff strand using the universal key; and a lock bar configured to move linearly and impede movement of the pawl arrangement unless moved to an unlocked position;

wherein unlocking the releasable handcuff strand requires digitally actuating the first ratchet button concurrently with the second ratchet button while simultaneously employing the universal handcuff key, thereby releasing the ratchet teeth of the releasable handcuff strand.

18. The set of handcuffs of claim 17, wherein the pawl arrangement comprises a spring arrangement and a multiple element pawl, wherein every element of the multiple element pawl rotates about a common axis and at least one element of the multiple element pawl is engageable by the universal key.

19. The set of handcuffs of claim 18, wherein the spring arrangement comprises a multiple element spring.

20. The set of handcuffs of claim 17, further comprising a movable element configured to be moved when the universal key is inserted into the universal key receptacle, thereby enabling sliding movement of the lock bar into an unlocked position.

21. The set of handcuffs of claim 17, wherein the first ratchet button and the second ratchet button are located on opposite sides of one handcuff of the set of handcuffs.

22. The set of handcuffs of claim 17, wherein the lock bar comprises an upper indentation configured to receive part of the pawl arrangement and an upper protrusion configured to inhibit movement of at least a portion of the pawl arrangement.

23. The set of handcuffs of claim 17, wherein the lock bar comprises a notch configured to receive a movable element configured to be moved when the universal key is inserted into the universal key receptacle.

24. The set of handcuffs of claim 17, wherein the openings are formed on two sides of the handcuff strand.

* * * * *